US010918233B2

(12) United States Patent
Shahar

(10) Patent No.: US 10,918,233 B2
(45) Date of Patent: Feb. 16, 2021

(54) DEVICE FOR WEARING SOCKS, AND METHOD OF USING SUCH DEVICE

(71) Applicant: S.B GROUP LTD., Raanana (IL)

(72) Inventor: Tal Shahar, Rishpon (IL)

(73) Assignee: Reuven Boaron, Etz Efraim (IL)

( * ) Notice: Subject to any disclaimer, the term of this patent is extended or adjusted under 35 U.S.C. 154(b) by 80 days.

(21) Appl. No.: 16/335,255

(22) PCT Filed: Sep. 26, 2017

(86) PCT No.: PCT/IL2017/051076
§ 371 (c)(1),
(2) Date: Mar. 21, 2019

(87) PCT Pub. No.: WO2018/055628
PCT Pub. Date: Mar. 29, 2018

(65) Prior Publication Data

US 2019/0254458 A1 Aug. 22, 2019

Related U.S. Application Data

(60) Provisional application No. 62/399,495, filed on Sep. 26, 2016.

(51) Int. Cl.
*A47G 25/90* (2006.01)

(52) U.S. Cl.
CPC ..... *A47G 25/905* (2013.01); *A47G 25/90* (2013.01)

(58) Field of Classification Search
CPC .... A47G 25/905; A47G 25/90; A47G 25/907; A47G 25/908; A47G 25/80; A41F 11/00; A41F 13/00

(Continued)

(56) References Cited

U.S. PATENT DOCUMENTS 2,828,057 A 3/1958 MacLauchlan
3,231,160 A * 1/1966 Glanville ..... A47G 25/905 223/111

(Continued)

FOREIGN PATENT DOCUMENTS

DE 20306424 U1 7/2003
DE 102004001905 A1 10/2005

(Continued)

OTHER PUBLICATIONS

International Search Report (ISR) in PCT/IL2017/051076, dated Jan. 18, 2018.

(Continued)

*Primary Examiner* — Ismael Izaguirre
(74) *Attorney, Agent, or Firm* — Eitan Mehulal Sadot

(57) ABSTRACT

An apparatus for donning socks includes: a substantially horizontal base; an elongated U-shaped, semi-cylindrical caddy on which a sock positioned inside out is fittable and into an interior of which a foot is insertable; and a tilt unit coupled to the semi-cylindrical caddy and pivotally connected to a head portion of the base. The semi-cylindrical caddy includes two elongated slider channels, that allow a handle assembly of the apparatus to slide back-and-forth within the elongated slider channels. The handle assembly includes a telescopic right-side rod and a generally-parallel telescopic left-side rod, which are interconnected by a generally-horizontal fixed-size bridge handle.

14 Claims, 75 Drawing Sheets

(58) Field of Classification Search
USPC ..... D2/641
See application file for complete search history.

(56) References Cited

U.S. PATENT DOCUMENTS

| | | | | |
|---|---|---|---|---|
| 4,238,061 | A | 12/1980 | Marchetti | |
| 5,593,071 | A | 1/1997 | Lusk | |
| 5,894,970 | A | 4/1999 | Belkin | |
| 5,927,573 | A | 7/1999 | Votino | |
| 6,102,262 | A | 8/2000 | Nicholson | |
| 6,951,224 | B2 | 10/2005 | Garrett | |
| 7,270,253 | B2 | 9/2007 | Radke | |
| 7,287,675 | B1 | 10/2007 | Sullivan | |
| 7,364,056 | B2 | 4/2008 | Boaron | |
| 8,356,735 | B1 * | 1/2013 | Drakeford | A47G 25/908 223/112 |
| 8,393,503 | B2 | 3/2013 | Moscato | |
| 8,528,796 | B1 | 9/2013 | Bosko et al. | |
| 9,119,494 | B2 * | 9/2015 | Boaron | A47G 25/905 |
| 9,282,840 | B2 * | 3/2016 | Moscato | A47G 25/907 |
| 2006/0027612 | A1 | 2/2006 | Boaron | |
| 2006/0076372 | A1 * | 4/2006 | Delaware | A47G 25/905 223/111 |
| 2008/0308587 | A1 * | 12/2008 | Schelhaas | A47G 25/908 223/111 |
| 2009/0120975 | A1 | 5/2009 | Schoepe | |

FOREIGN PATENT DOCUMENTS

| | | | |
|---|---|---|---|
| EP | 1442686 | A1 | 8/2004 |
| IE | 2940038 | A1 | 4/1981 |
| WO | 2008/006142 | A1 | 1/2008 |
| WO | WO 2011051582 | A2 * | 5/2011 |
| WO | WO 2014202083 | A1 * | 12/2014 |

OTHER PUBLICATIONS

Written Opinion of the International Searching Authority in PCT/IL2017/051076, dated Jan. 18, 2018.
Letter from the European Patent Office in patent application EP 17852547, dated May 6, 2020.

* cited by examiner

DEVICE FOR WEARING SOCKS, AND METHOD OF USING SUCH DEVICE

CROSS-REFERENCE TO RELATED APPLICATIONS

This patent application is a National Stage of PCT international application number PCT/IL2017/051076, having an international filing date of Sep. 26, 2017, published as international publication number WO 2018/055628 A1, which is hereby incorporated by reference in its entirety; which claims benefit and priority from U.S. provisional patent application No. 62/399,495, filed on Sep. 26, 2016, which is hereby incorporated by reference in its entirety.

FIELD

The present invention relates to the field of socks, as well as aids for daily living and aids for wearing socks.

BACKGROUND

Millions of people wear socks every day. A sock is an item of clothing worn on the foot. In hot climate or hot environment, socks may absorb sweat and perspiration from the feet. In cold climate or cold environment, socks may provide comfort and heating to the feet, and may decrease the risk of frostbite. Socks are often worn as an intermediary layer between the bare feet and a pair of shoes, thereby providing additional comfort to the wearer.

Socks may be manufactured from various materials, for example, cotton, wool, nylon, acrylic, polyester, spandex, silk, and/or other material(s). Socks may be manufactured in different sizes or lengths, for example, ankle socks, knee-high socks, over-the-knee socks, or the like.

SUMMARY

The present invention may include, for example, devices for wearing socks, or devices which may assist a person to put-on or to wear or to don a sock; as well as methods of utilizing or operating such devices.

The present invention may provide other and/or additional benefits and/or advantages.

DETAILED DESCRIPTION OF SOME EMBODIMENTS

Figure 1:
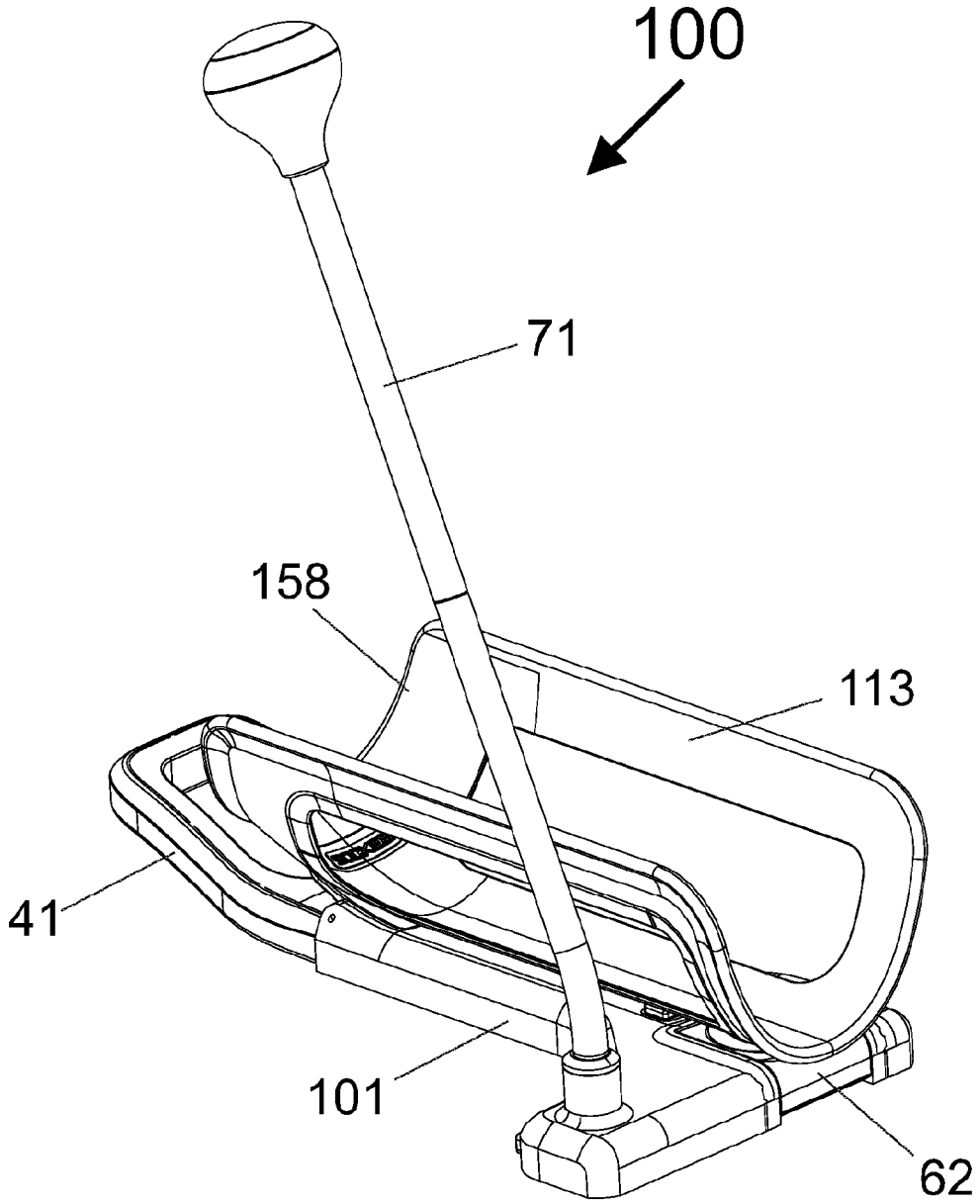
FIG. 1 is a perspective view from the side of sock donning apparatus in a rest position, in accordance with some demonstrative embodiments of the present invention.

Embodiments of the present invention may comprise devices for wearing socks; including the device(s) that are shown in any one of FIGS. 1 to 31C, and/or that are discussed herein with reference to any one of FIGS. 1 to 31C, as well as modifications and/or improvements of such devices as described herein. The devices of the present invention may comprise, any one or more features or components that are shown in FIGS. 1 to 31C, and/or any one or more features or components that are discussed with reference to any one of FIGS. 1 to 31C, and/or any other components, additions, substitutions, or modifications that are described herein with reference to FIGS. 32 to 37H, and some or all of such components or units may be utilized in combination and/or in cooperation with each other, in accordance with the present invention.

The term "sock" as used herein may include any suitable type of sock or foot apparel, or any type of garment or article-of-clothing which is intended for wearing on the foot.

Applicants have realized that some people may have difficulty in wearing (or donning) socks by themselves. Such persons may include, for example, disabled persons, handicapped or invalid persons, persons that suffer from a particular disease or medical condition, children, senior citizens, old persons, persons that are tired or exhausted, persons that have difficulty bending down and/or reaching their toes and/or reaching their feet and/or reaching their ankles, or the like. Furthermore, other types of users, who may not suffer from any limiting condition, may still benefit from a device which may assist user to put-on socks, and which may obviate the need to bend-down or to reach-down in order to put on the socks.

The present invention relates to the field of invalid aids and appliances. More particularly, the invention relates to an apparatus and method for self-serve use by invalids or handicapped persons, and especially for use by invalids with amputated or disabled arms, or by people having muscular dystrophy or tendon problems, permitting a person to don his sock without any assistance.

Applicants have realized that people with various physically limiting conditions may have difficulty in dressing themselves unassisted by a second individual, limiting their ability to live independently; this at times contributes to lowered self-esteem and depression. Examples of limiting physical conditions that may contribute to such difficulties while properly and comfortably getting dressed may include: pregnancy, obesity, and a diminished range of motion in the back, hip, knee, ankle, or foot; often caused by injury, disease, or surgery. Applicants have realized that one special problem for invalids, handicapped persons with amputated or disabled arms, people having muscular dystrophy or tendon problems, or people who are recovering from a surgery, is the donning of socks.

Applicants have realized that some prior attempts to provide a sock donning device, have resulted in complicated devices that are unusable for an invalid or a handicapped person with amputated or disabled arms, or for persons having muscular dystrophy or tendon problems. Additionally or alternatively, such prior attempts have resulted in devices that do not operate well, or which still require utilization of two hands, or which require an assistance from another person, or which cause the sock to slip or to fall, or which suffer from various other complexities and/or deficiencies.

Applicants have realized that there is a need for an apparatus which will aid in donning socks or any other articles of hosiery, and which does not require the user to bend down, or pull, or receive assistance from another person, or the use of hands. Until now, none of the prior art devices provided a complete solution to the problem of the donning of socks or any other article of hosiery, without any assistance of another, for invalids or handicapped persons with amputated or disabled arms, or for persons having muscular dystrophy or tendon problems, or for persons with any other limiting physical condition.

The present invention seeks to overcome these difficulties by providing a sock donning apparatus which is easy to use and simple in maintenance.

Some embodiments of the present invention may provide a novel sock donning apparatus and method having many advantages while simultaneously overcoming disadvantages that prior art devices suffer from.

Some embodiments of the present invention may provide donning apparatus which is of a durable and reliable construction.

Some embodiments of the present invention may provide a sock donning apparatus which does not require a pulling motion by the user's arm, and/or does not require the user to bend his back or to bend his body, or which require the user to only slightly bend his back and/or his body.

Some embodiments of the present invention may provide a sock donning apparatus that aids a user who is an invalid, a handicapped person with amputated or disabled arms, a person having muscular dystrophy or tendon problems, a user that is recovering from surgery, or a person with any other limiting physical condition, in putting on socks within a minimal time, without requiring assistance from other person(s), and/or without bending down, and/or without bending his (or her) back, and/or without the need to reach down with the wearer's hand(s) to the wearer's toes or ankles or feet, and/or with reduced or minimal strain on the wearer's body.

Some embodiments of the present invention may provide a sock donning apparatus which utilizes the elasticity of socks to provide an easy fit for legs (or feet) of different sizes.

Some embodiments of the present invention may provide a sock donning apparatus which is compatible with socks of different sizes and types.

Some embodiments of the present invention may provide a sock donning apparatus which may be easily and efficiently manufactured and/or marketed and/or maintained and/or utilized.

Some embodiments of the present invention may provide a sock donning apparatus which may have a low cost of manufacture with regard to both materials and labor, and which accordingly may have a low cost or reduced cost for consumers.

These and further features of the present invention will be more readily appreciated when considering the following disclosure and appended drawings. Other objects and advantages of the invention will become apparent as the description proceeds.

The present invention provides apparatus for donning or wearing or putting-on socks (or a single sock; or a single garment typically worn on a foot), comprising a substantially horizontal base, an elongated U-shaped, semi-cylindrical caddy on which a sock positioned inside out is fittable and into an interior of which a foot is insertable, and a tilt unit coupled to said caddy and pivotally connected to a head portion of said base.

The sock is kept open prior to a sock donning operation to facilitate insertion of a foot into the sock. The pivotally connected tilt unit advantageously supports a pushing motion of the leg and/or of the foot, and does not require a pulling motion of an arm of the user, as has been practiced heretofore in some prior art devices.

In some embodiments, the base may be T-shaped so as to be configured by an elongated main portion and two spaced, forwardly positioned head portions, the tilt unit being insertable within an interspace between said two head portions and pivotally connected to said two head portions by at least one coupled horizontally disposed pin which is substantially perpendicular to said main portion and introducible within a recess formed within a forwardly positioned projection of the tilt unit, allowing the tilt unit and caddy to be tilted about a horizontal axis during a sock donning operation.

In some embodiments, the tilt unit may have a central through-hole through which a part protruding from the caddy and connected with a projection of a flange passes, said through-hole being positioned rearwardly from the projection of the tilt unit, allowing the caddy and flange to be rotated in unison about a vertical axis during the sock donning operation.

The flange may limit the rotational displacement of the caddy about a central axis of the through-hole. An inner face of each of the two head portions may have an upper, substantially straight and unreccesed region, and a lower region which is angularly recessed with respect to said upper region, thereby allowing the flange to rotate for a predetermined angular distance when the caddy is at a rest position until the flange contacts said inner face, yet preventing the flange from rotating when the caddy is tilted.

The apparatus may further comprise a hook member which is engageable with a stationary or relatively stationary element for providing a reactive force during the sock donning operation.

In some embodiments, the main portion of the base may be hollowed to fixedly receive the hook member, and the hook member may be selectively extendable with respect to the main portion of the base.

In some embodiments, the hook member may comprise an elongated positioning bar formed with a plurality of longitudinally spaced latching grooves, a hook rearwardly extending from said positioning bar, and a spring biased detent pivotally connected to the main portion of the base for selectively engaging one of said grooves. The detent may comprise a finger contactable portion for disengaging the detent from the engaged groove, to allow the bar to be repositioned.

The apparatus may further comprise a pole assembly extending upwardly from one of the head portions, for facilitating manual displacement of the apparatus.

In some embodiments, the pole assembly may comprise a straight pole section and a bent pole section that is movable within a cup attachment fixed to the base, for facilitating apparatus repositioning.

The present invention further includes a method for donning socks, comprising the steps of, for example: providing an apparatus comprising a substantially horizontal base and an elongated U-shaped, semi-cylindrical caddy movably coupled to said base; fitting a sock in an inside out arrangement over a rearward terminal edge of said caddy; securing said base to a relatively stationary element for providing a reactive force during a sock donning operation while a user is positioned to the rear of said caddy; inserting a foot of the user into the interior of the sock, while said foot applies a moment to said caddy to cause said caddy to pivot and an open end of the sock is gradually slipped off said rearward terminal edge of said caddy; and fully inserting toes of the user into a toe portion of the sock, to cause said caddy to assume a final pivoted position and the sock to be released from said caddy.

In some embodiments, the caddy also may rotate about a substantially vertical axis while the foot is being inserted into the interior of the sock.

In some embodiments, a first apparatus and a second (generally similar or generally identical) apparatus may be positioned forwardly to right and left feet, respectively, and first and second socks are donned on the right and left feet, respectively, thereby, allowing the first and second socks to be donned simultaneously, or concurrently, or in a serial manner (e.g., one after the other), by the same wearer.

In some embodiments, the method may further comprise the steps of: providing a hook member coupled to the base, and affixing said hook member to the relatively stationary element. The hook member may be extendable, and the length of the hook member may be set prior to inserting the foot into the interior of the sock.

In some embodiments, a pole assembly extending upwardly from the base may be manipulated or utilized by the user in order to adjust a direction of the caddy relative to a direction of the foot to be inserted into the interior of the sock.

In some embodiments, the pole assembly may comprise a straight pole section, a hand graspable knob fitted from above to said straight pole section, and a bent pole section fitted from below to said straight pole section that is rotatable within a cup attachment fixed to the base, and wherein the user selectively rotates said bent pole section when desired to bring said knob closer or farther away from the relatively stationary element in order to facilitate apparatus repositioning.

In some embodiments of the present invention, for example, an apparatus for donning (or wearing) a sock may comprise: a substantially horizontal base; an elongated U-shaped, semi-cylindrical caddy on which a sock positioned inside out is fittable and into an interior of which a foot is insertable; and a tilt unit coupled to said caddy and pivotally connected to a head portion of said base.

In some embodiments, the base is T-shaped and is configurable by an elongated main portion and two spaced, forwardly positioned head portions. The tilt unit is insertable within an interspace between said two head portions. The tilt unit is pivotally connected to said two head portions by at least one coupled horizontally disposed pin which is substantially perpendicular to said main portion. The pin is introducible within a recess formed within a forwardly positioned projection of the tilt unit. The tilt unit and the caddy are able to be tilted about a horizontal axis during a sock donning operation.

FIG. 1 illustrates a perspective view of sock donning apparatus 100 from the side, according to some demonstrative embodiments of the present invention. Apparatus 100 may comprise a base 101 and an elongated U-shaped (or concave, or convex), semi-cylindrical tube or caddy 113, for foot and/or leg placement (e.g., able to fit or to accommodate therein a human foot) that may be pivotally connected by a tilt unit 62 to base 101. A sock intended to be worn by the user is positionable on rounded rearward terminal edge 158 of caddy 113. Caddy 113 is shown in a rest position or starting position or initial position.

Base 101 may be substantially T-shaped or may be generally T-shaped, and its main portion may be hollowed to receive a slidable hook member 41, shown in a retracted position. Extending upwardly from the head or front of base 101 is a pole assembly 71, which may be used to manually displace apparatus 100 to a position that is more convenient to a user during a sock donning (sock wearing, sock putting-on) operation.

Figure 2A:
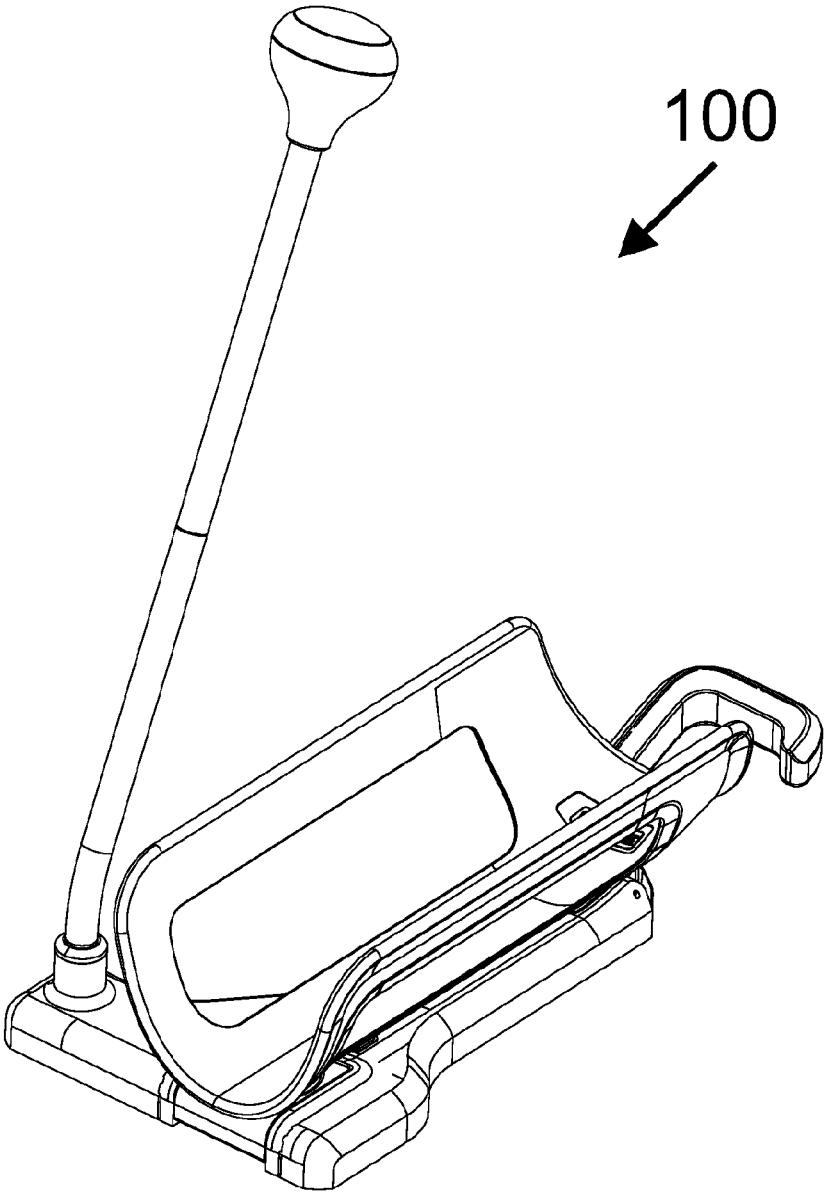
FIGS. 2A and 2B are two perspective views of the sock donning apparatus, in the rest position, in accordance with some demonstrative embodiments of the present invention.
Figure 2B:
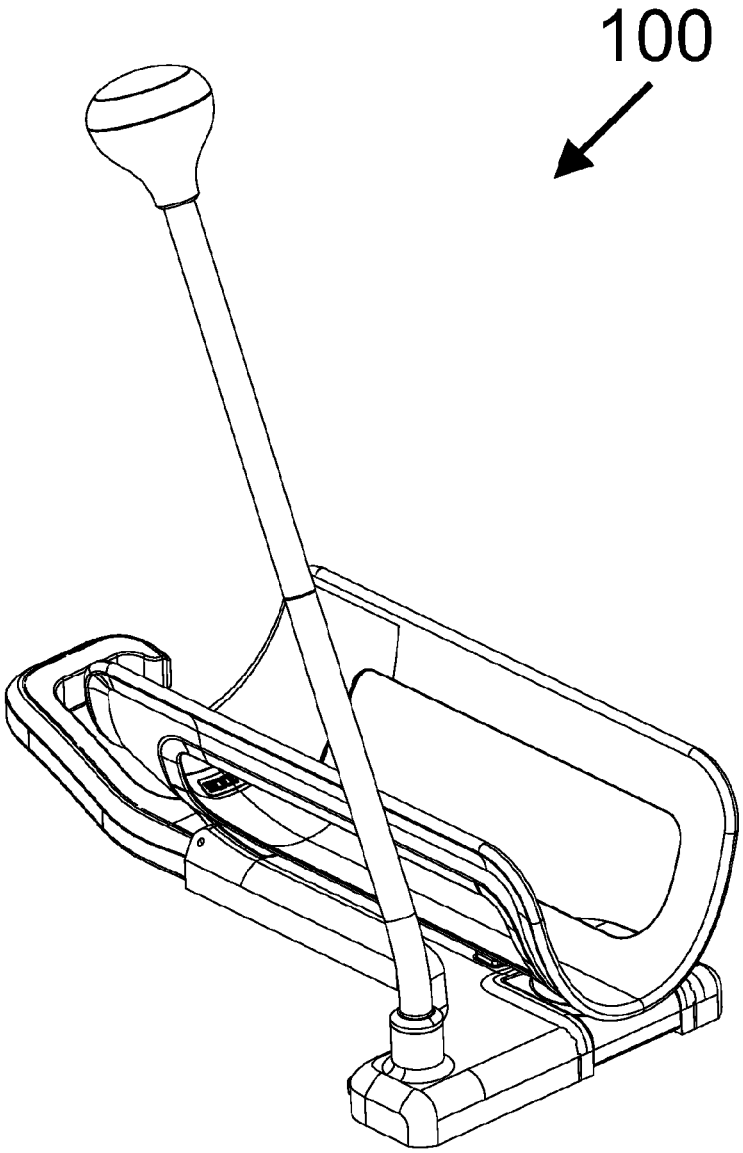
Figure 3:
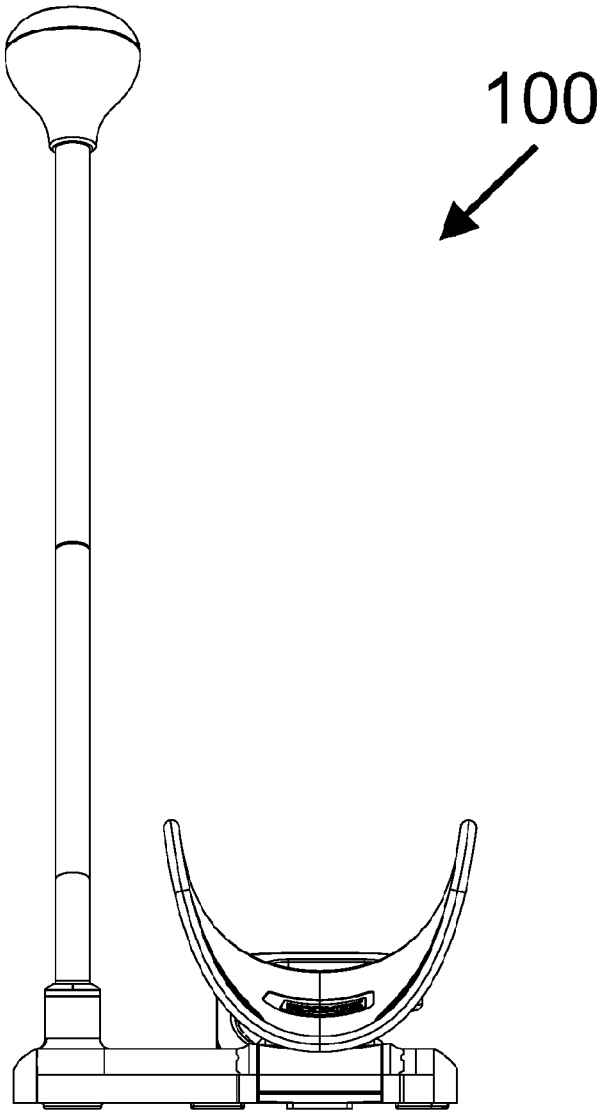
FIG. 3 is a front view of the sock donning apparatus in the rest position, in accordance with some demonstrative embodiments of the present invention.
Figure 4:
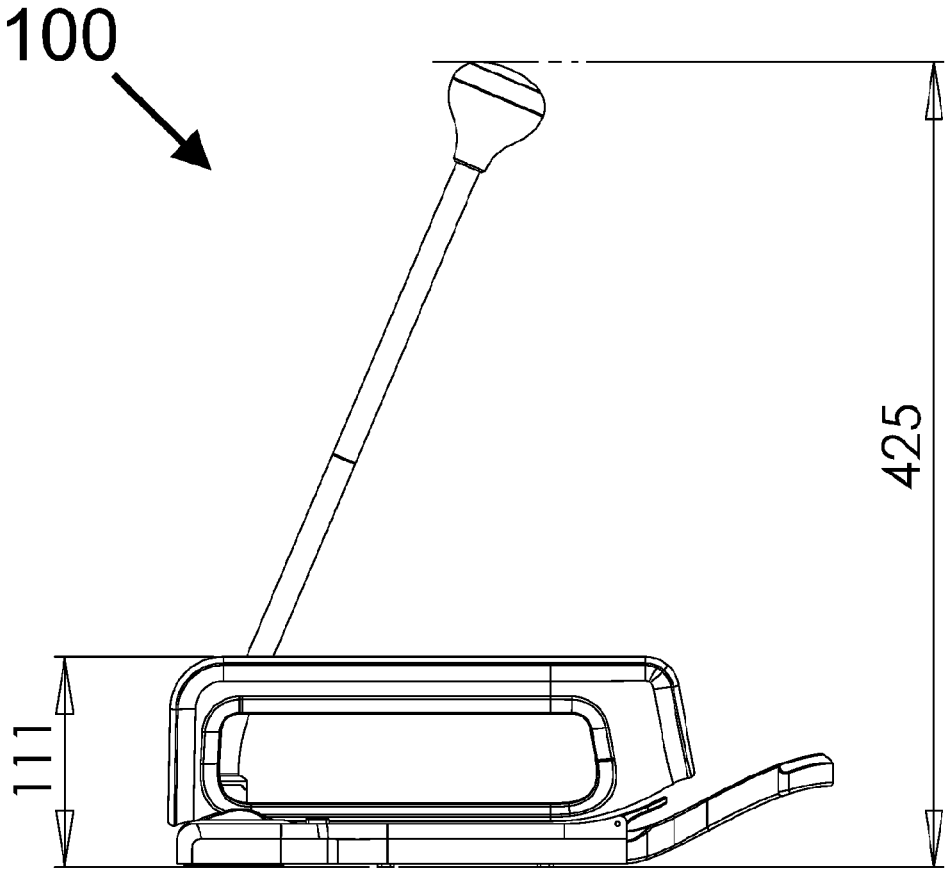
FIG. 4 is a side view of the sock donning apparatus in the rest position, in accordance with some demonstrative embodiments of the present invention.
Figure 5:
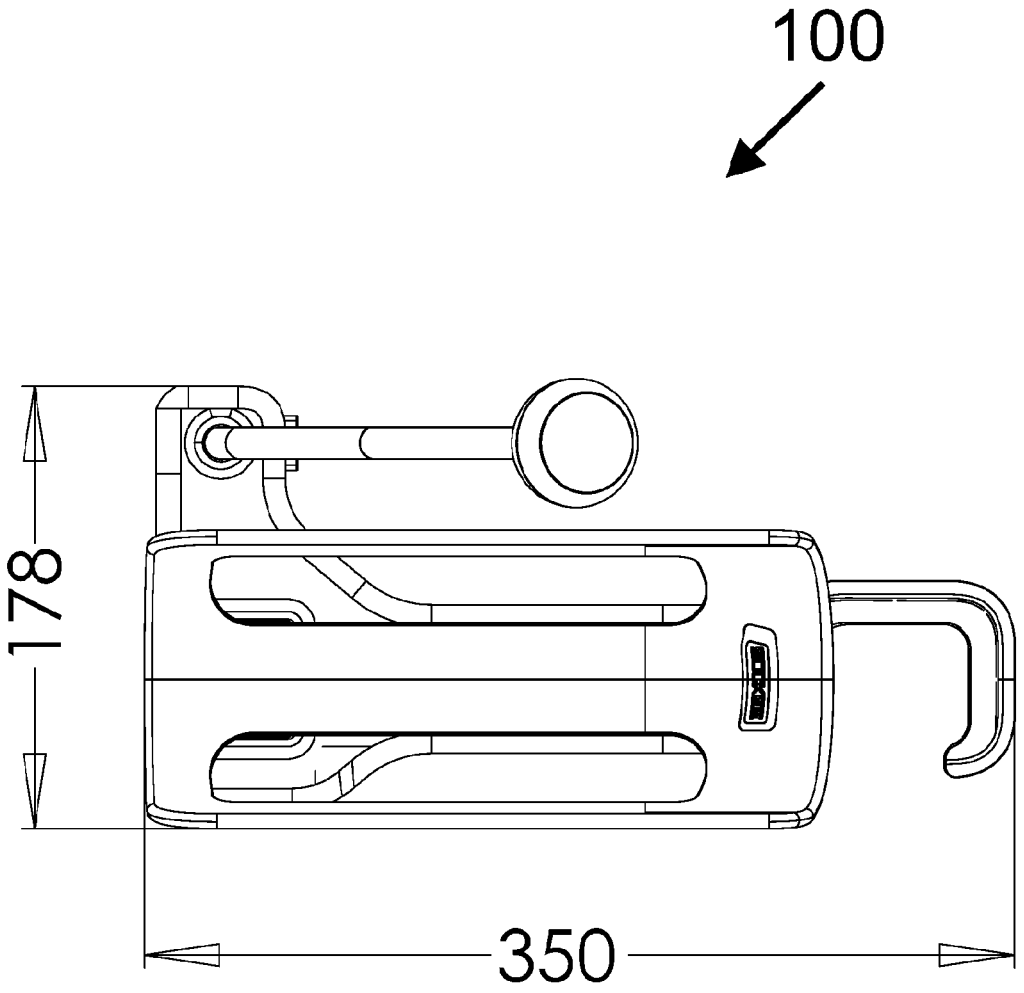
FIG. 5 is a top view of the sock donning apparatus in the rest position, in accordance with some demonstrative embodiments of the present invention.
Figure 6A:
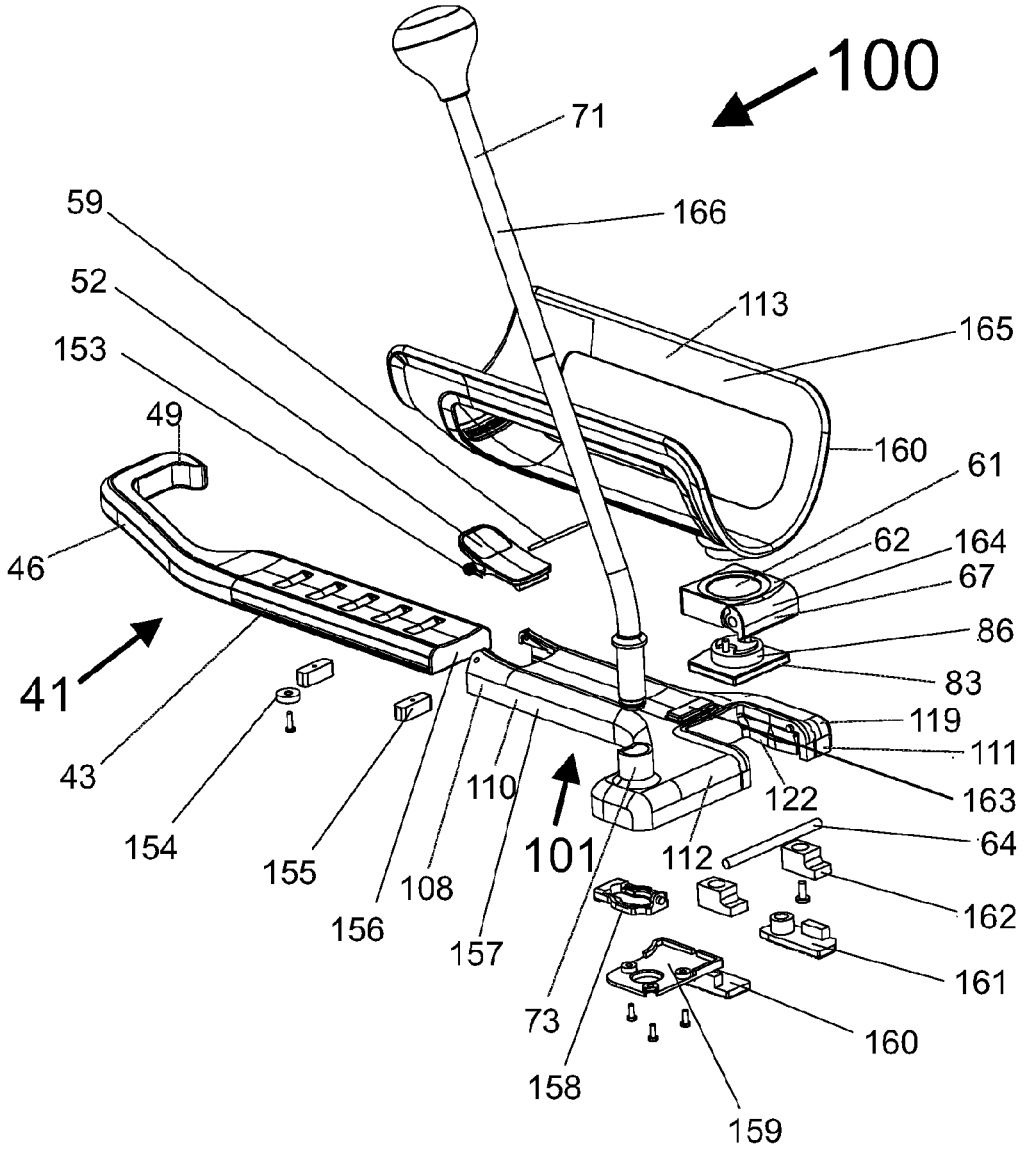
FIGS. 6A and 6B are exploded views of the sock donning apparatus in the rest position, in accordance with some demonstrative embodiments of the present invention.
Figure 6B:
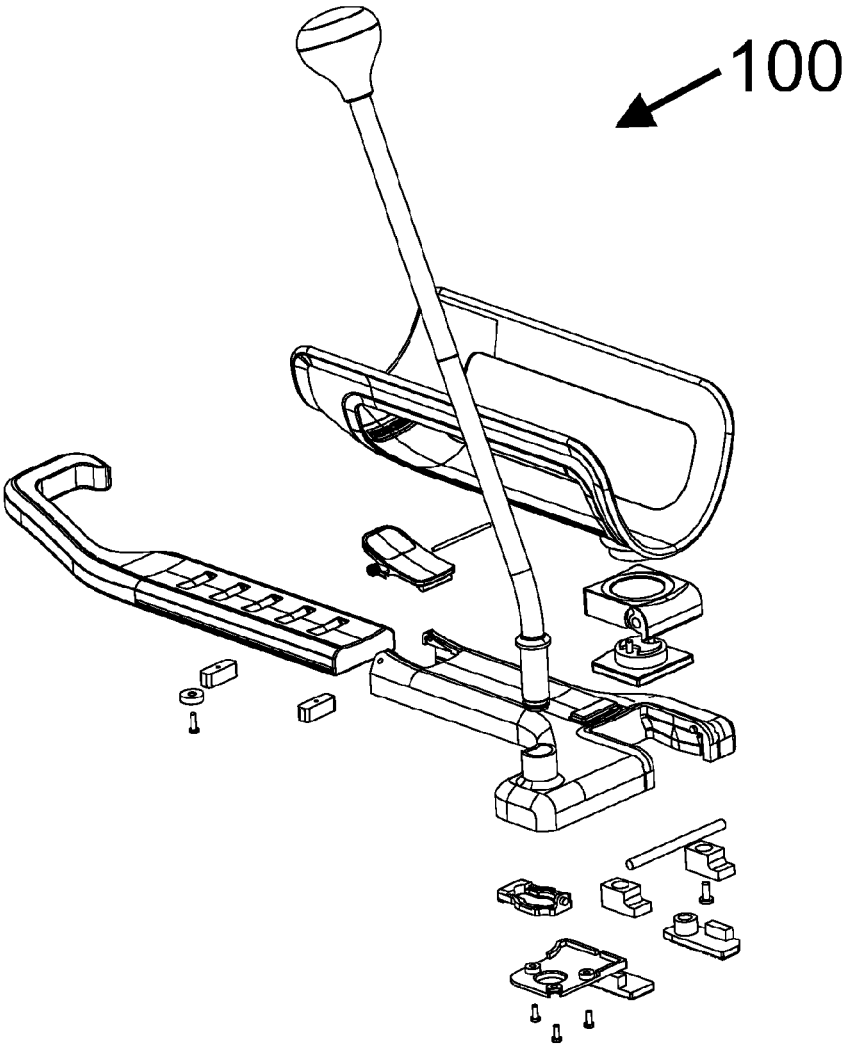

At this caddy rest position, apparatus 100 is shown in perspective views in FIGS. 2A-2B, in a front view in FIG. 3, in a side view in FIG. 4, in a top view in FIG. 5, and in exploded views in FIGS. 6A-6B.

With reference to FIGS. 6-9, a spring biased detent 52 for selectively engaging hook member 41 in order to set a desired degree of extension from base 101 may be pivotally connected by pin 59 to seats 106 formed in a corresponding protrusion 108 to main portion 110 of base 101.

Hook member 41 may comprise an elongated positioning bar 43 which may be formed, for example, with a plurality of longitudinally spaced latching grooves 45, and an inclined element 46 considerably thinner than, and extending slightly upwardly from, the longitudinal end of bar 43. Inclined element 46 may be able to change direction to define hook 49, which may be engageable with the leg of a chair or other furniture or any other stationary or relatively stationary element that can provide a reactive force (or counter-force) during a sock donning operation, as described herein.

Detent 52 may have a first rearwardly oriented portion 53 for contacting the upper surface of bar 43 and a second, finger contactable portion 54 extending rearwardly and obliquely from first portion 53. A protuberance 57 for engaging a selected groove 45 may extend downwardly from first portion 53, generally at the forward end thereof.

Second portion 54 may be normally spaced from inclined element 46 of hook element 41. Second portion 54 may be lowered when a finger applies a force thereto, causing protuberance 57 to be disengaged from groove 45 and allowing bar 43 to be displaced to a different longitudinal position with respect to main portion 110 of base 101. When the force is released, detent 52 returns to its original position and once again hook member 41 is fixed to a selected longitudinal position.

Figure 7:
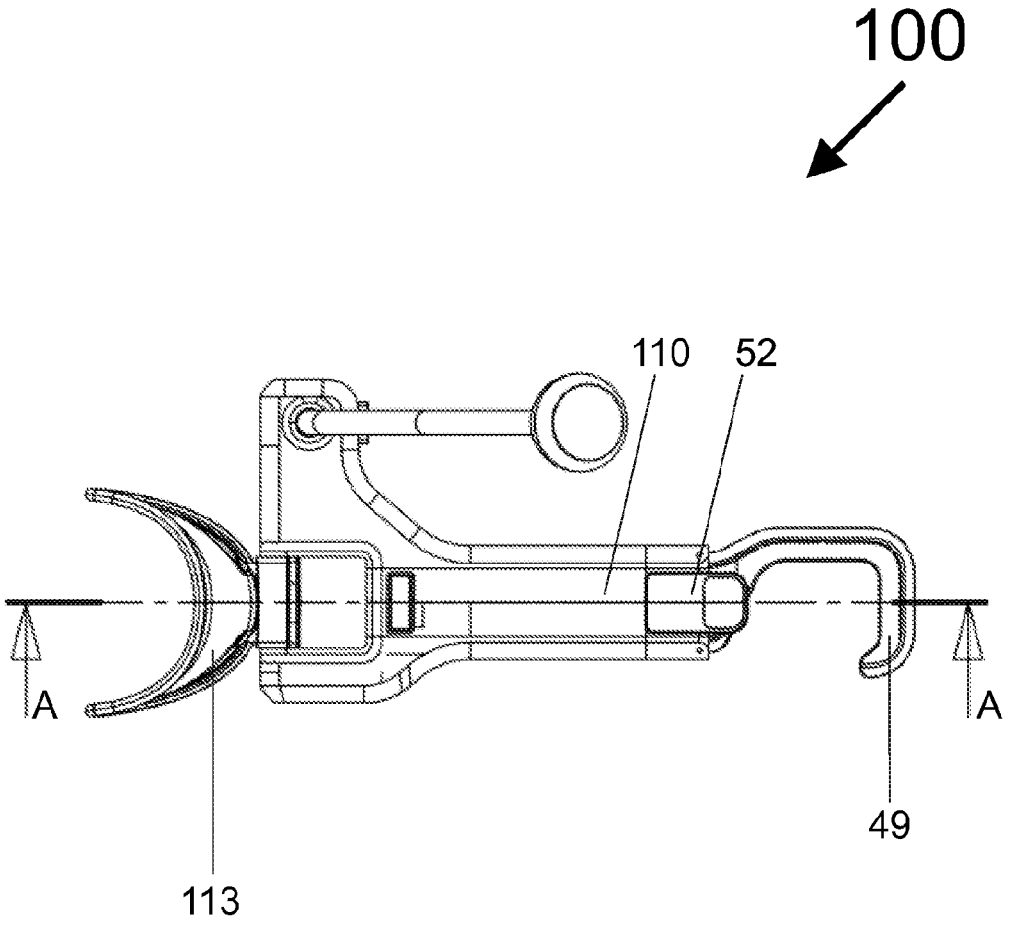
FIG. 7 is a partial top view of the sock donning apparatus, when the caddy is in a fully tilted position and the hook member is in a fully retracted position, in accordance with some demonstrative embodiments of the present invention.
Figure 8:
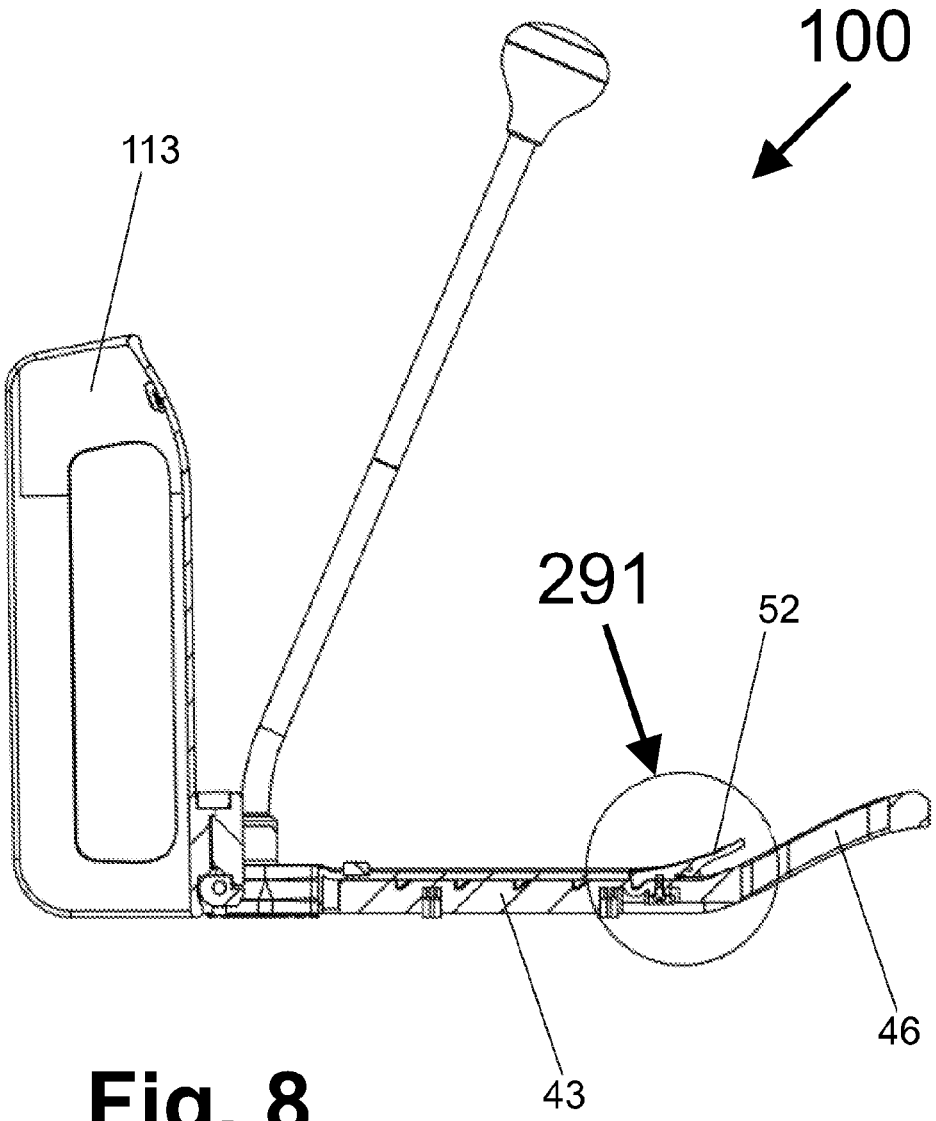
FIG. 8 is a side cross sectional view (corresponding to section A-A of FIG. 7) of the sock donning apparatus, when the caddy is in a fully tilted position and the hook member is in a fully retracted position, in accordance with some demonstrative embodiments of the present invention.
Figure 9:
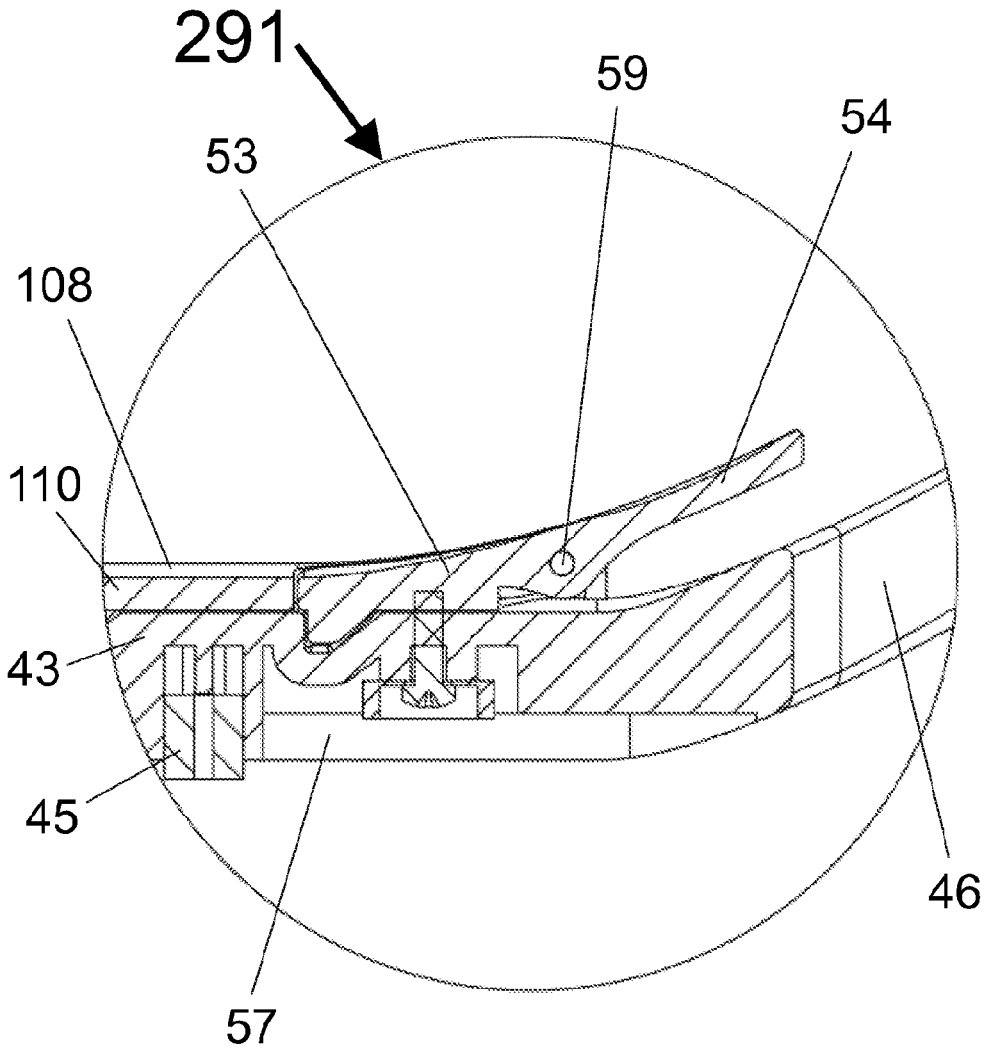
FIG. 9 is an enlargement of Detail 291 of FIG. 8, showing the details of the hook latch, in accordance with some demonstrative embodiments of the present invention.
Figure 10:
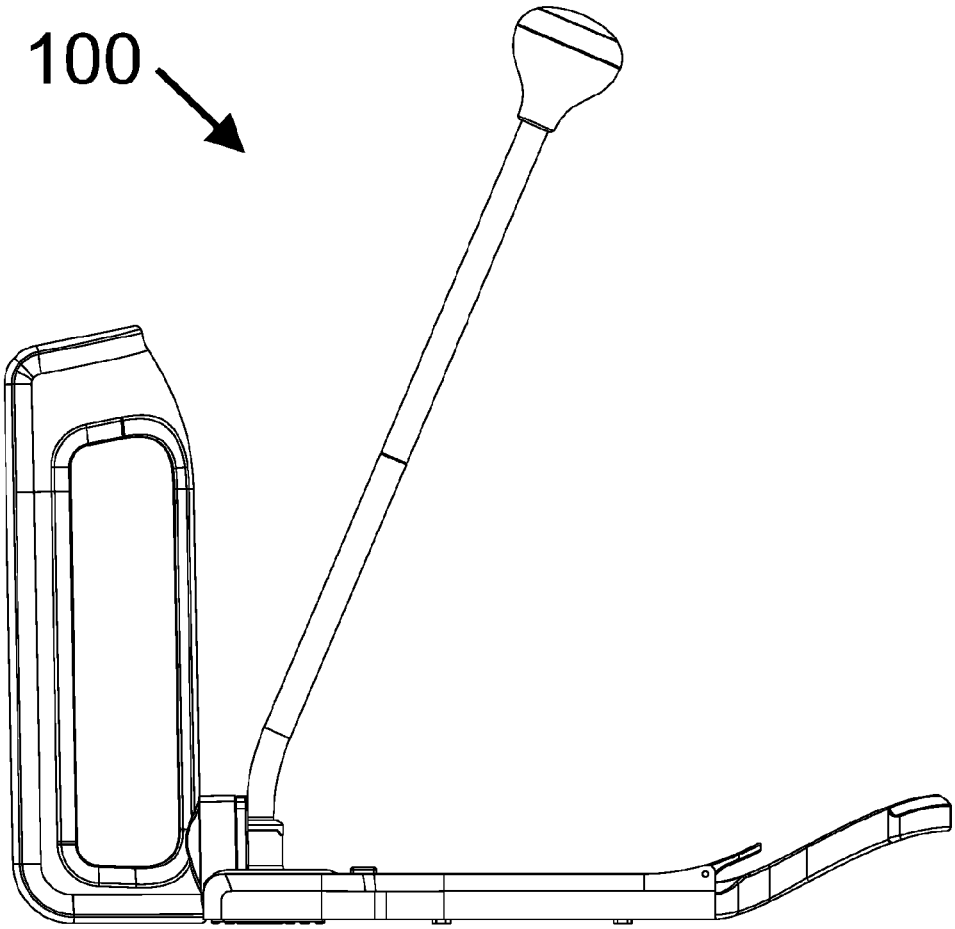
FIG. 10 is a side view of the sock donning apparatus, when the caddy is in a fully tilted position and the hook member is in a fully retracted (or closed) position, in accordance with some demonstrative embodiments of the present invention.
Figure 11:
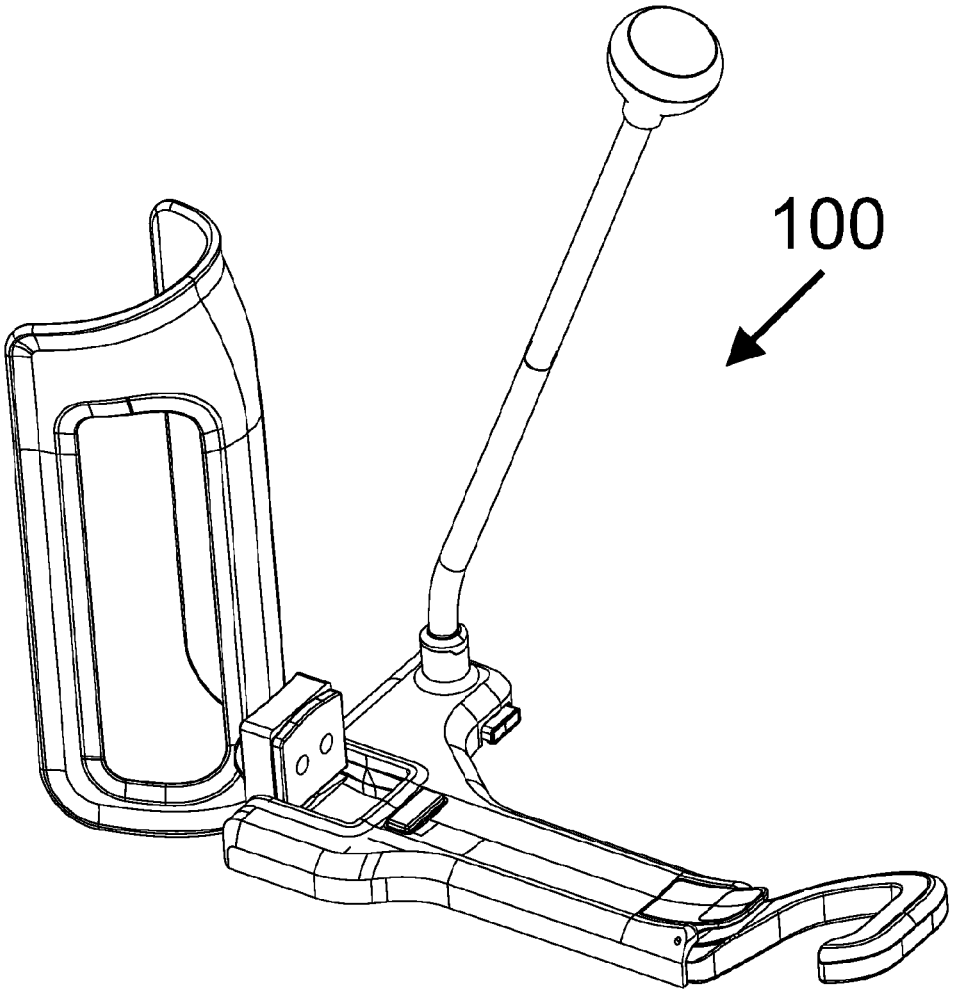
FIG. 11 is a perspective view from the top of the sock donning apparatus, when the caddy is in a fully tilted position and the hook member is in a fully retracted (or closed) position, in accordance with some demonstrative embodiments of the present invention.
Figure 12:
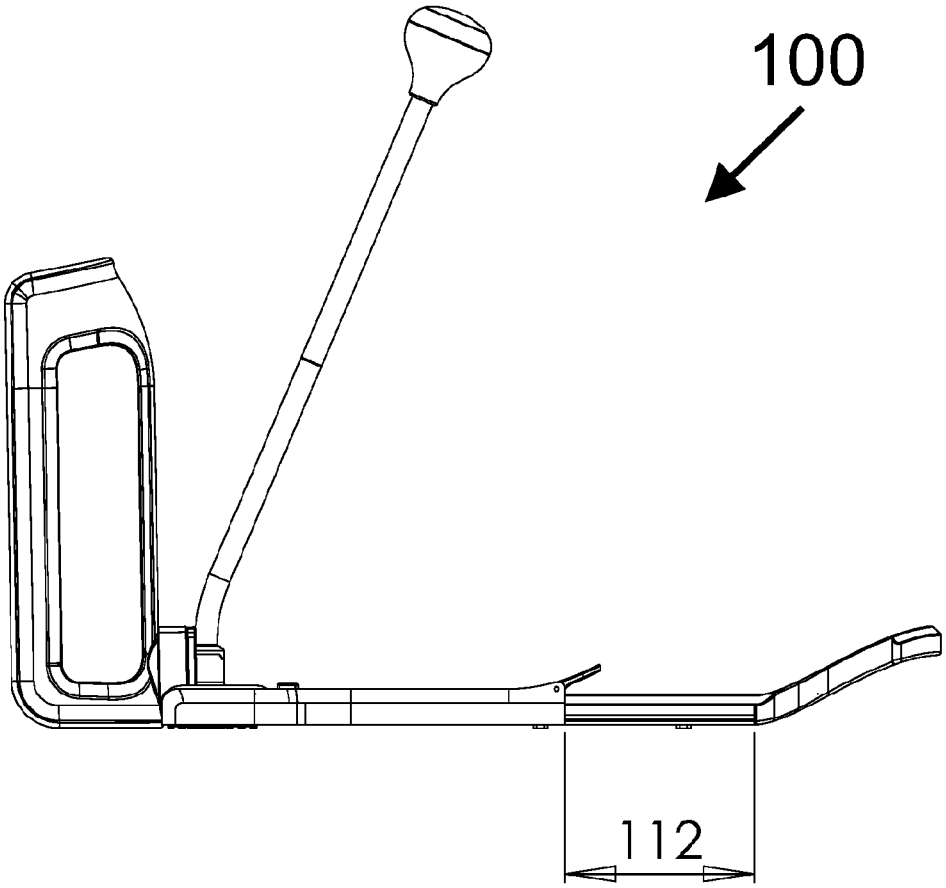
FIG. 12 is a side view of the sock donning apparatus, when the caddy is in a fully tilted position and the hook member is in an extended (or opened) position, in accordance with some demonstrative embodiments of the present invention.
Figure 13:
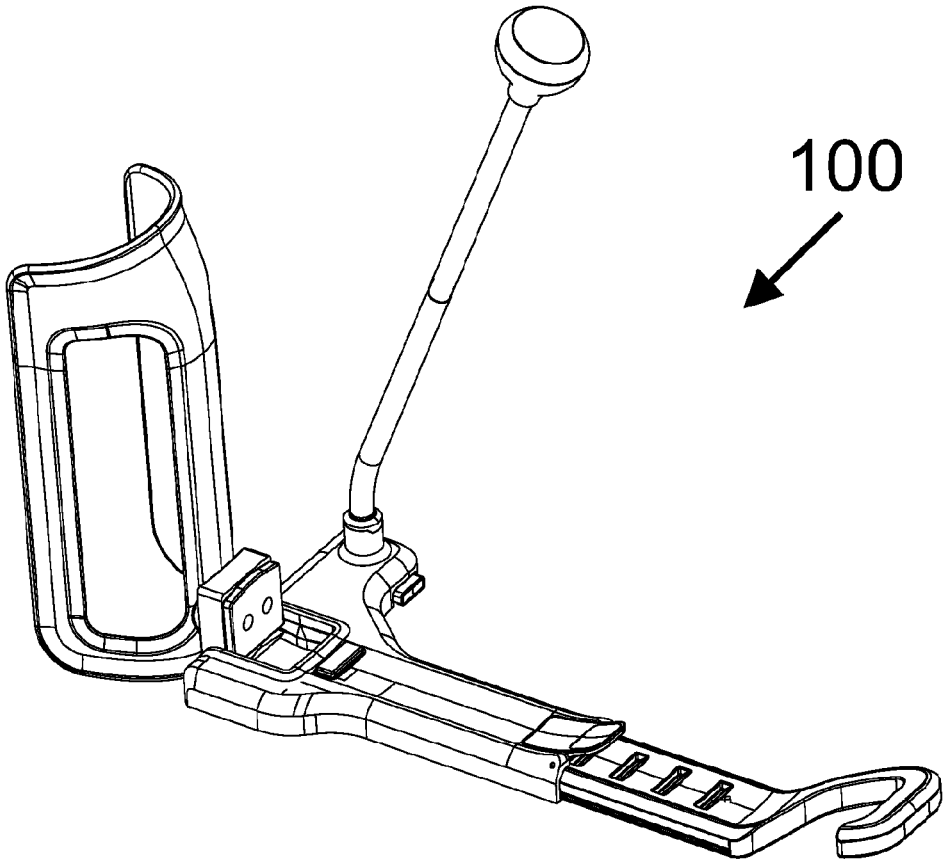
FIG. 13 is a perspective view from the top of the sock donning apparatus, when the caddy is in a fully tilted position and the hook member is in an extended (or opened) position, in accordance with some demonstrative embodiments of the present invention.

Hook member 41 is shown in a fully retracted position in FIGS. 7-11 and in an extended position in FIGS. 12-13; such that, for example, FIG. 7 shows a top view, FIGS. 8-9 show side cross sectional views, FIGS. 10 and 12 show side views, and FIGS. 11 and 13 show perspective views from the top.

Figure 14:
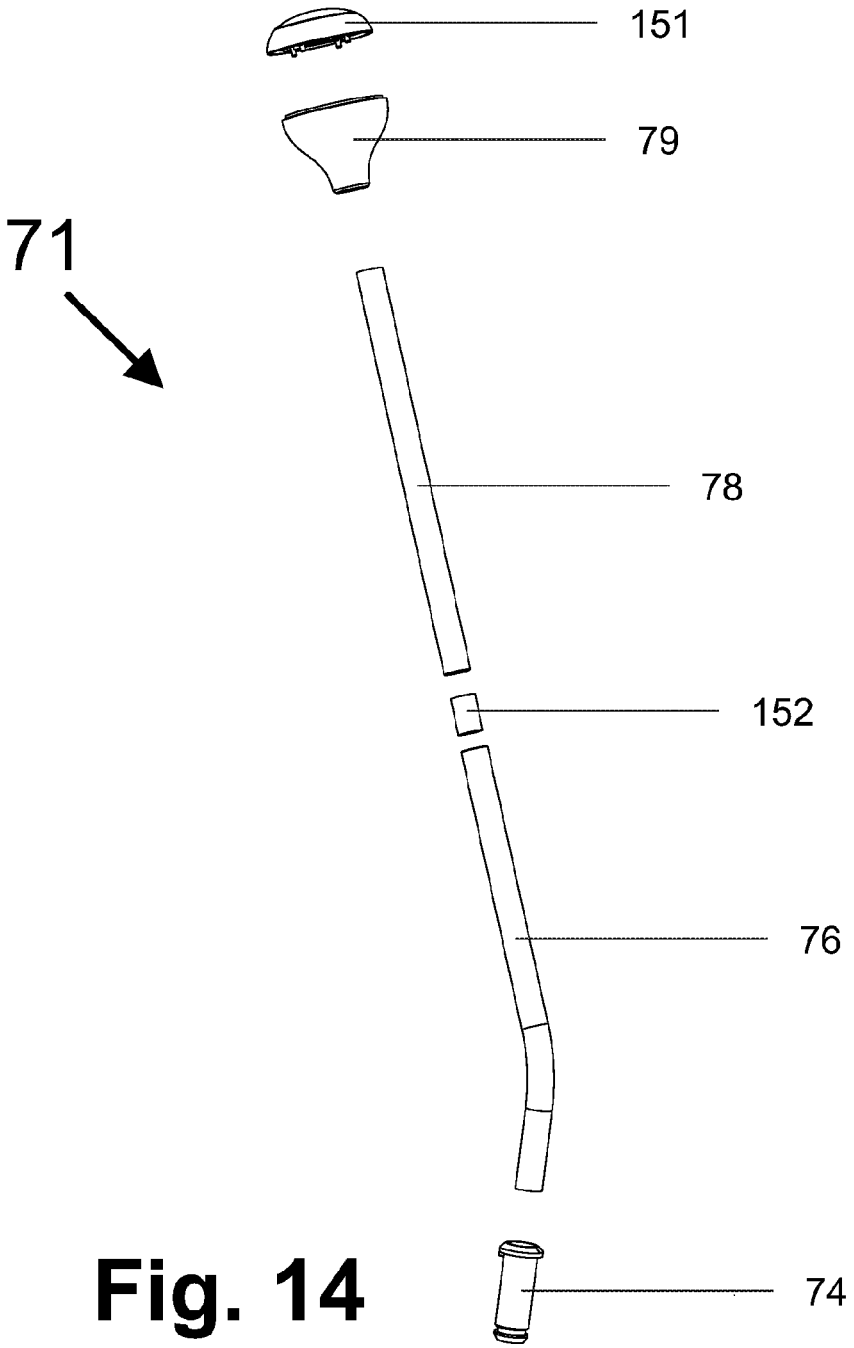
FIG. 14 is an exploded side view of a pole assembly, in accordance with some demonstrative embodiments of the present invention.
Figure 15:
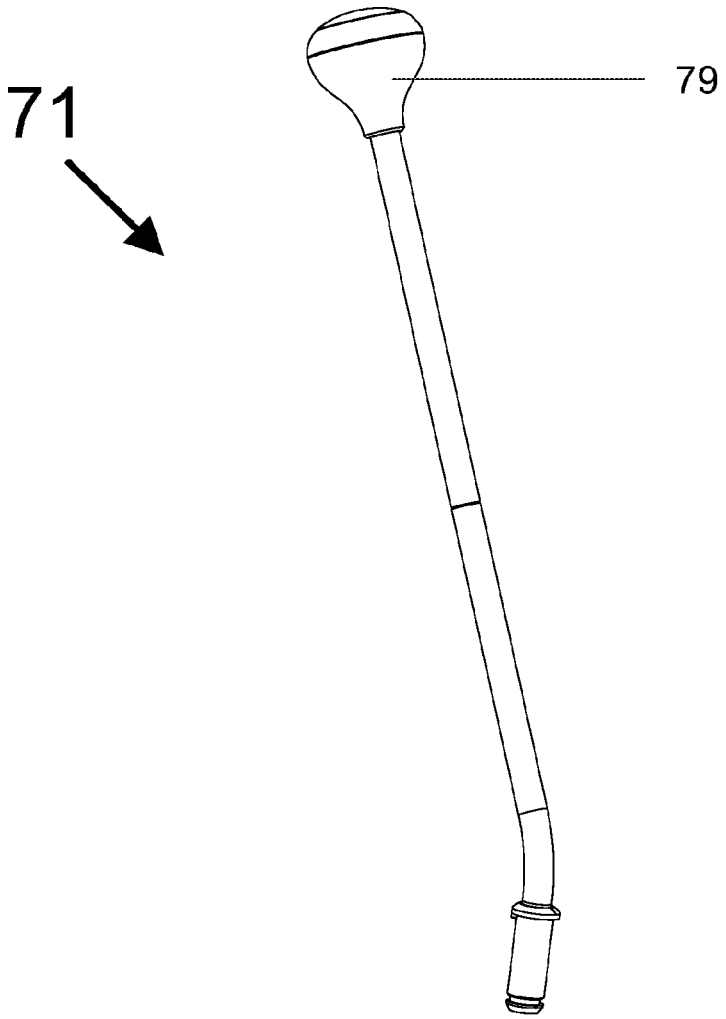
FIG. 15 is an assembled side view of the pole assembly, in a normal or un-folded state, in accordance with some demonstrative embodiments of the present invention.

An exploded side view of pole assembly 71 is shown in FIG. 14, and an assembled side view thereof is shown in FIG. 15.

Figure 16:
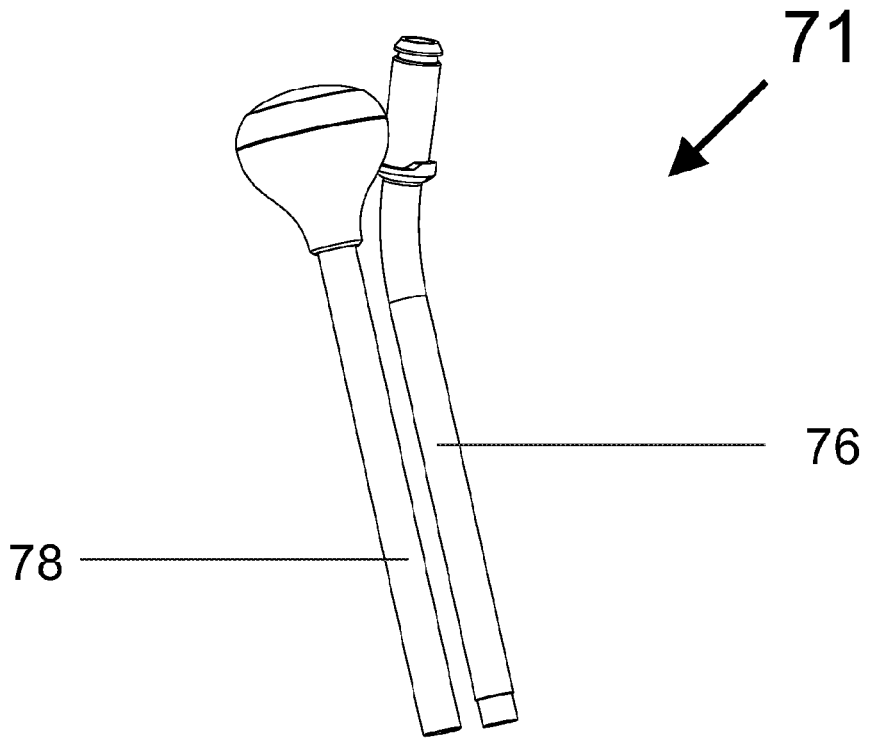
FIG. 16 is a side view of some components of the pole assembly, when dismantled or folded or dis-assembled, in accordance with some demonstrative embodiments of the present invention.
Figure 17:
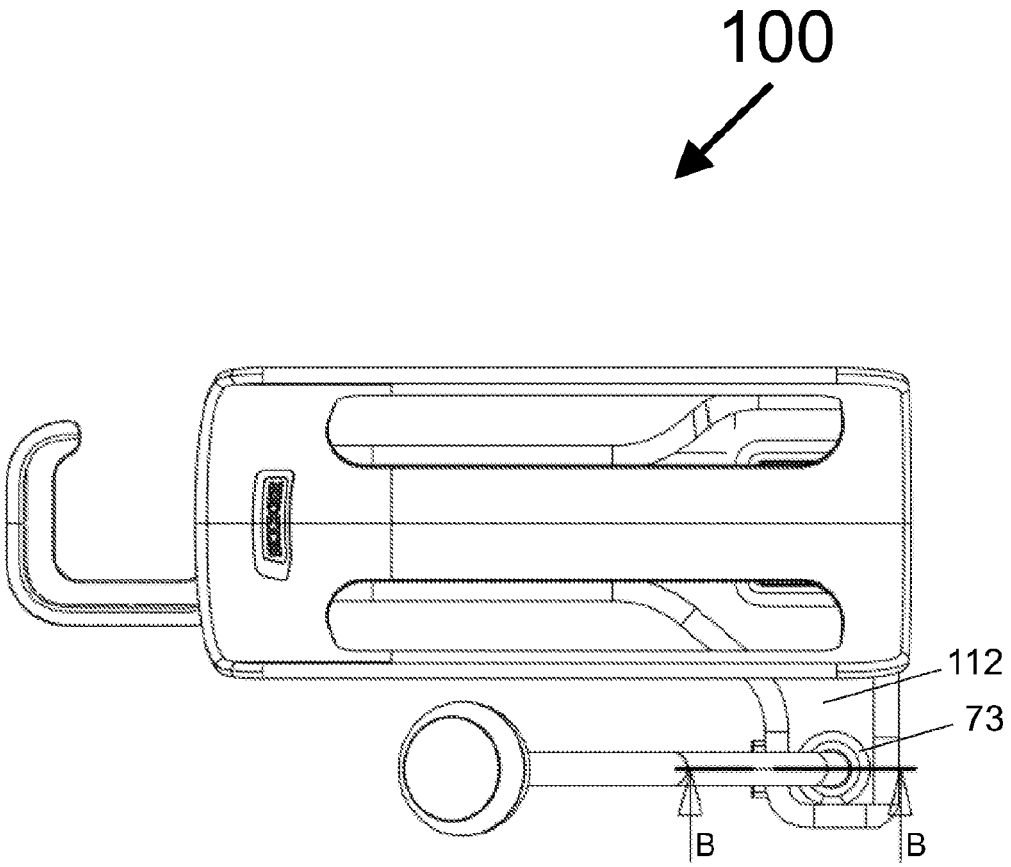
FIG. 17 is a top view of the sock donning apparatus in the rest position, in accordance with some demonstrative embodiments of the present invention.
Figure 18:
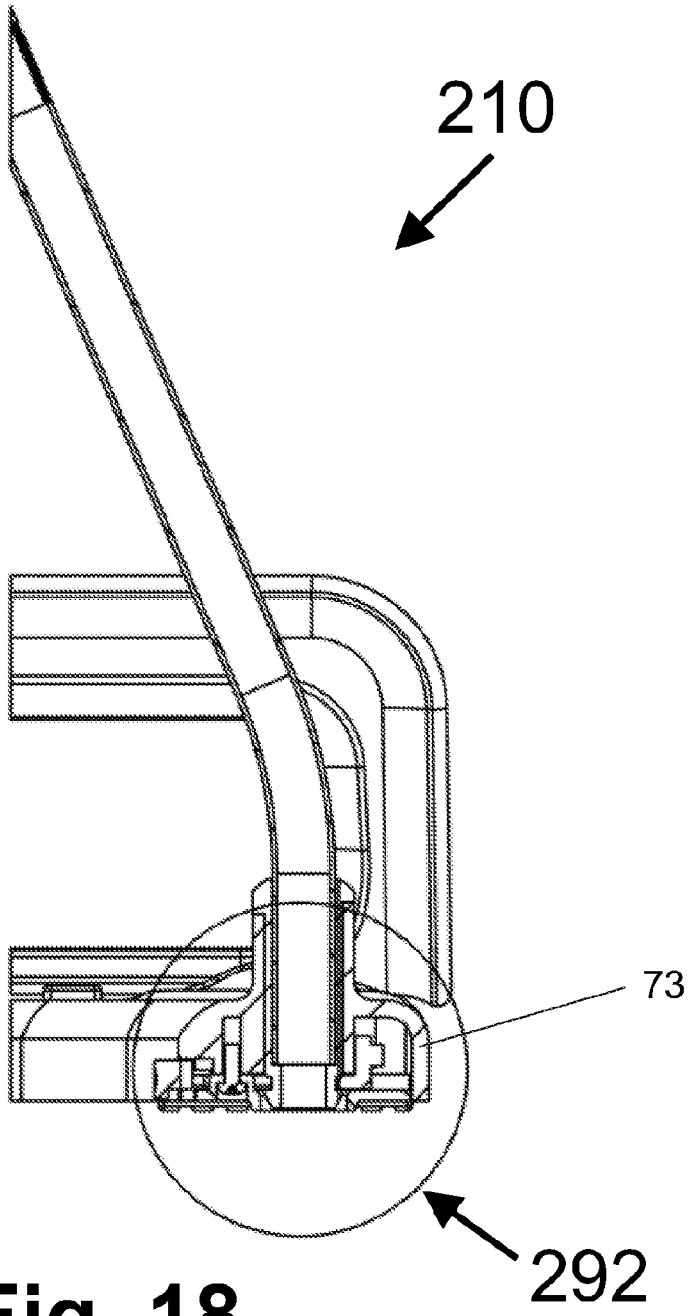
FIG. 18 is a side cross sectional view (corresponding to section B-B of FIG. 17) of a portion of the sock donning apparatus, showing connection to a head portion of a socket for receiving the pole assembly of FIG. 14, in accordance with some demonstrative embodiments of the present invention.
Figure 19:
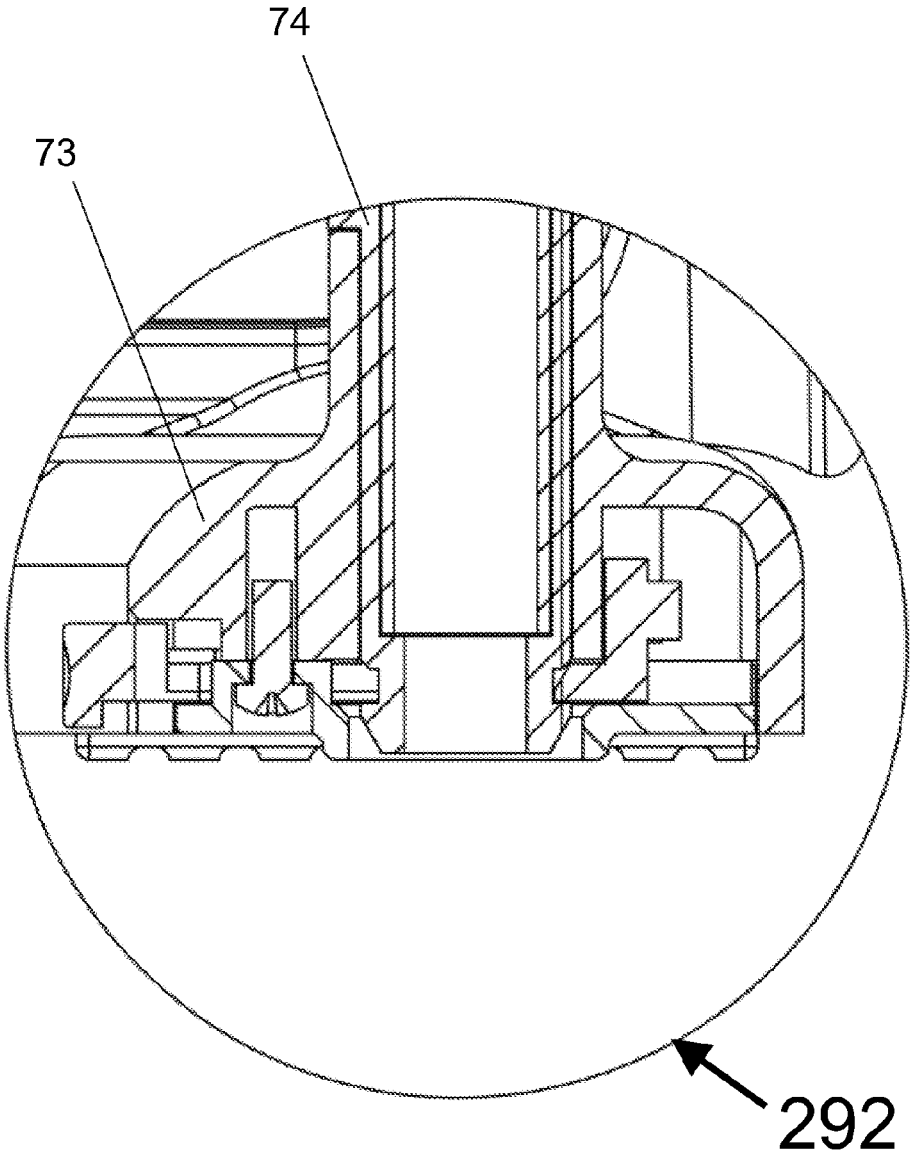
FIG. 19 is an enlargement of Detail 292 (the pole latch) of FIG. 18, in accordance with some demonstrative embodiments of the present invention.

As shown in FIGS. 6A and 6B, and also in FIG. 17, which is a top view of apparatus 100, a socket 73 may protrude upwardly from head portion 112 of base 101, and may be connected thereto in the manner shown in FIGS. 18-19, which are side cross sectional views. To assist in coupling pole assembly 71 to base 101, a cup attachment 74 is received within socket 73, to which a bent pole section 76 is releasably and movably connectable. A straight pole section 78 may be releasably connectable to bent pole section 76, allowing pole assembly 71 to be dismantled as shown in FIG. 16. In this manner, pole assembly 71 may be moved while received within attachment 74, so that knob 79 will be more to accessible to a user who desires to perform a sock donning operation with the apparatus 100.

Referring back to FIGS. 6A and 6B, caddy 113 is advantageously able to be both tilted about a horizontal axis and rotated about a vertical axis during a sock donning operation, depending upon the physical capabilities of the leg (or foot) of a user. To facilitate or to accomplish this multifaceted capability, a rectilinear tilt unit 62 may be fitted within the interspace between the two head portions 111 and 112 of base 101. A tubular and annular pin 64 introducible through a similarly shaped recess formed within a forwardly positioned projection 67 of tilt unit 62, may be coupled to two opposed pin holders 119 protruding from the inner face of head portions 111 and 112, respectively thereby allowing tilt unit 62 and caddy 113 to pivot about pin 64 when a suitable force is applied by the leg of the user. Tilt unit 62 may have a central through-hole 61, through which circular protruding part 118 of caddy 113 located in the vicinity of forward terminal edge 160 passes. A circular projection 86 protruding from flange 83 and introducible into through hole 61 may be connected to the bottom face of protruding part 118, e.g., by screws or other suitable connection mechanism; thereby allowing flange 83 and protruding part 118 to rotate in unison about the central axis of through-hole 61 while an outer element of protruding part 118 is in supporting relation with the rim of through-hole 61. In accordance with the present invention, limited rotation in unison about the central axis of through-hole 61 may be required to allow the user deciding from which side of the apparatus 100 he wished to insert his leg (or his foot) into the sock (which is already slipped over the rearward terminal edge 158 of caddy 113), so as to prevent the user's heel from encountering the leg of the chair.

Flange 83 may serve as an angular limiter for the rotational displacement of caddy 113 about the central axis of through hole 61. Cooperating with flange 83 is inner face 122 of head portions 111 and 112, a lower region of which may be angularly recessed with respect to an upper, substantially straight and unrecessed region thereof. This angular recess may allow flange 83 to rotate when caddy is at the rest position for a predetermined angular distance, e.g., up to 15 or 20 or 30 or 40 degrees in either rotational direction, until the flange contacts inner face 122, yet prevents flange 83 from rotating when caddy 113 is tilted.

Figure 20:
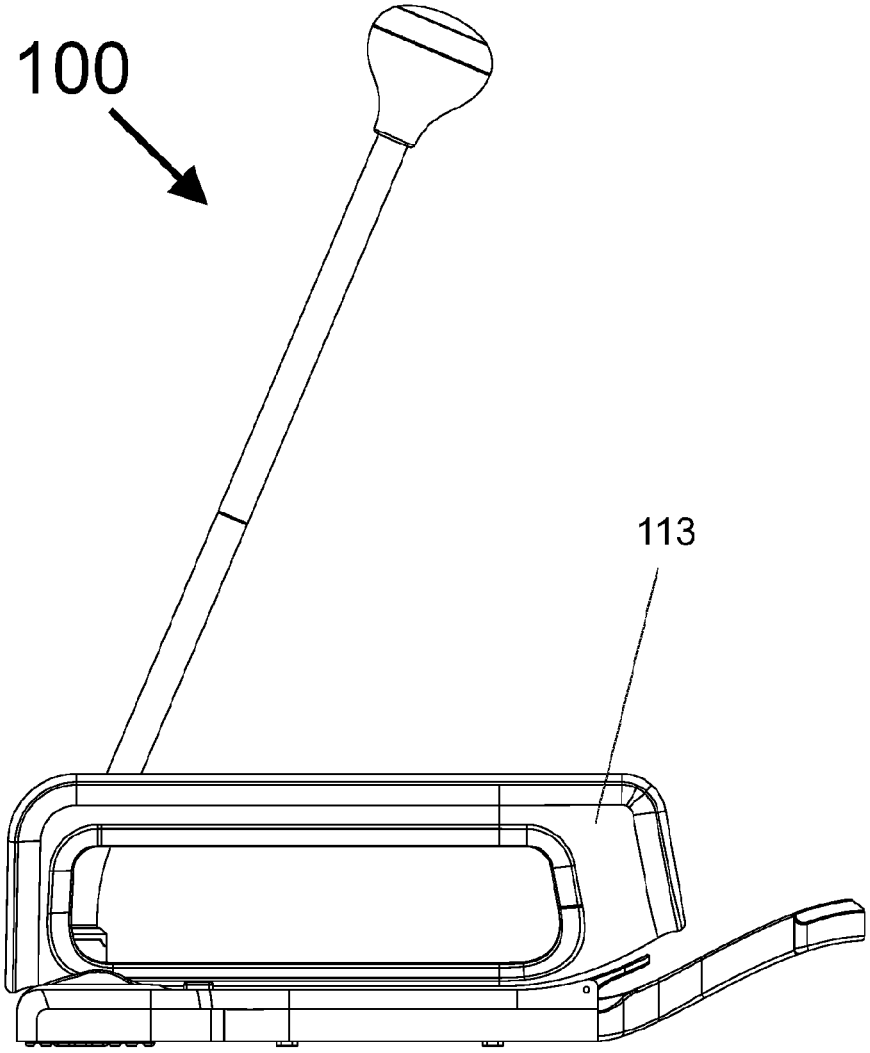
FIGS. 20-22 are side views of the sock donning apparatus, showing the caddy in three tilted positions, respectively, with respect to a horizontal axis, in accordance with some demonstrative embodiments of the present invention.
Figure 21:
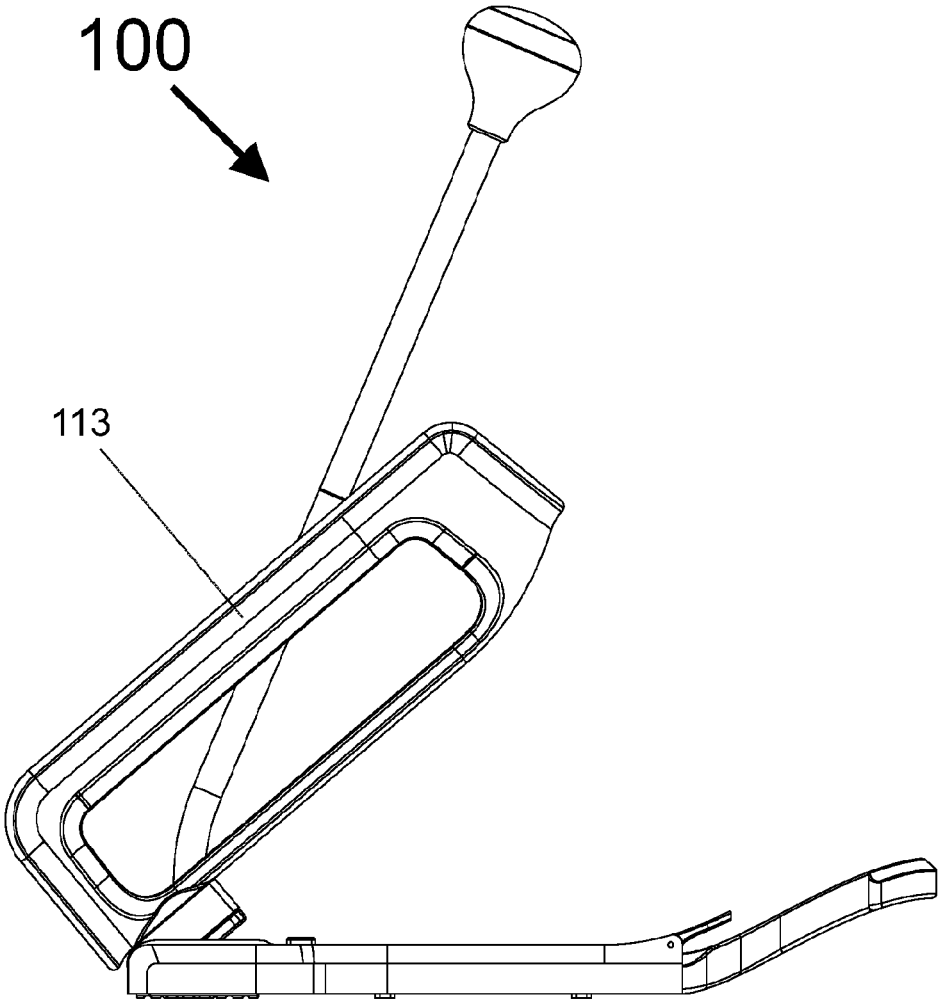
Figure 22:
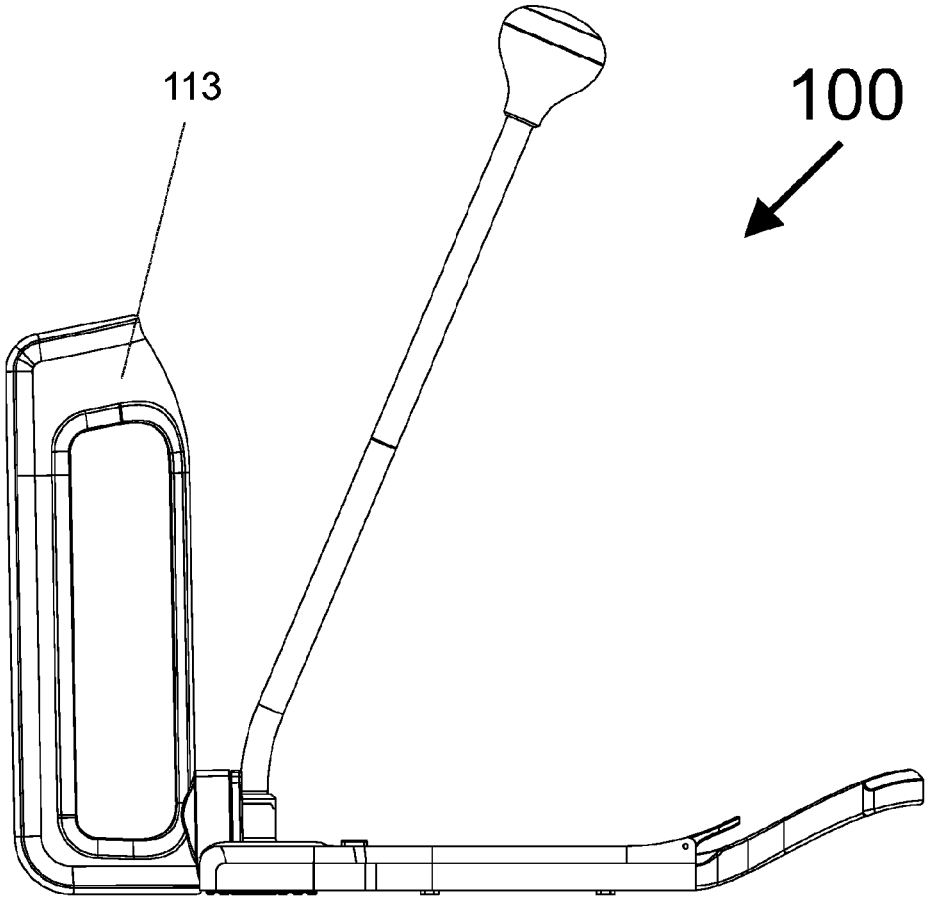
Figure 23:
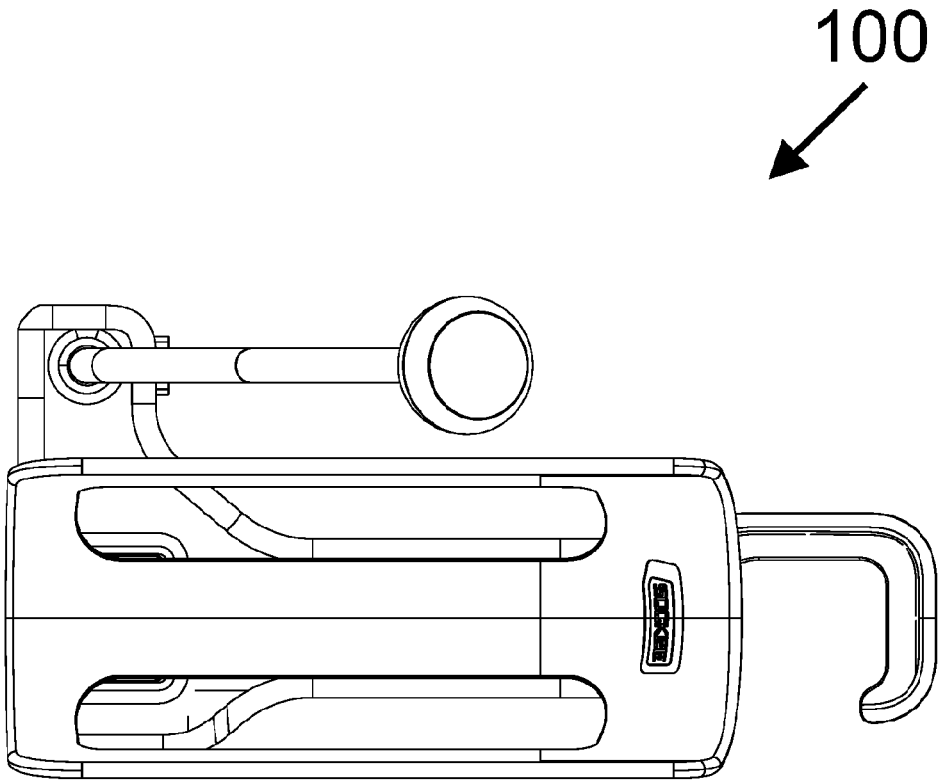
FIGS. 23-25 are top views of the sock donning apparatus, showing the caddy in three tilted positions, respectively, with respect to a horizontal axis, in accordance with some demonstrative embodiments of the present invention.
Figure 24:
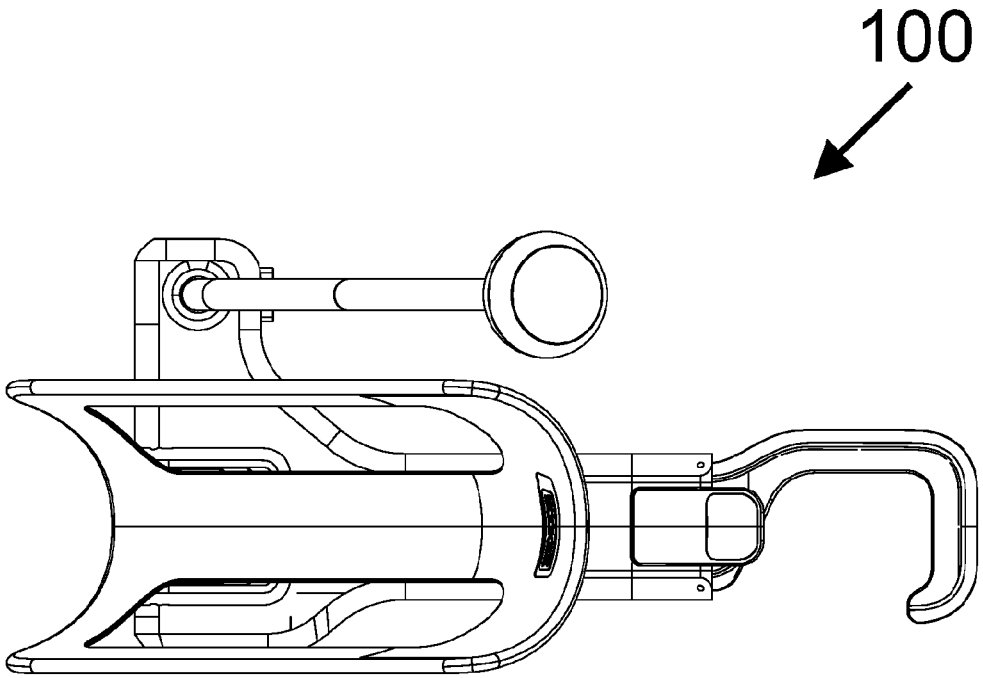
Figure 25:
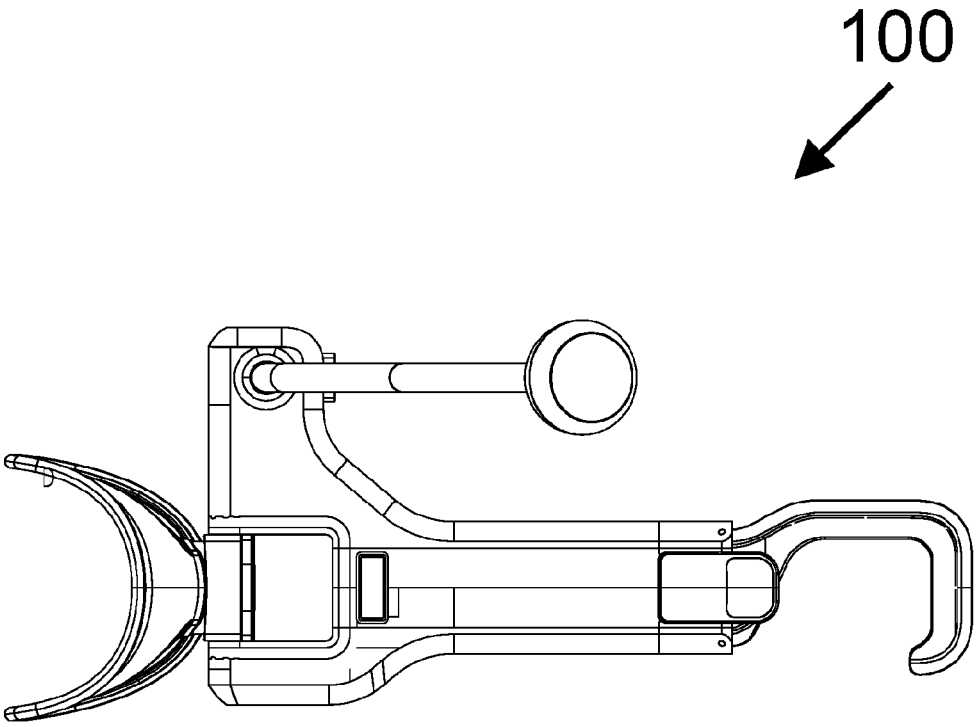

FIGS. 20-22 illustrate side views of apparatus 100, and FIGS. 23-25 illustrate top views of apparatus 100, showing caddy 113 in three tilted positions with respect to a horizontal axis. For example, FIGS. 20 and 23 correspond to a rest position; FIGS. 21 and 24 correspond to a middle position or intermediate position; and FIGS. 22 and 25 correspond to a fully-opened position.

Figure 26:
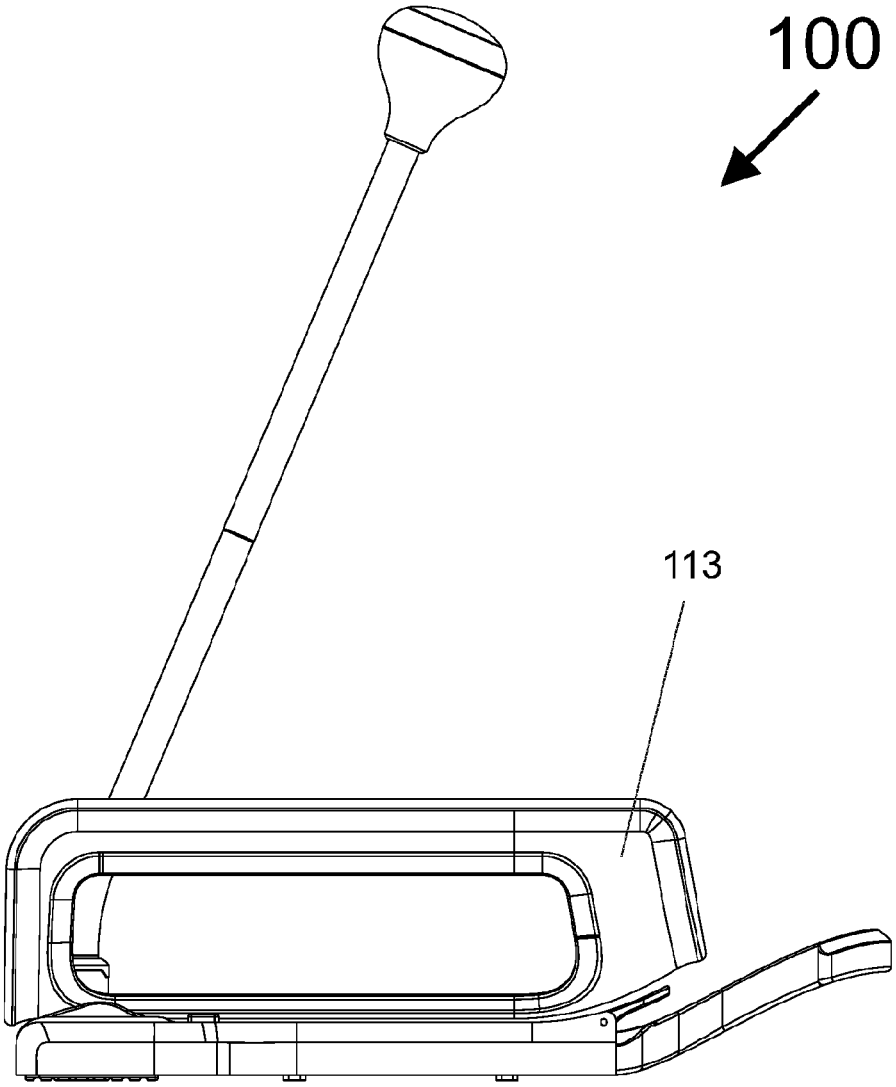
FIGS. 26-27 are side views of the sock donning apparatus, showing the caddy in two rotated positions, respectively, with respect to a vertical axis in accordance with some demonstrative embodiments of the present invention.
Figure 27:
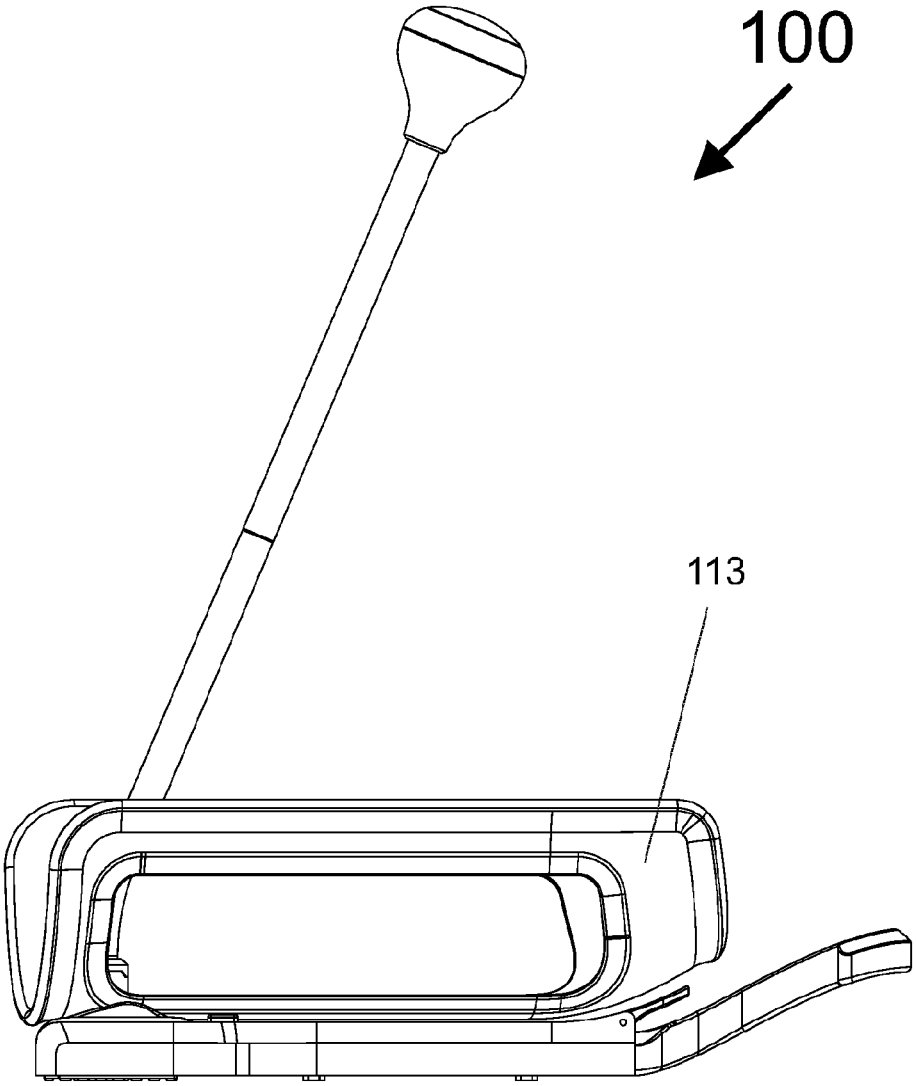
Figure 28:
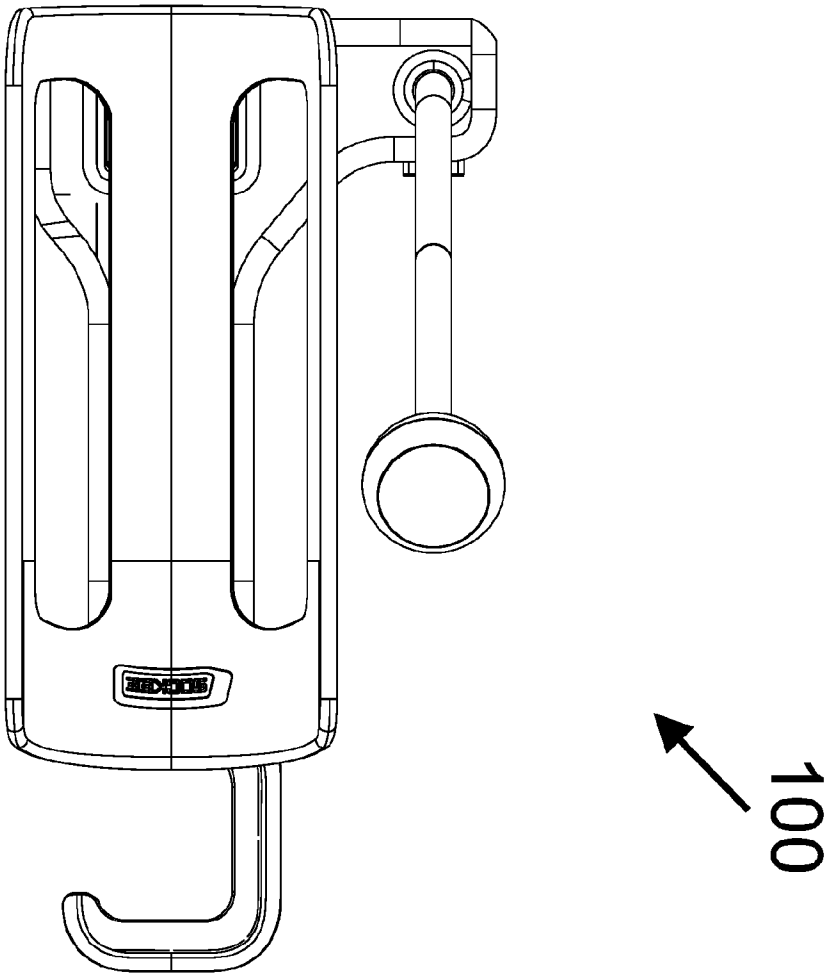
FIGS. 28-29 are top views of the sock donning apparatus, showing the caddy in two rotated positions, respectively, with respect to a vertical axis, in accordance with some demonstrative embodiments of the present invention.
Figure 29:
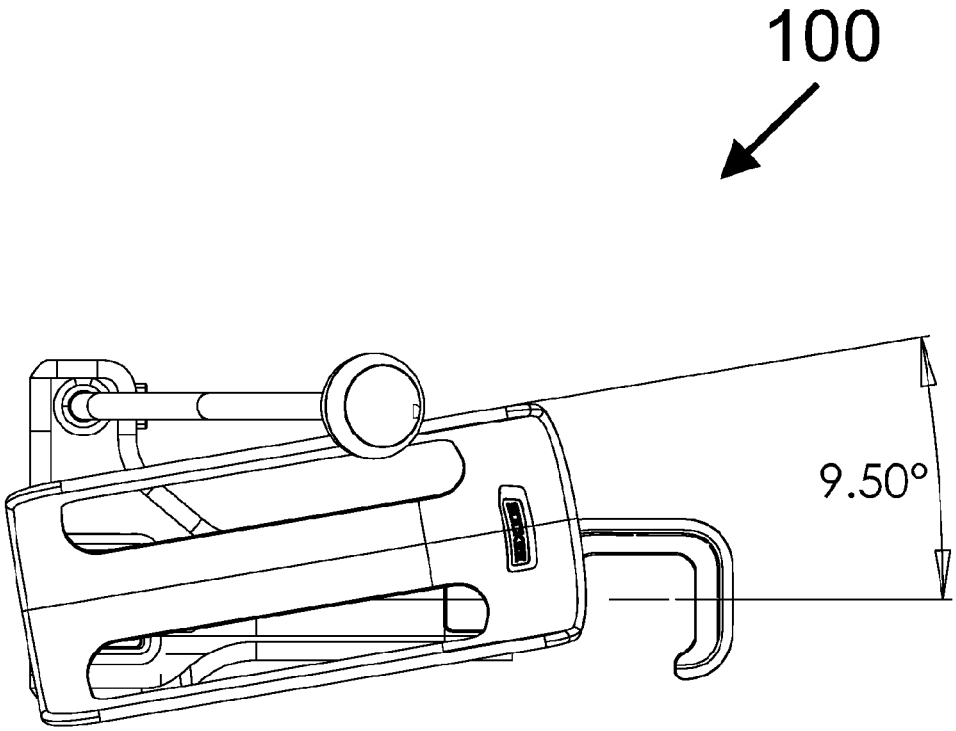

FIGS. 26-27 illustrate side views of apparatus 100 and FIGS. 28-29 illustrate top views of apparatus 100, showing caddy 113 in rotated positions with respect to a vertical axis. For example, FIGS. 26 and 28 correspond to zero yaw position; whereas FIGS. 27 and 29 correspond to a full yaw position (e.g., allowing approximately 5 or 7 or 9 or 9.5 or 10 or 12 degrees of yaw to each side).

In operation, hook member 41 may initially be set to a selected longitudinal position that provides optimal comfort to the user, since the user may not be able to bend over (entirely or partially). A sock positioned inside out may then be slipped over rearward terminal edge 158 of caddy 113, for example when the caddy is set to a completely vertical position as shown in FIG. 22, after which the caddy may be set to the rest position shown in FIG. 20. The user, or alternatively a caretaker or assistant, may affix hook 49 to the leg of a chair (or other furniture) on top of which the user is sitting, or to any other desired stationary or relatively-stationary element. Generally, the optimal length may be set once, since the user may repeat the sock donning operations from the same position (e.g., while sitting on a chair or bed or other seat or furniture). Pole assembly 71 may be used to conveniently position the apparatus 100, without the need to bend down, until the hook 49 is engaged with the leg of the chair (or of any other relatively stationary element that can provide a reactive force during a sock donning operation). Once the hook 49 is engaged with the leg of the chair, the pole assembly 71 may be used to adjust the direction of caddy 113 to match it to the direction of the first leg. After the user wears the sock on the first leg, the user may further utilize the pole assembly 71 to conveniently disengage the hook 49 from the leg of the chair and to reposition the apparatus 100, until the hook 49 is engaged with another leg of the chair, which may be closer to the second leg of the user. Once the hook 49 is engaged with the other leg of the chair, the pole assembly 71 may be utilized to adjust the direction of caddy 113 to match it to the direction of the second leg, again, without the need to bend down (at all, or partially).

While the user is sitting, or otherwise positioned, to the rear of caddy 113, the foot of the user may then be brought in close proximity to the closed end of the sock near rearward terminal edge 158, and may be pushed within the interior of the elongated caddy 113. A moment or a force which may be applied by the foot being introduced within the interior of the caddy 113 causes the caddy 113 to be pivoted, such that the rearward edge thereof becomes positioned higher than its forward edge. While the foot of the user is being inserted within its interior, the caddy 113 is able to slightly rotate about a substantially vertical axis, in response to the direction and magnitude of the force applied by the foot. As the foot of the user continues to be pushed into the sock, the closed end of the sock is gradually displaced towards the forward terminal edge 160 of caddy 113. Likewise, the open end of the sock is gradually slipped off the rearward terminal edge 158 to allow the sock to fit the user's foot, until the toes of the user are fully inserted into the toe portion of the sock and the heel of the user is fully inserted into the heel portion of the sock. As the foot of the user is being pushed downwardly into the sock to ensure proper engagement, caddy 113 rotates about pin 64 in response to the foot position, assuming a final position or an advanced position, for example an intermediate position as shown in FIG. 21. The rounded terminal edge 158 of caddy 113 may enable a smooth sock donning process. With the use of two identical devices, two socks may be positioned on both feet of the user, simultaneously or concurrently or in parallel, or in partially-overlapping time slots.

Some embodiments of the present invention may further comprise a method or a process of donning (or wearing, or putting-on) a sock, by performing the operations described above, and/or by using the apparatus 100 and its components as described above. In some embodiments, the method or process may be integrally related to the apparatus 100, or to a generally similar apparatus for donning socks; such that, for example, the method may require operations which are performed through, or via, or by using, the apparatus 100 or a similar apparatus.

In accordance with the present invention, a device for putting-on socks may comprise or may provide one or more features, for example: The device may comprise a hook or anchor, or other connecting element or attachment element or anchoring element, enabling the user to immobilize the device or to anchor the device to a chair or furniture or other generally-unmoving article, thereby allowing efficient and easy utilization of the device by a single user, independently or autonomously and without requiring assistance of other person's, and without requiring the user to bend down (entirely or partially).

Figure 30A:
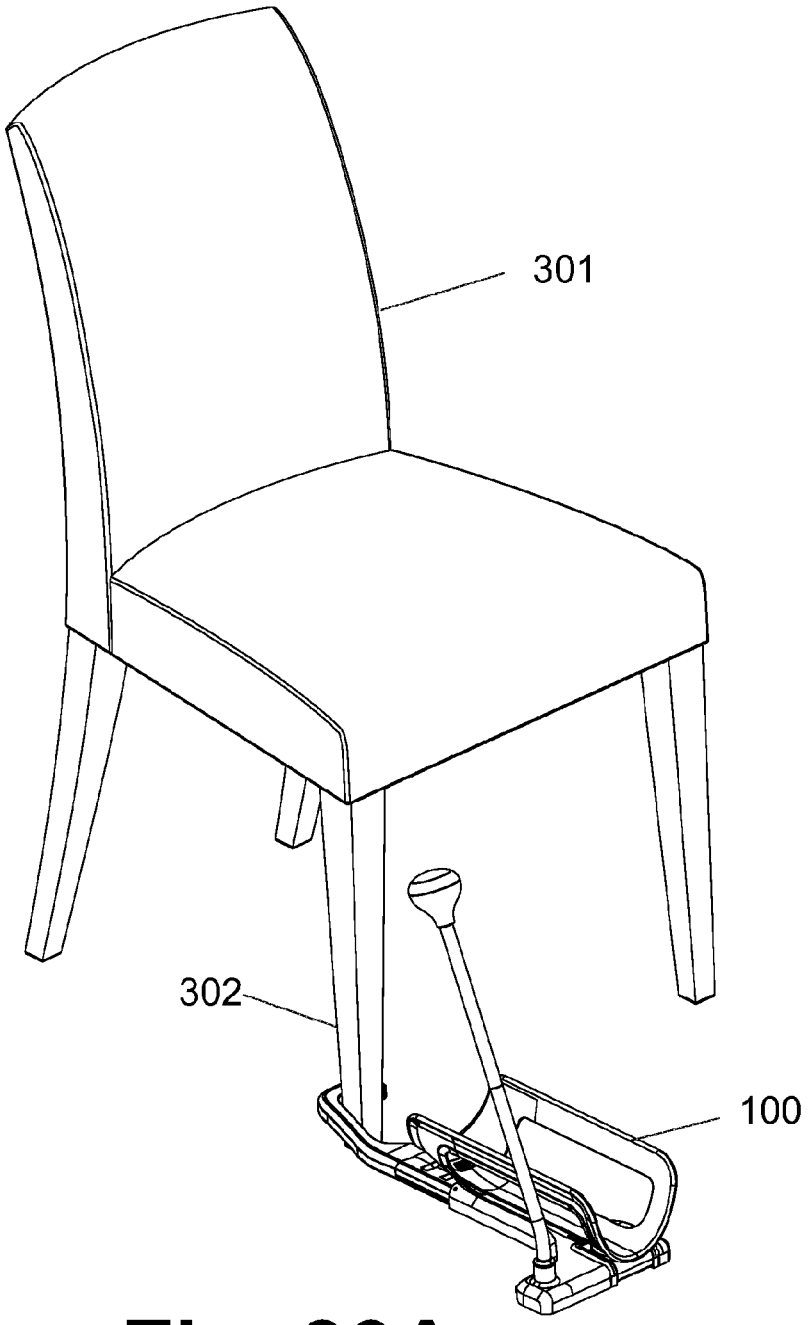
FIGS. 30A and 30B are schematic illustrations of the sock donning apparatus having its hook element engaging with a leg of a chair, in accordance with some demonstrative embodiments of the present invention.
Figure 30B:
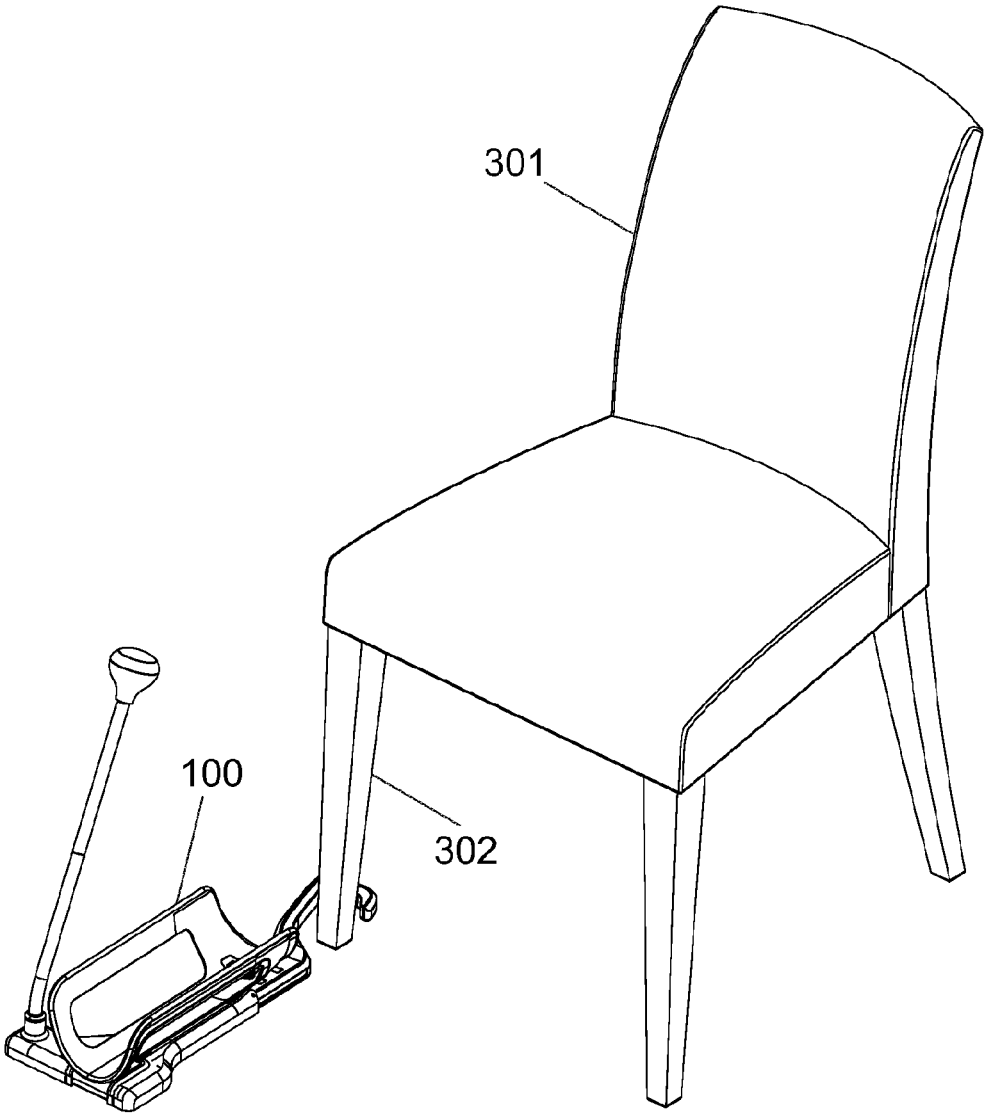

Reference is made to FIGS. 30A and 30B, which demonstrate the apparatus 100 having its hook element (or anchor element) partially-surrounding or partially-encircling (or engaging with) a leg 302 of a chair 301. Other suitable furniture articles, or other generally-stationary objects, may be used together with the apparatus 100.

The device may comprise a handle, or an elongated handle or shaft, thereby allowing the user to autonomously operate the device without requiring the user to bend his back or body, or without requiring the user to apply force on its back or its spinal cord or spine; and this may be advantageous to a user who is, for example, sick or ill or disabled or tired. The handle or shaft of the device may optionally be (or may comprise), for example, a folding handle, a dis-assembling handle, one or more components able to fold or dis-assemble, or other mechanism allowing the device to have a reduced form-factor in order to facilitate storage of the device and/or transport of the device.

The device may comprise an axis or hinge or gimbal, or a set of axes or hinges or gimballing elements, which may allow at least two degrees of freedom, or at least several degrees of freedom, or at least two gimballing directions or movement directions, thereby enabling the user to autonomously and easily perform the donning process (e.g., a first gimbal direction which may be generally parallel to the ground surface; and a second gimbal direction which may be slanted upwardly relative to the ground surface).

Figure 31A:
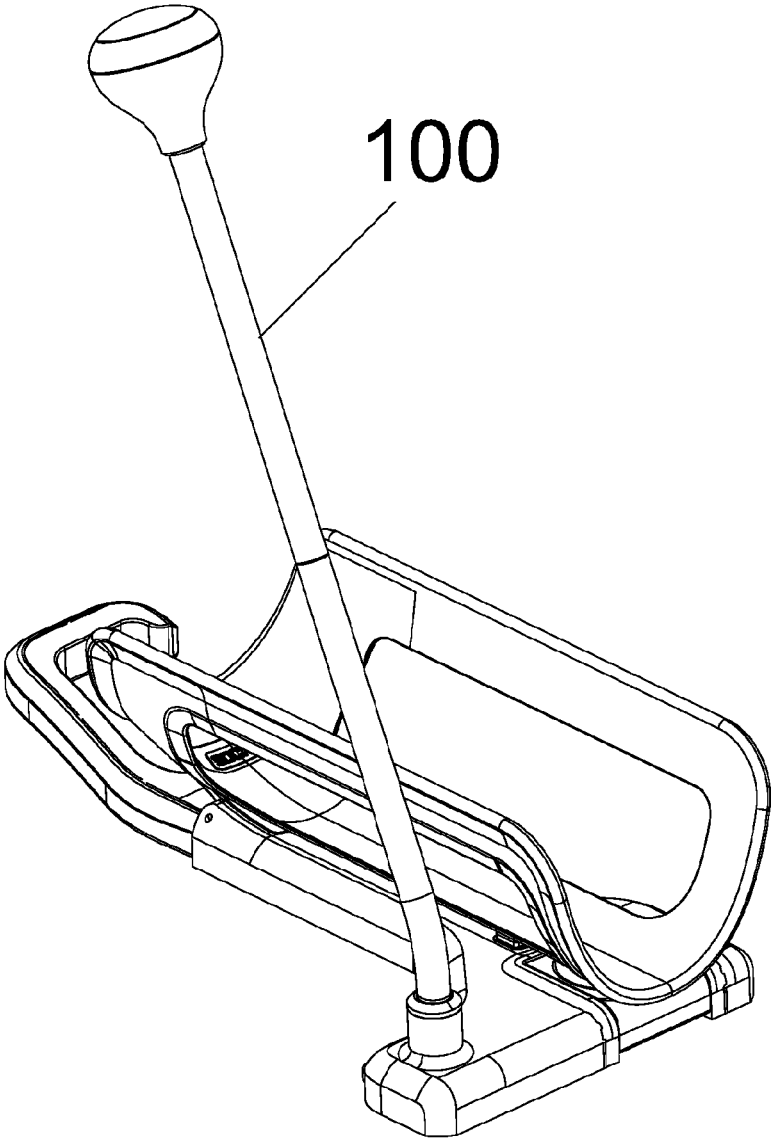
FIGS. 31A, 31B and 31C are schematic illustrations of the sock donning apparatus in three positions, demonstrating two different gimballing directions of the caddy of the apparatus, in accordance with some demonstrative embodiments of the present invention.
Figure 31B:
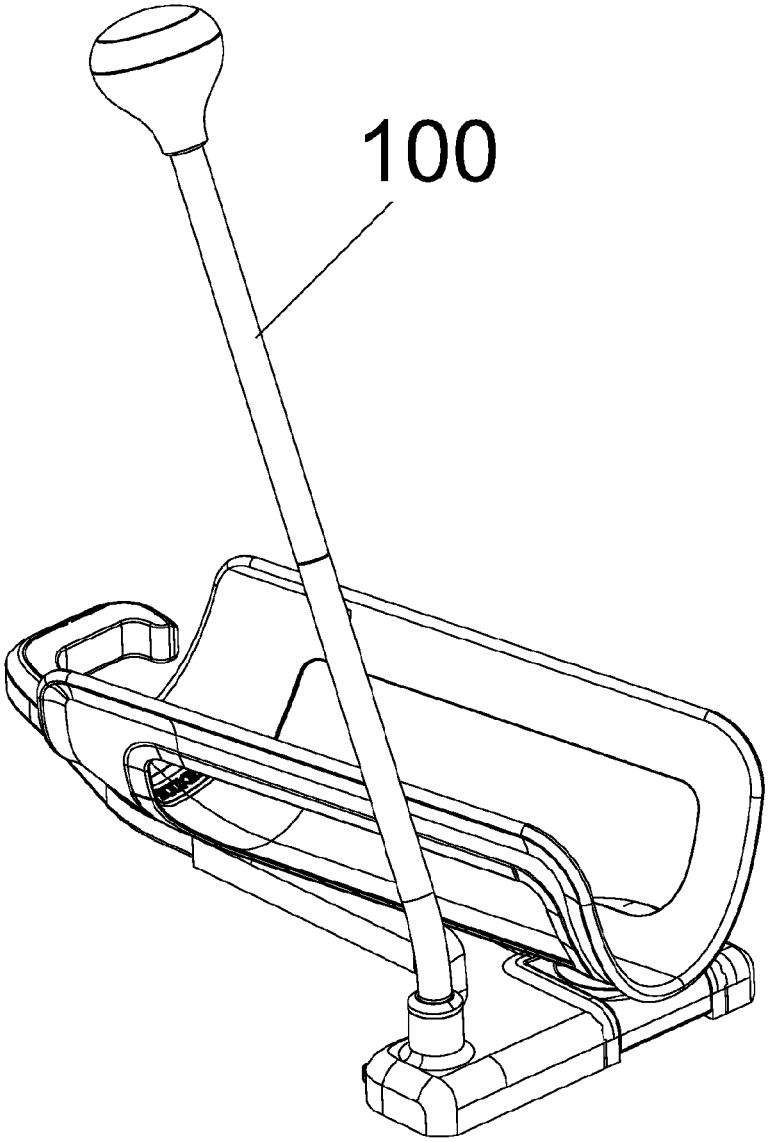
Figure 31C:
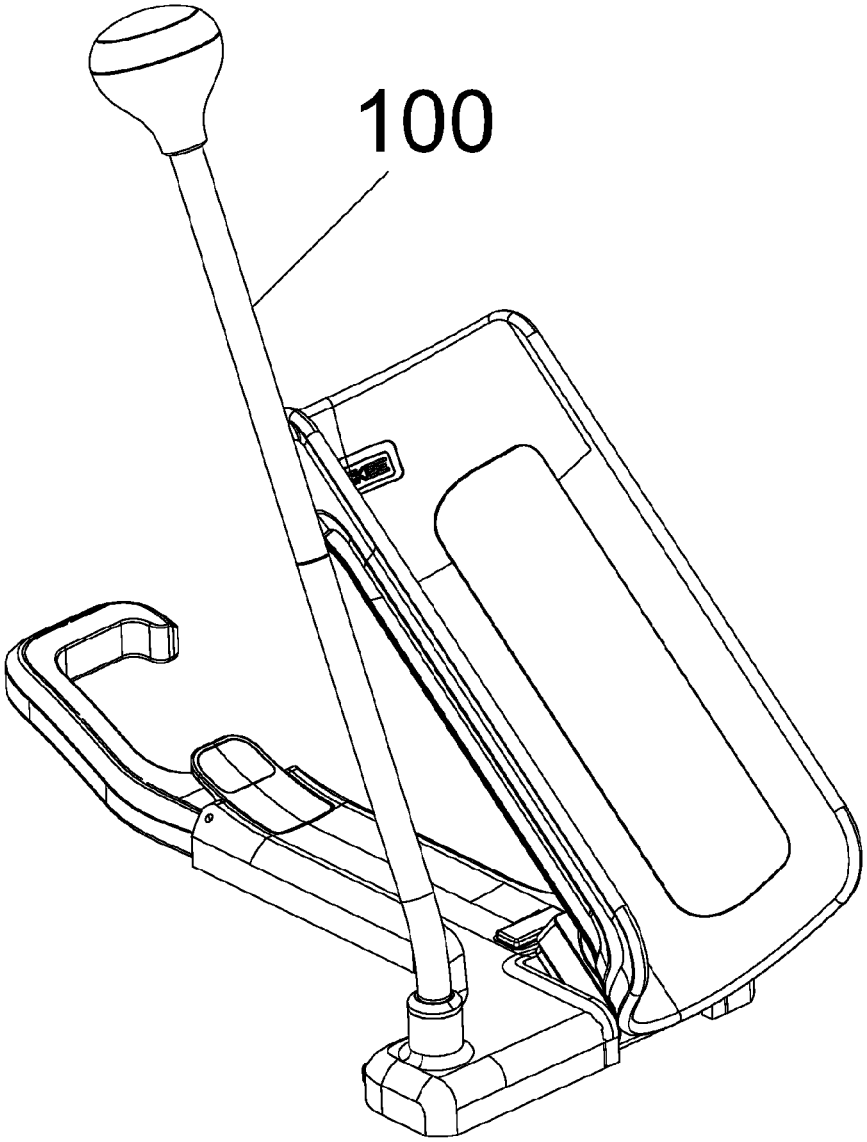
Figure 32A:
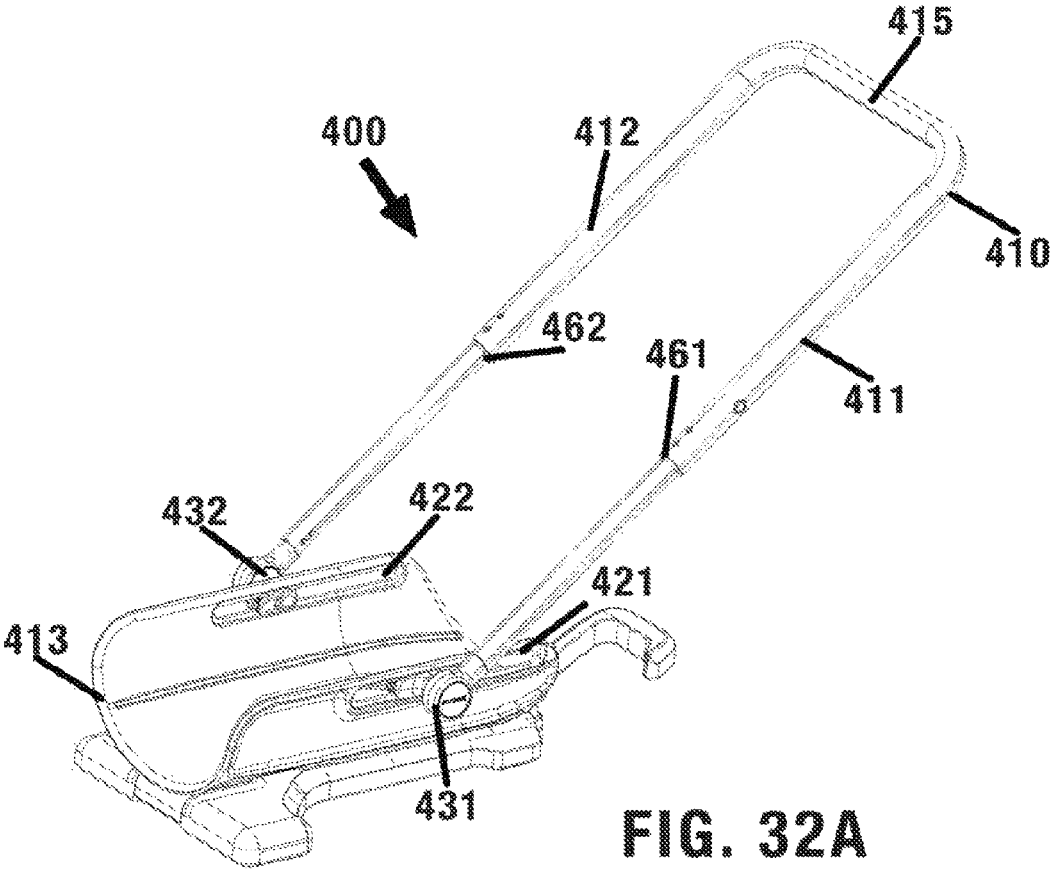
FIGS. 32A to 32E are schematic illustrations which demonstrate an improved device for wearing socks, and its improved components, in accordance with some demonstrative embodiments of the present invention.
Figure 32B:
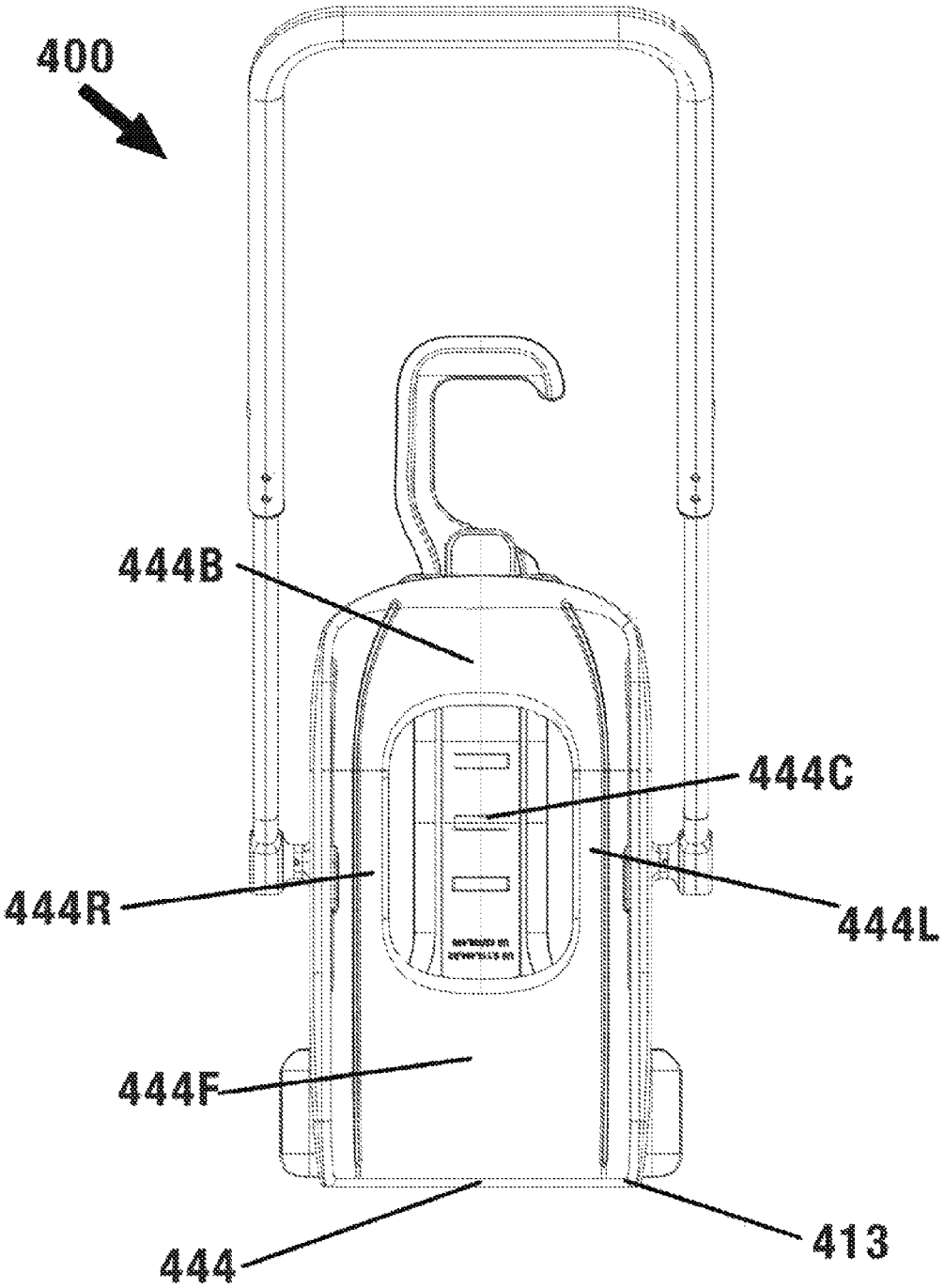
Figure 32C:
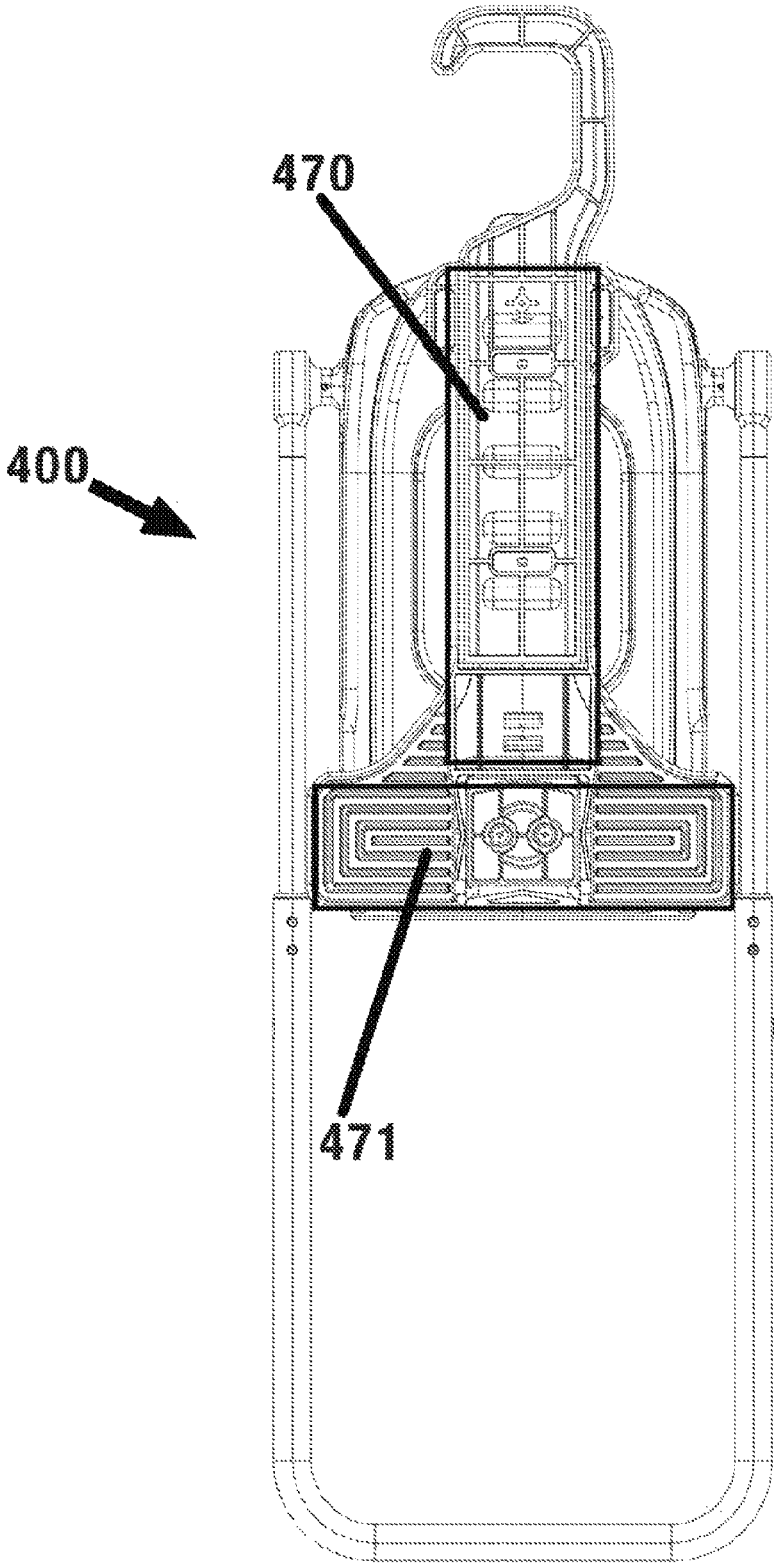
Figure 32D:
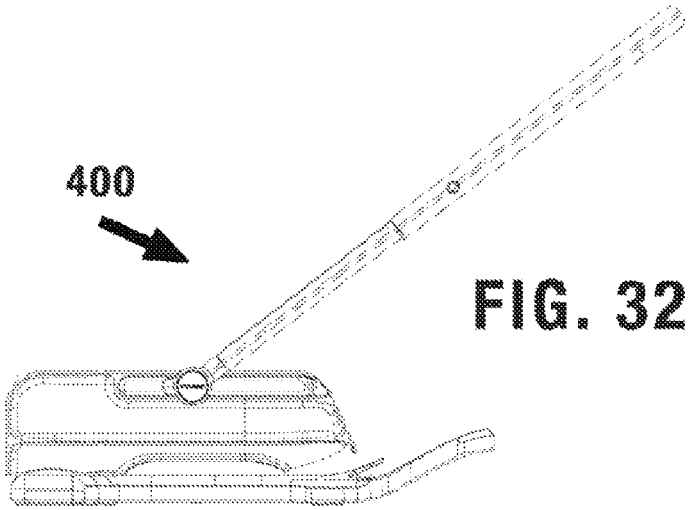
Figure 32E:
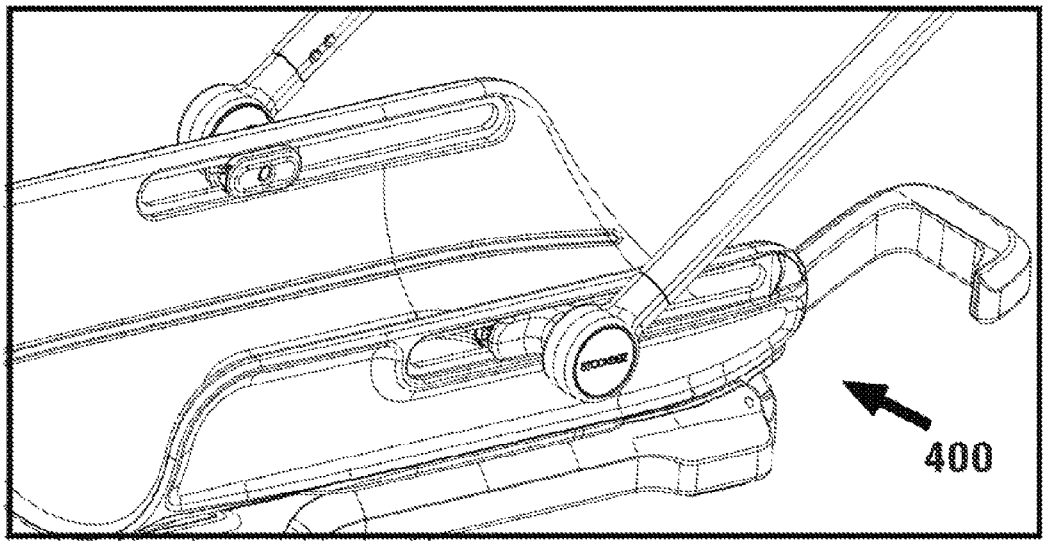

Reference is made to FIGS. 31A, 31B and 31C, which demonstrate the apparatus 100 in three positions or three states. For example, FIG. 31A demonstrates a rest position of apparatus 100; whereas FIG. 31B demonstrates gimballing along a first gimbal direction (e.g., generally parallel to the ground surface); and whereas FIG. 31C demonstrates gimballing along a second, different, gimbal direction (e.g., generally slanted relative to the ground surface). In some embodiments, the gimballing elements or the gimbals of apparatus 100 may allow simultaneous movement or concurrent movement of the caddy (or other element(s) of apparatus 100) in both of the gimbal directions, at the same time.

Some embodiments of the present invention may include an apparatus (or device) for donning socks, the apparatus comprising: a substantially horizontal base; an elongated U-shaped, semi-cylindrical caddy on which a sock positioned inside out is fittable and into an interior of which a foot is insertable; and a tilt unit coupled to said caddy and pivotally connected to a head portion of said base.

In some embodiments, the base is T-shaped and is configurable by an elongated main portion and two spaced, forwardly positioned head portions; wherein the tilt unit is insertable within an interspace between said two head portions; wherein the tilt unit is pivotally connected to said two head portions by at least one coupled horizontally disposed pin which is substantially perpendicular to said main portion; wherein the pin is introducible within a recess formed within a forwardly positioned projection of the tilt unit; wherein the tilt unit and the caddy are able to be tilted about a horizontal axis during a sock donning operation.

In some embodiments, the tilt unit has a central through-hole through which a part protruding from the caddy and connected with a projection of a flange passes; wherein said through-hole is positioned rearwardly from the projection of the tilt unit, allowing the caddy and flange to be rotated in unison about a vertical axis during the sock donning operation.

In some embodiments, the flange comprises a flange that limits the rotational displacement of the caddy about a central axis of the through hole.

In some embodiments, an inner face of each of the two head portions has (a) an upper, substantially straight and un-recessed region, and (b) a lower region which is angularly recessed with respect to said upper region, thereby allowing the flange to rotate for a predetermined angular distance when the caddy is at a rest position until the flange contacts said inner face, yet preventing the flange from rotating when the caddy is tilted.

In some embodiments, the apparatus further comprises: a hook member that is engageable with a relatively stationary element for providing a reactive force during the sock donning operation. In some embodiments, the elongated main portion of the base is hollowed to fixedly receive the hook member. In some embodiments, the hook member is selectively extendable with respect to the elongated main portion of the base. In some embodiments, the hook member comprises: an elongated positioning bar formed with a plurality of longitudinally spaced latching grooves; a hook rearwardly extending from said positioning bar; and a spring biased detent pivotally connected to the main portion of the base for selectively engaging one of said grooves. In some embodiments, the detent comprises: a finger contactable portion for disengaging the detent from the engaged groove, to allow the bar to be repositioned.

In some embodiments, the apparatus further comprises: a pole assembly extending upwardly from one of the head portions, for facilitating manual displacement of the apparatus. In some embodiments, the pole assembly comprises: a straight pole section, and a bent pole section that is movable within a cup attachment fixed to the base, for facilitating apparatus repositioning.

In some embodiments, a method or process for donning (or putting on, or wearing) a sock (or multiple socks) may comprise: (a) providing an apparatus comprising a substantially horizontal base and an elongated U-shaped, semi-cylindrical caddy movably coupled to said base; (b) fitting a sock in an inside out arrangement over a rearward terminal edge of said caddy; (c) securing said base to a relatively stationary element for providing a reactive force during a sock donning operation while a user is positioned to the rear of said caddy; (d) inserting a foot of the user into the interior of the sock, while said foot applies a moment to said caddy to cause said caddy to pivot and an open end of the sock is gradually slipped off said rearward terminal edge of said caddy; and (e) fully inserting toes of the user into a toe portion of the sock, to cause said caddy to assume a final pivoted position and the sock to be released from said caddy.

In some embodiments, the caddy also rotates about a substantially vertical axis while the foot is being inserted into the interior of the sock.

In some embodiments, a first sock donning apparatus and a second sock donning apparatus are positioned forwardly to right and left feet, respectively, and first and second socks are donned on the right and left feet, respectively, thereby. In some embodiments, the first and second socks may be donned substantially simultaneously or concurrently or in parallel to each other.

In some embodiments, the method further comprises: providing a hook member coupled to the base; and affixing said hook member to the relatively stationary element. In some embodiments, the hook member is extendable; wherein the length of the hook member is set prior to inserting the foot into the interior of the sock.

In some embodiments, the method further comprises: utilizing a pole assembly, which extends upwardly from the base, to adjust a direction of the caddy relative to a direction of the foot to be inserted into the interior of the sock. In some embodiments, the pole assembly comprises: a straight pole section; a hand graspable knob fitted from above to said straight pole section; and a bent pole section fitted from below to said straight pole section that is rotatable within a cup attachment fixed to the base; wherein the method further comprises: selectively rotating said bent pole section when desired to bring said knob closer or farther away from the relatively stationary element in order to facilitate apparatus repositioning.

The Applicant has realized that the device for wearing or donning socks, which is depicted in FIGS. 1 to 31C and which is discussed above in relation to FIGS. 1 to 31C, may be modified and/or improved and/or enhanced in order to achieve a more-efficient, more user-friendly, more convenient, more useful, and/or more versatile device for wearing or donning or putting-on socks. Such modified or improved device for wearing socks, with its improvements, modifications, additions, substitutions, and/or other changes, in accordance with the present invention, is demonstrated in FIGS. 32 to 38E, and is further discussed herein; however, such improved device may comprise or may incorporate therein some of the units or modules or features that are depicted in any one of FIGS. 1 to 31C and/or that are discussed in the text with reference to any one of FIGS. 1 to 31C.

Reference is made to FIGS. 32A to 32E, which demonstrate an improved device 400 for wearing socks (or for assisting a person in putting-on a sock), and its improved components or units, in accordance with some demonstrative embodiments of the present invention.

Figure 33:
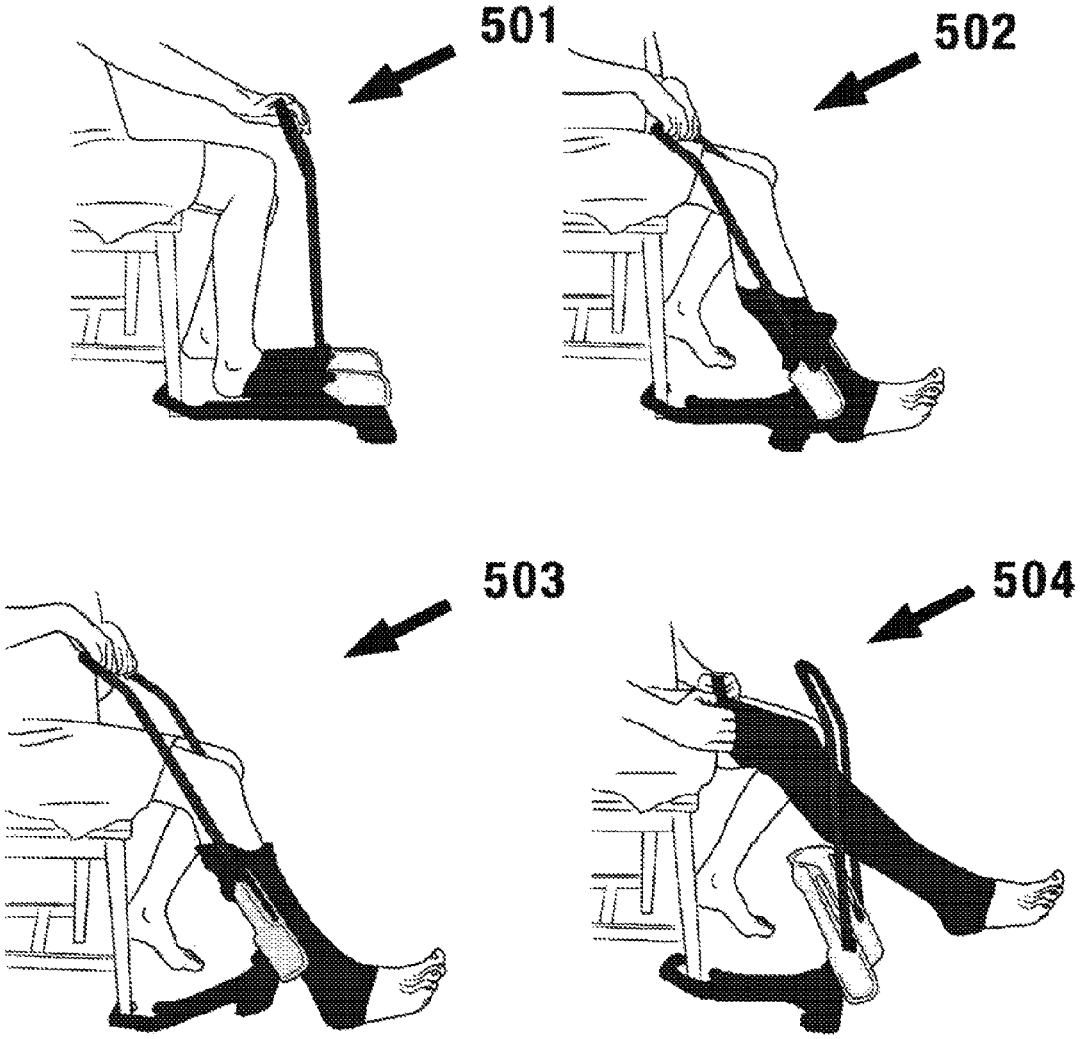
FIG. 33 is a schematic illustration which demonstrates four stages of a process of using the device for wearing a sock, in accordance with some demonstrative embodiments of the present invention.
Figure 34A:
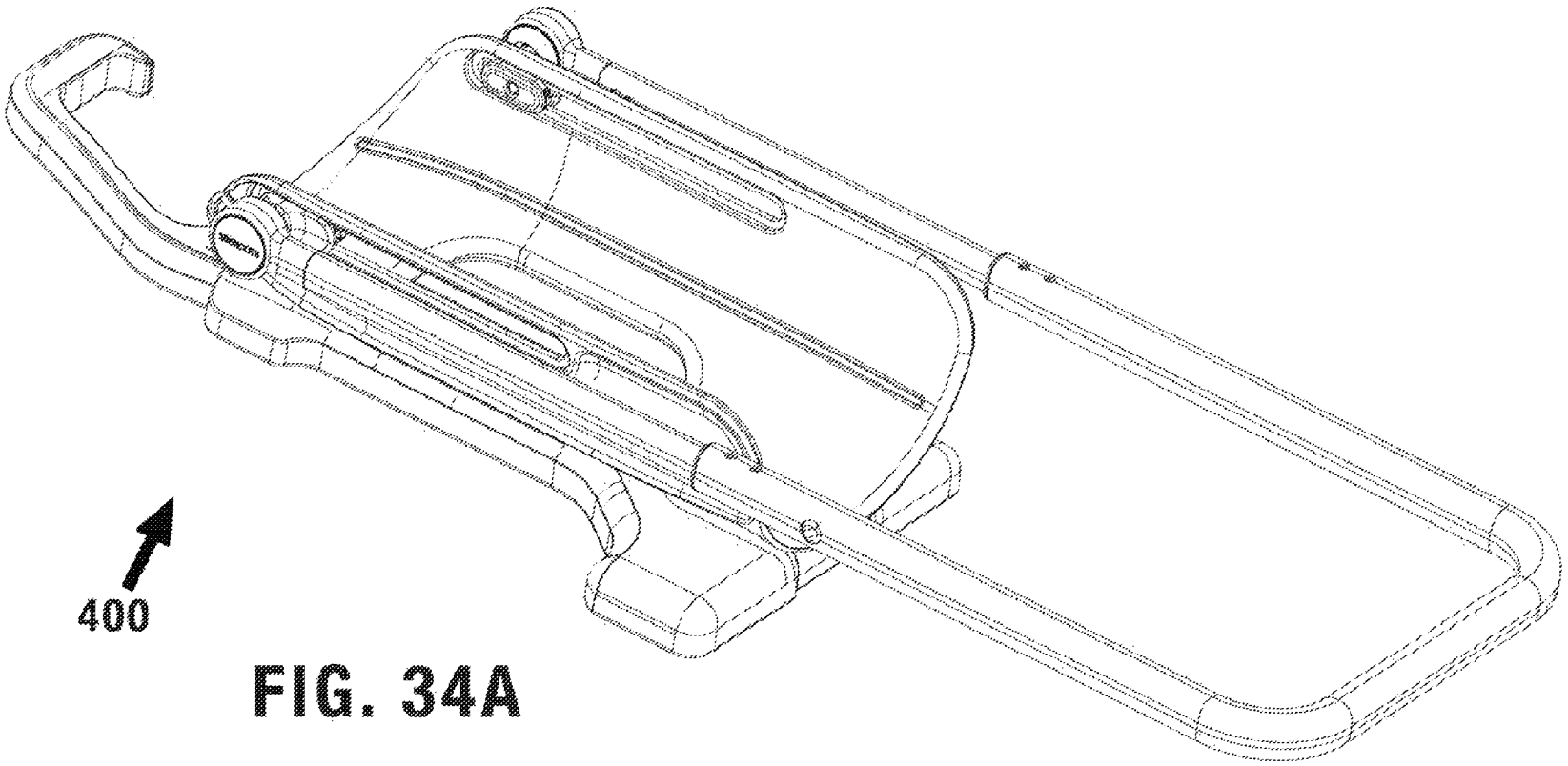
FIGS. 34A to 34H are additional schematic illustrations of the improved device for wearing socks, and its improved components, in accordance with some demonstrative embodiments of the present invention.
Figure 34B:
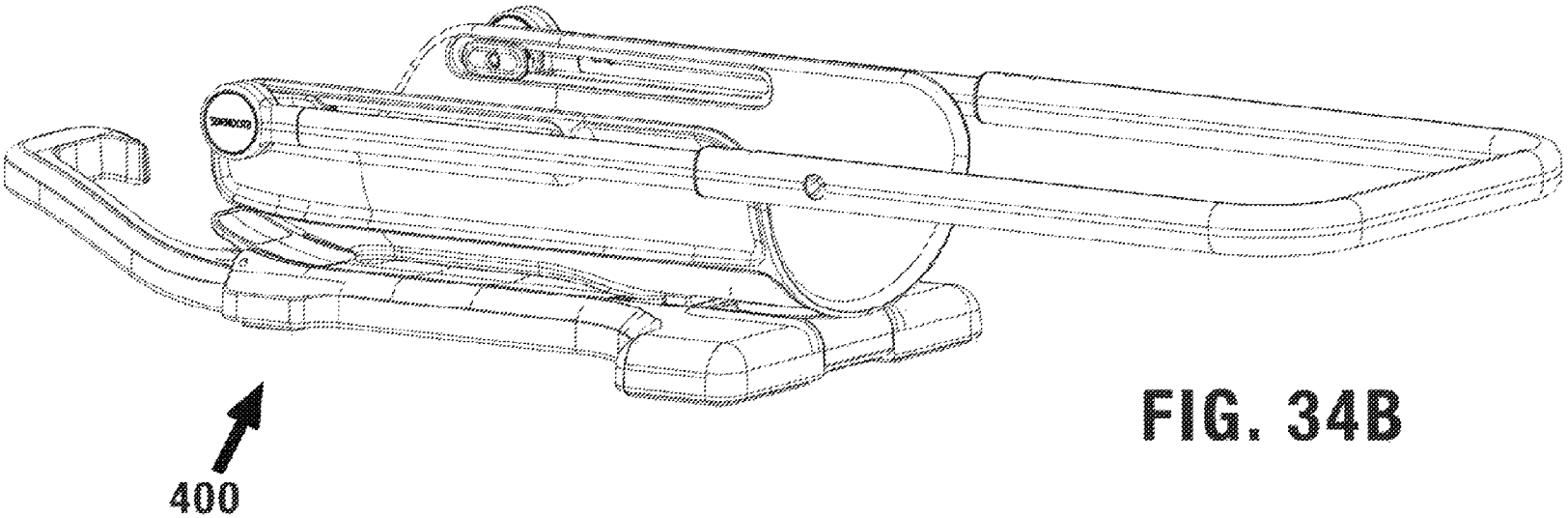
Figure 34C:
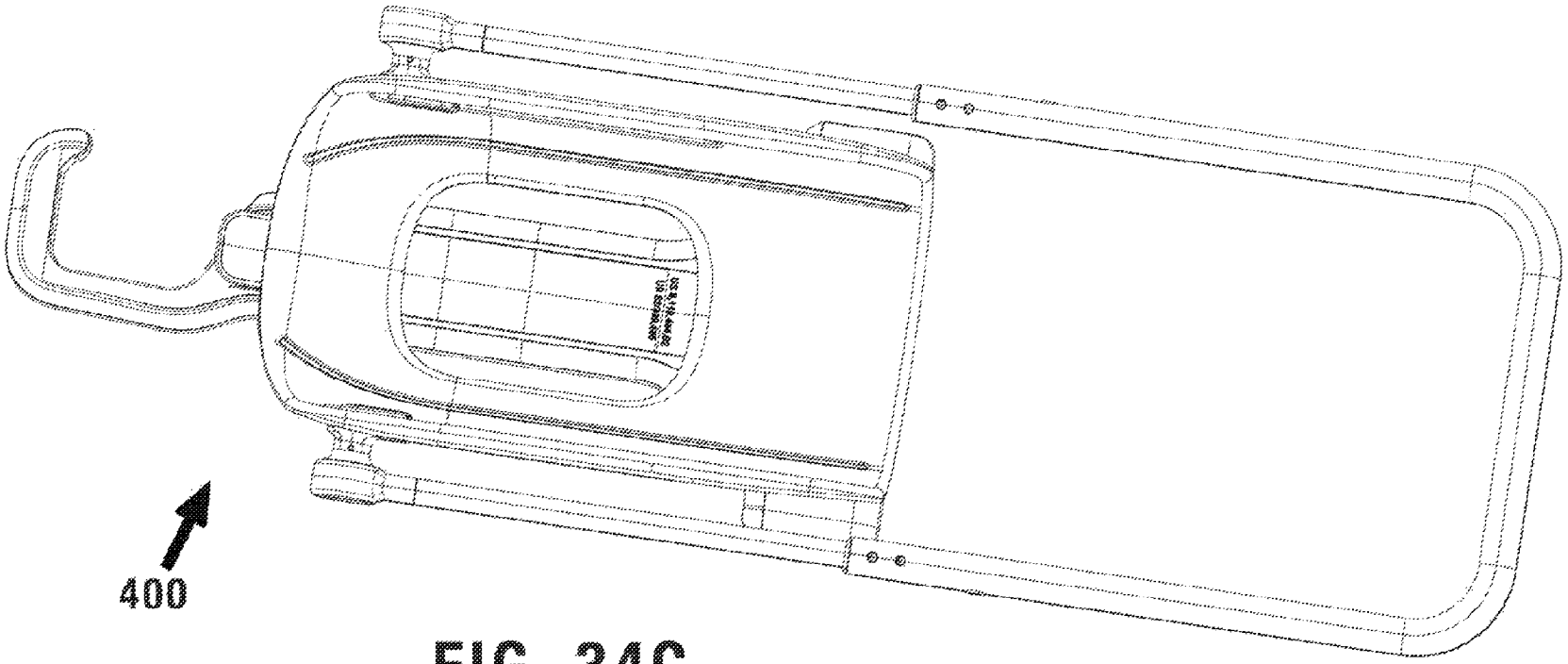
Figure 34D:
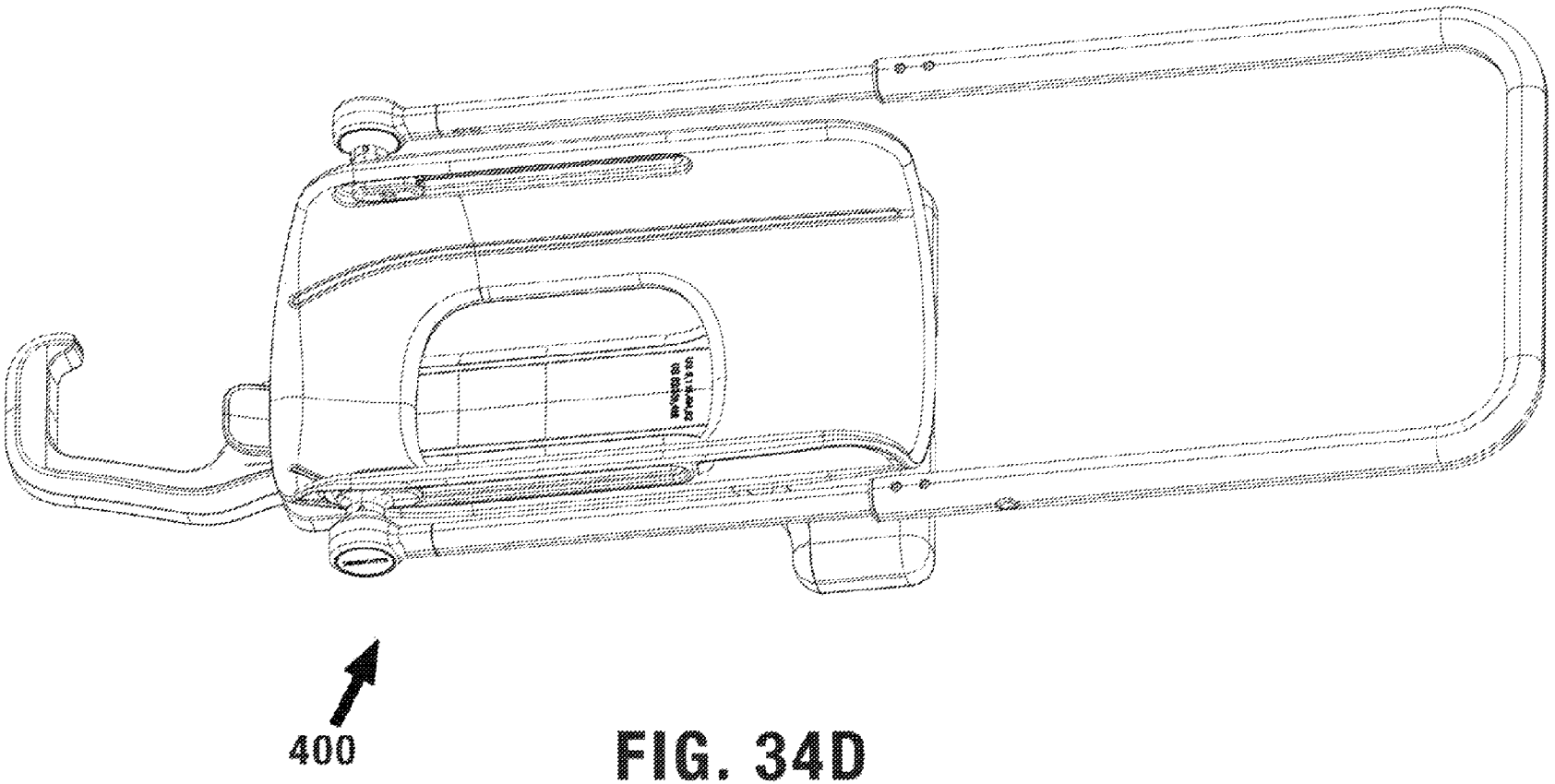
Figure 34E:
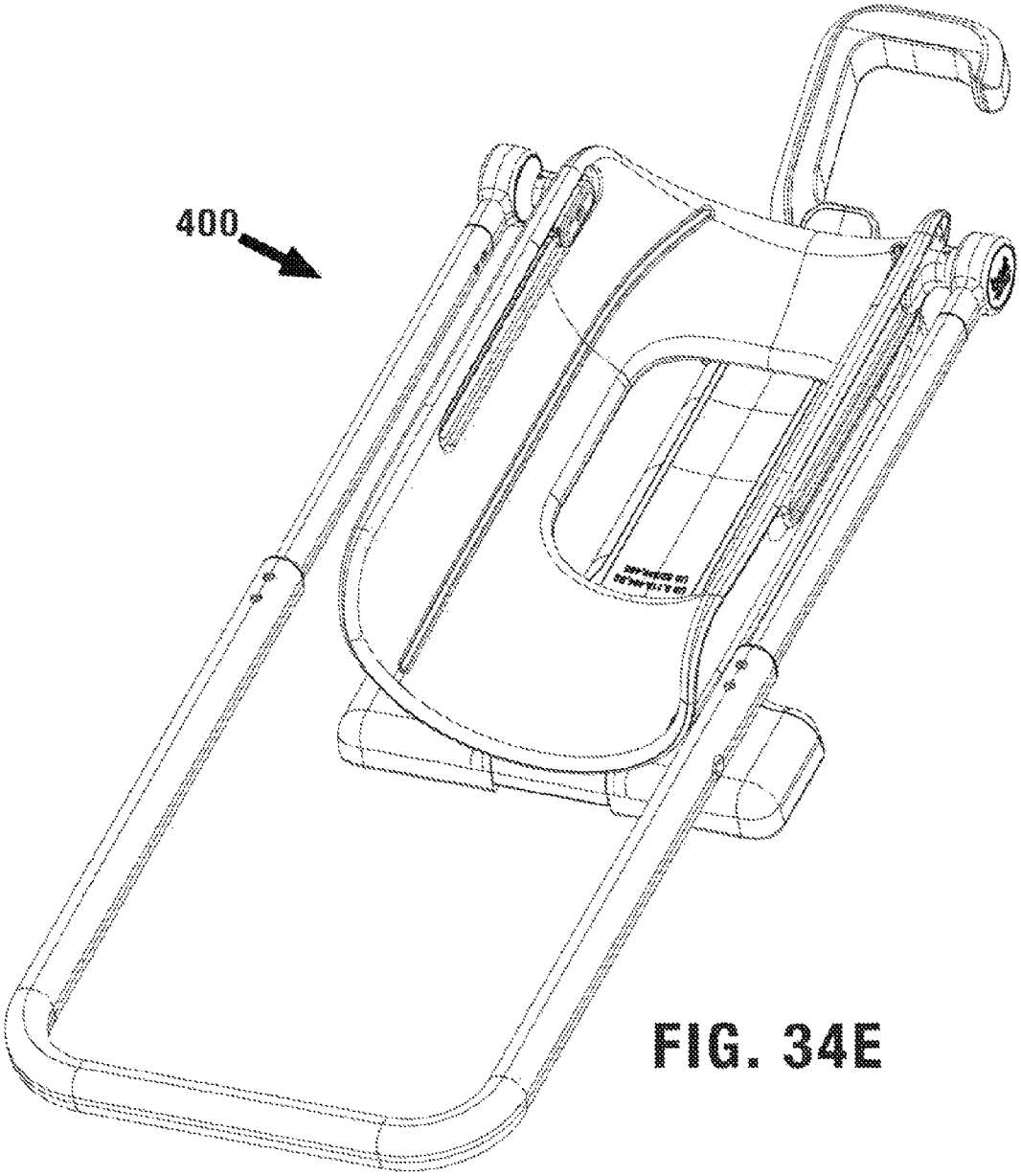
Figure 34F:
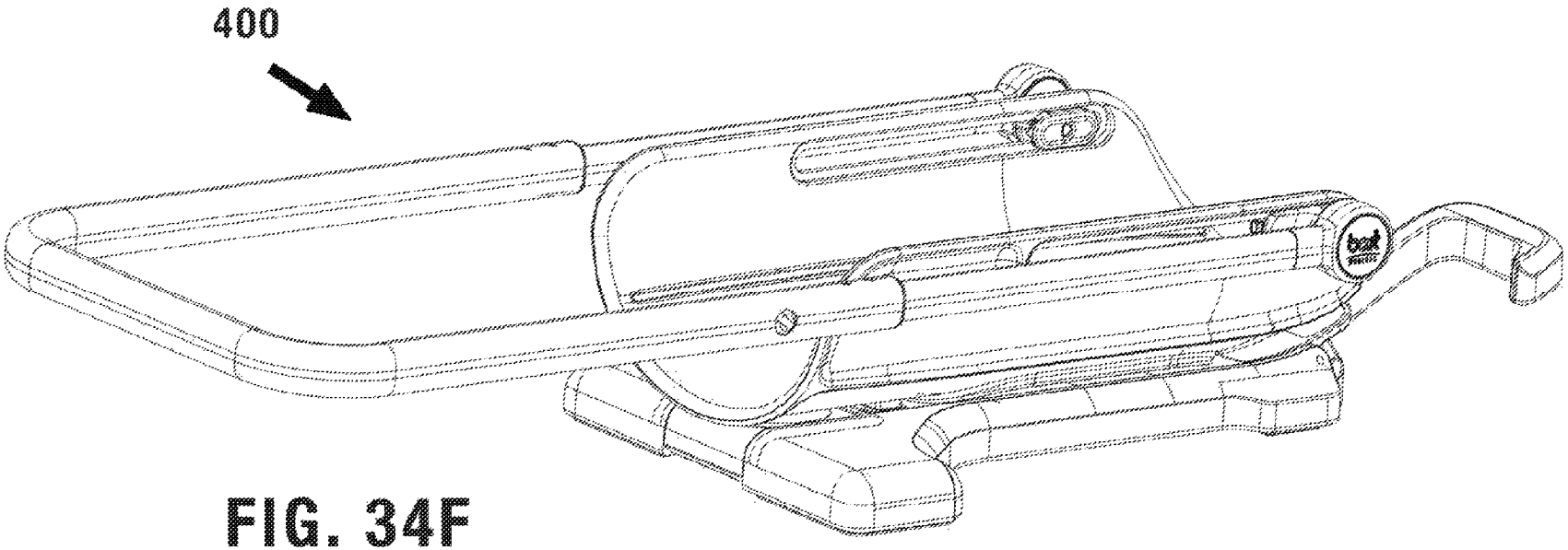
Figure 34G:
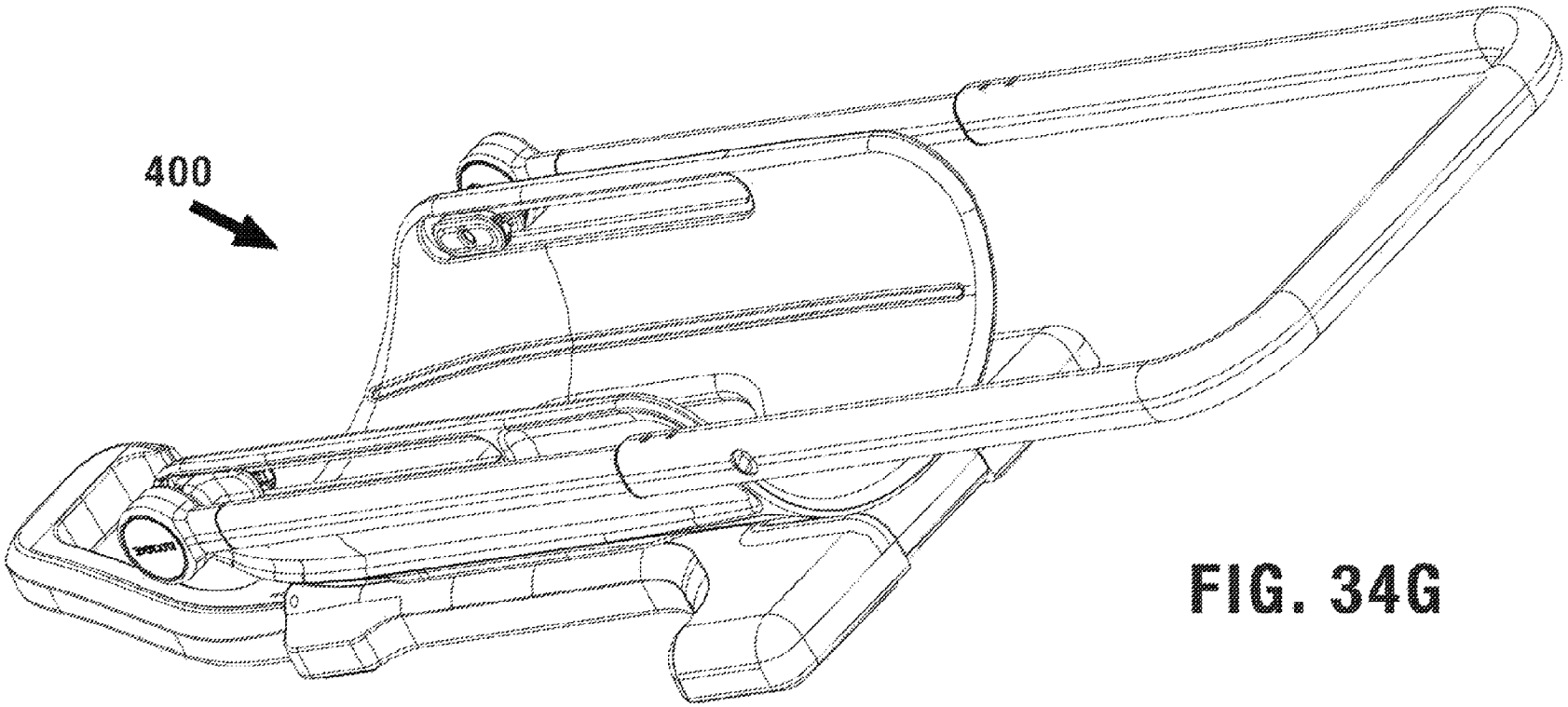
Figure 34H:
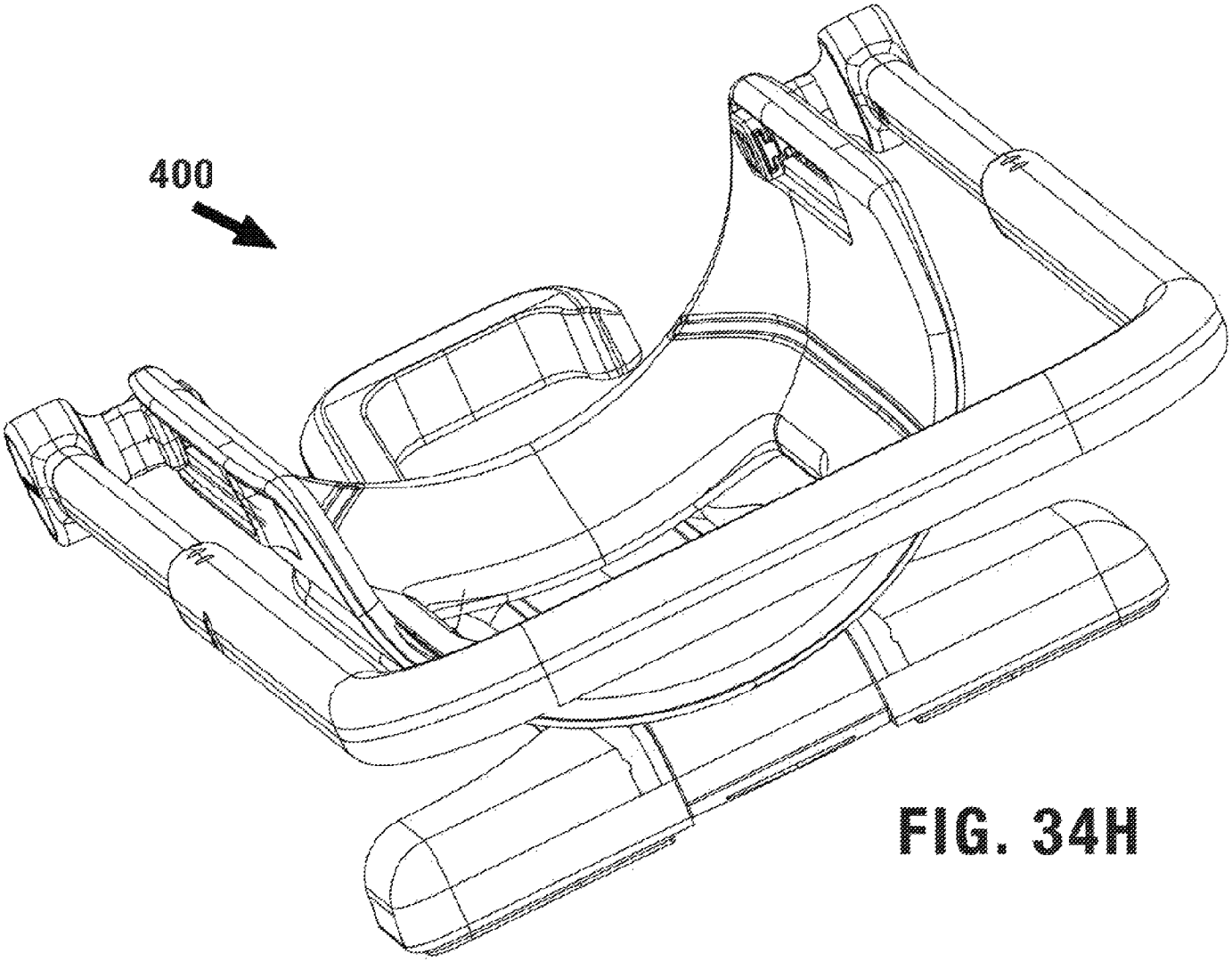
Figure 35A:
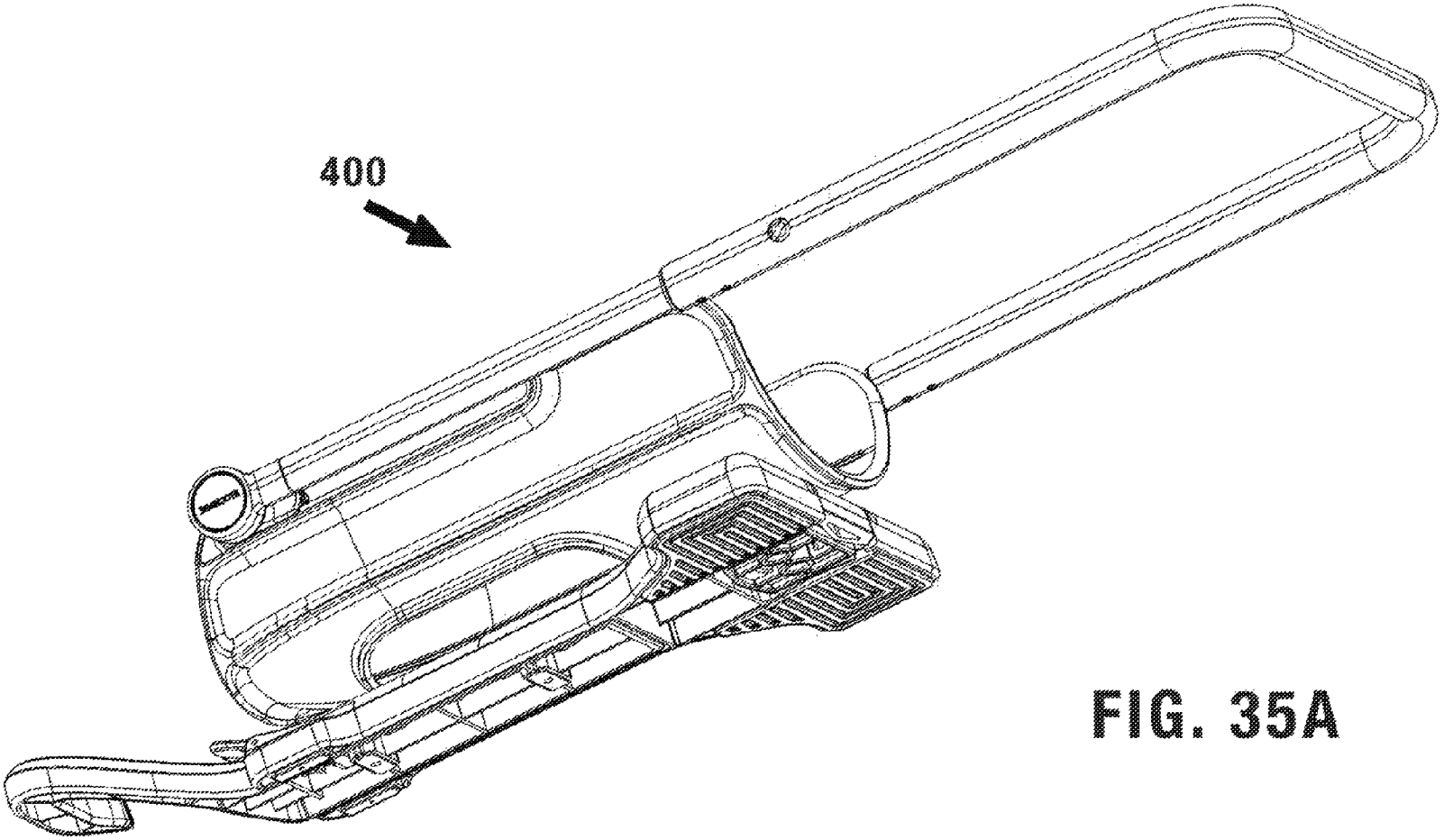
FIGS. 35A to 35F are further schematic illustrations of the improved device for wearing socks, and its improved components, in accordance with some demonstrative embodiments of the present invention.
Figure 35B:
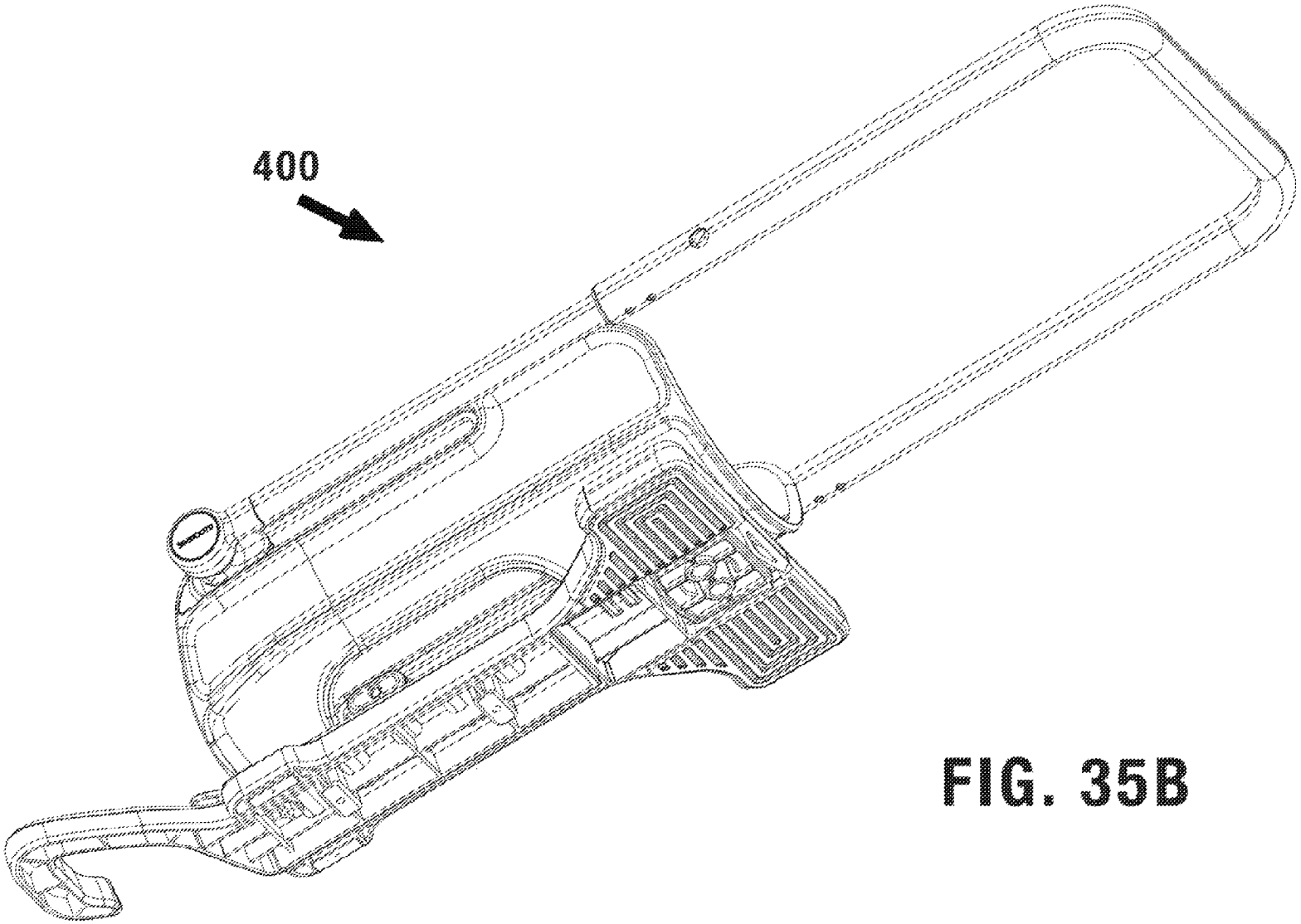
Figure 35C:
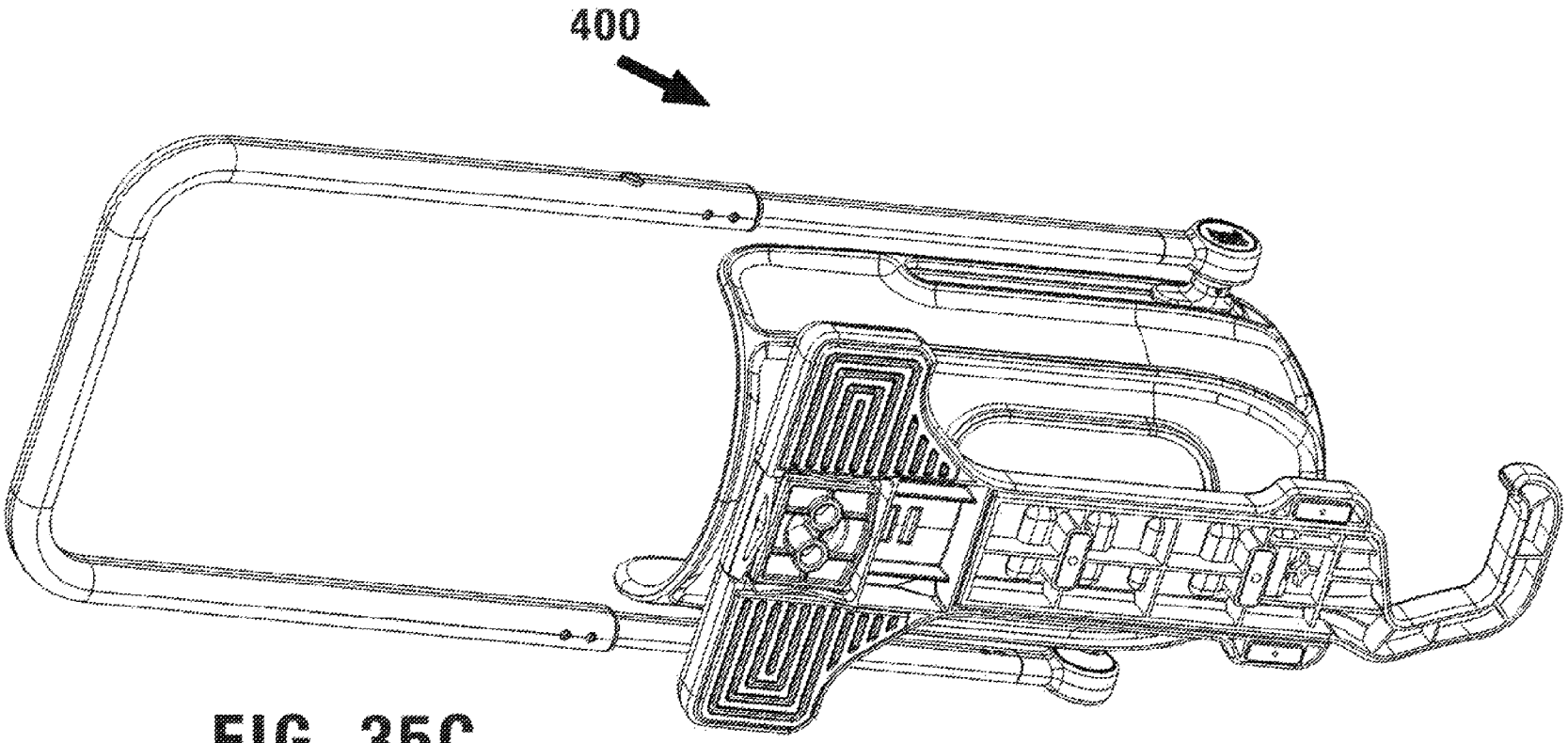
Figure 35D:
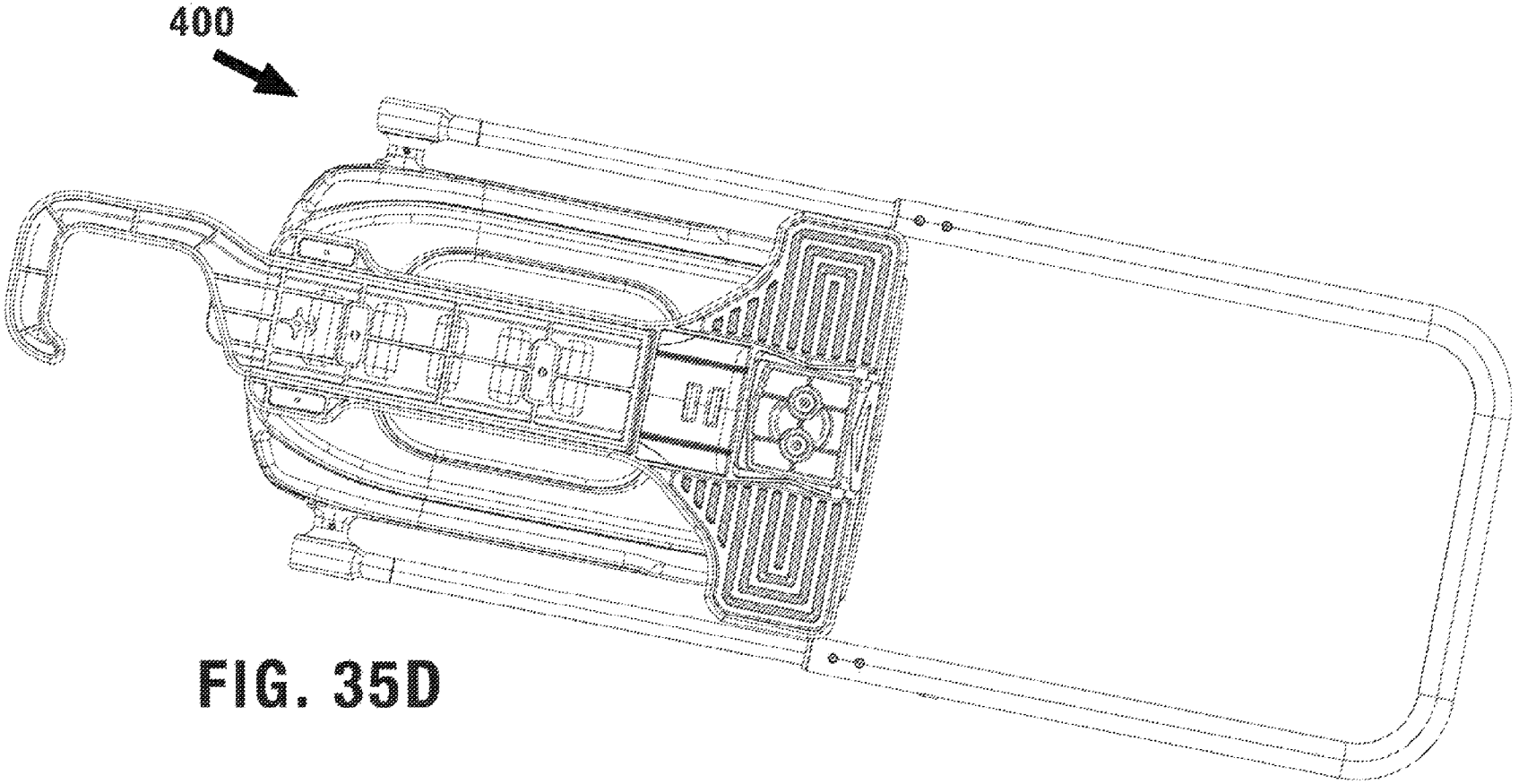
Figure 35E:
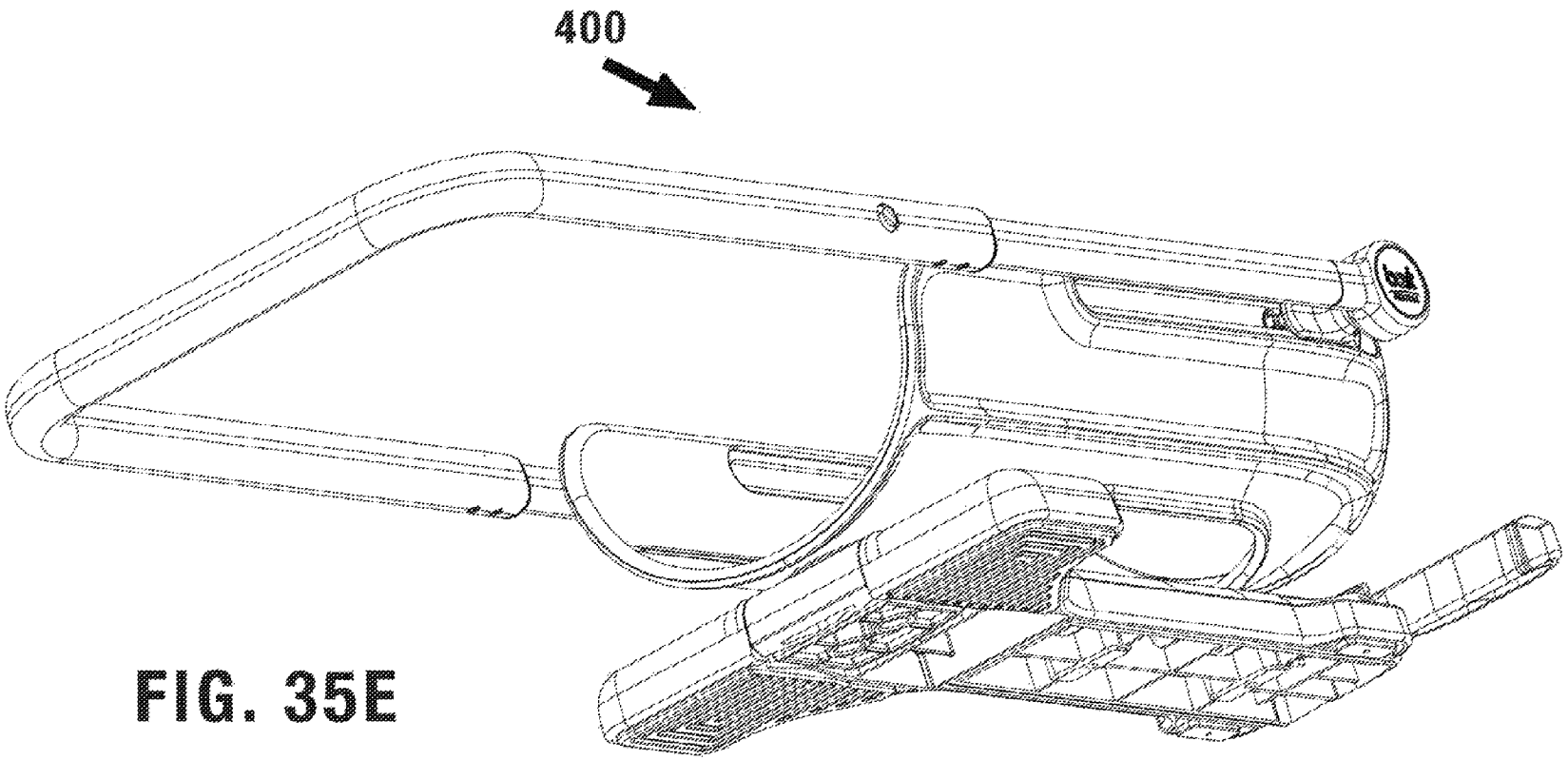
Figure 35F:
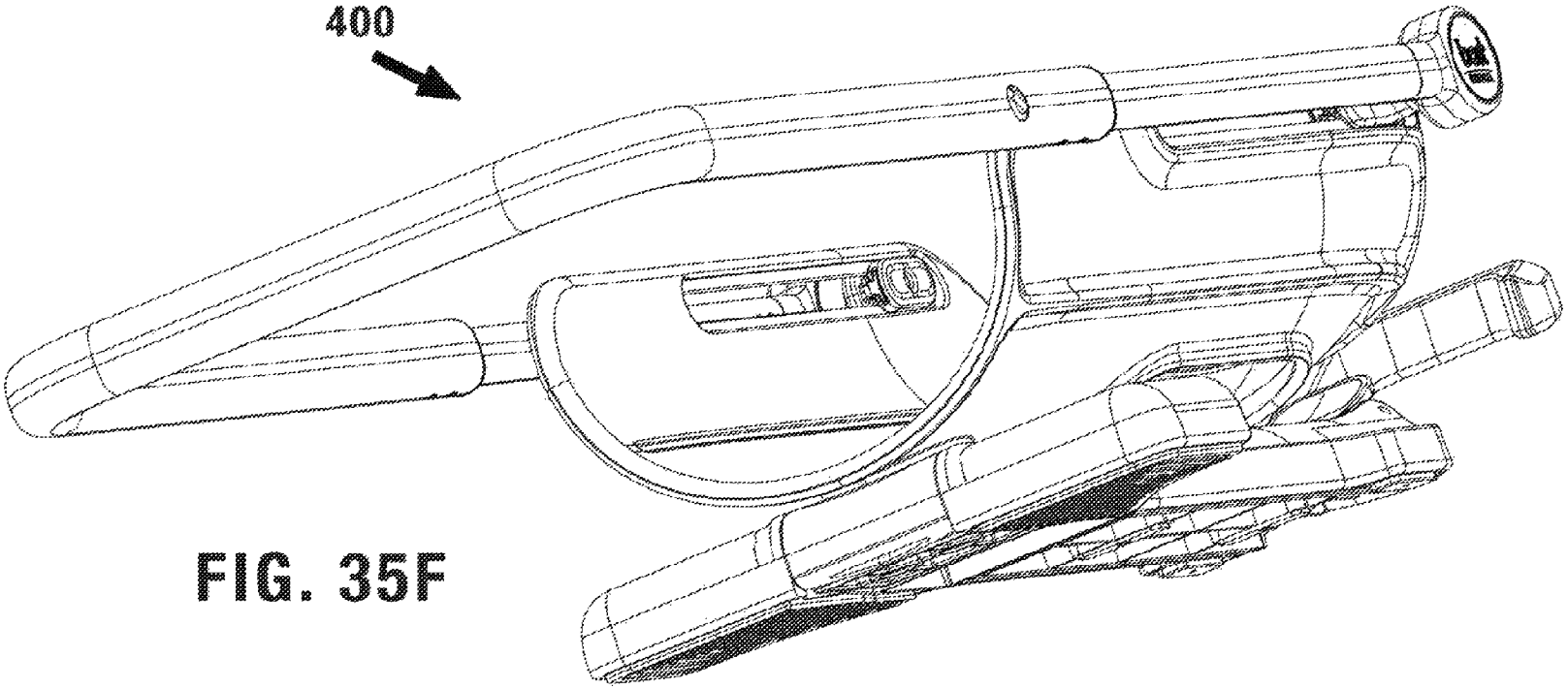
Figure 36A:
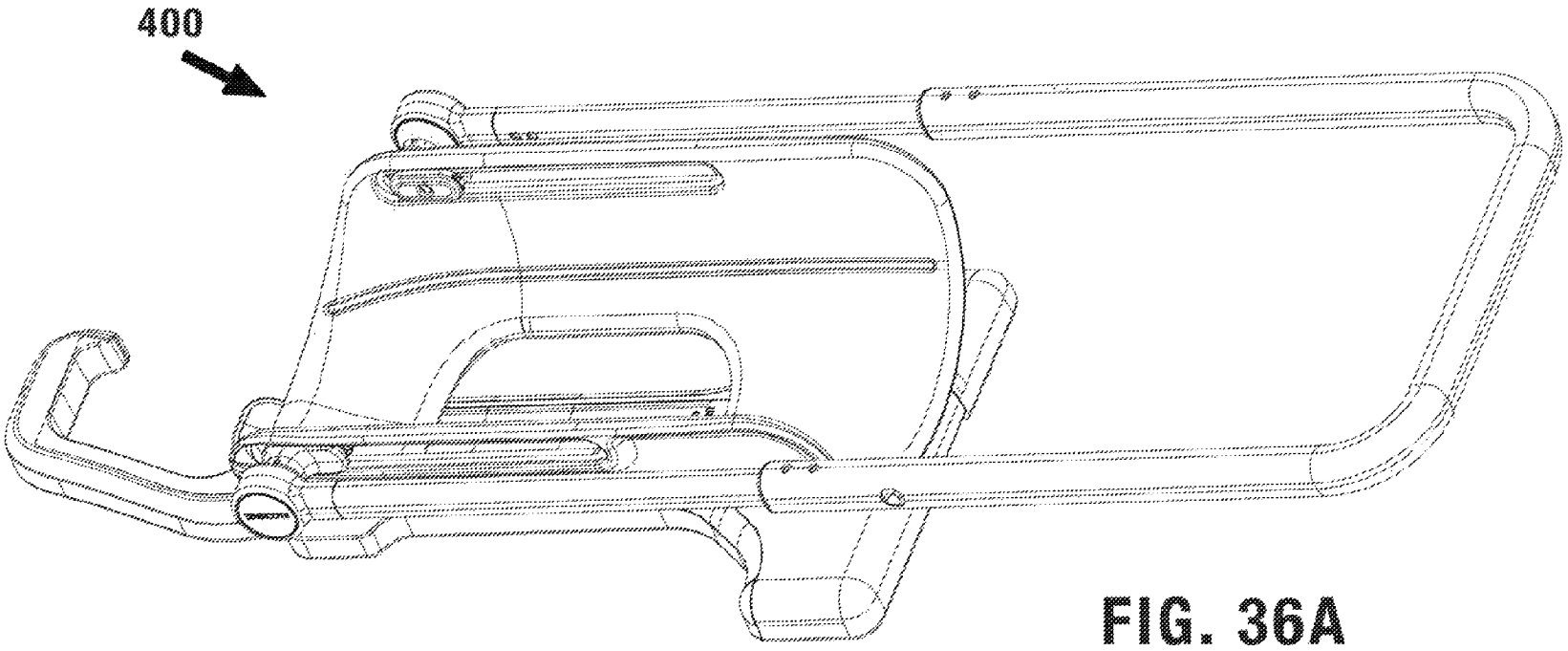
FIGS. 36A to 36G are additional schematic illustrations of the improved device for wearing socks, and its improved components, in accordance with some demonstrative embodiments of the present invention.
Figure 36B:
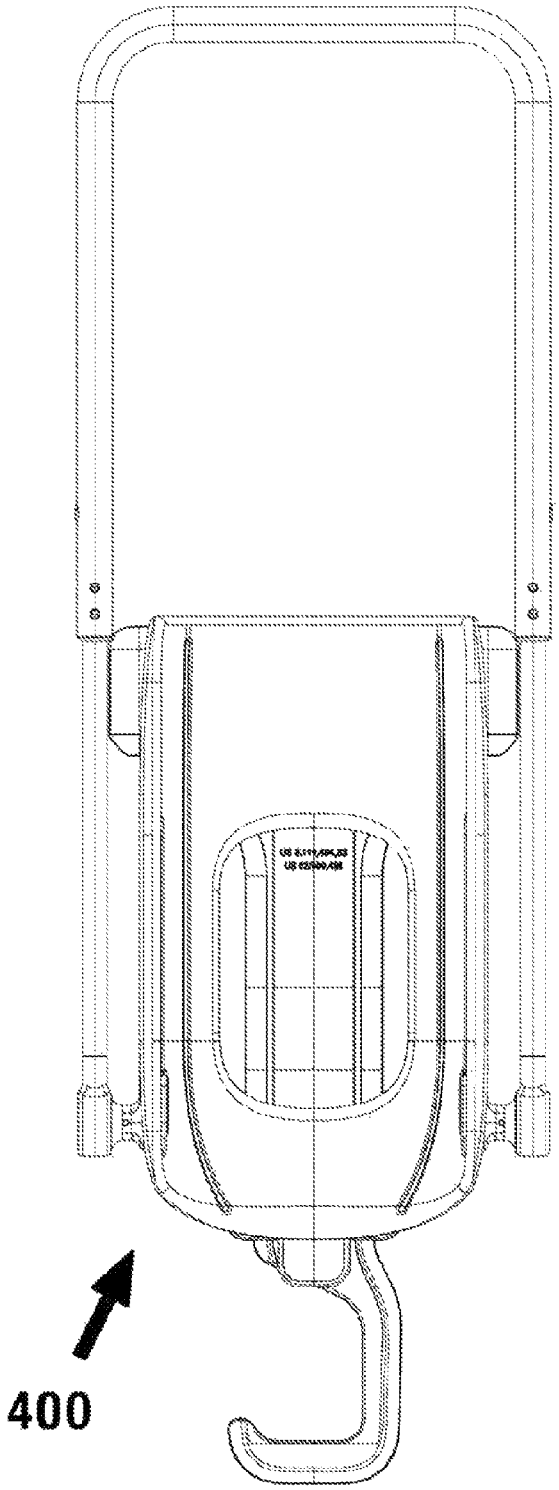
Figure 36C:
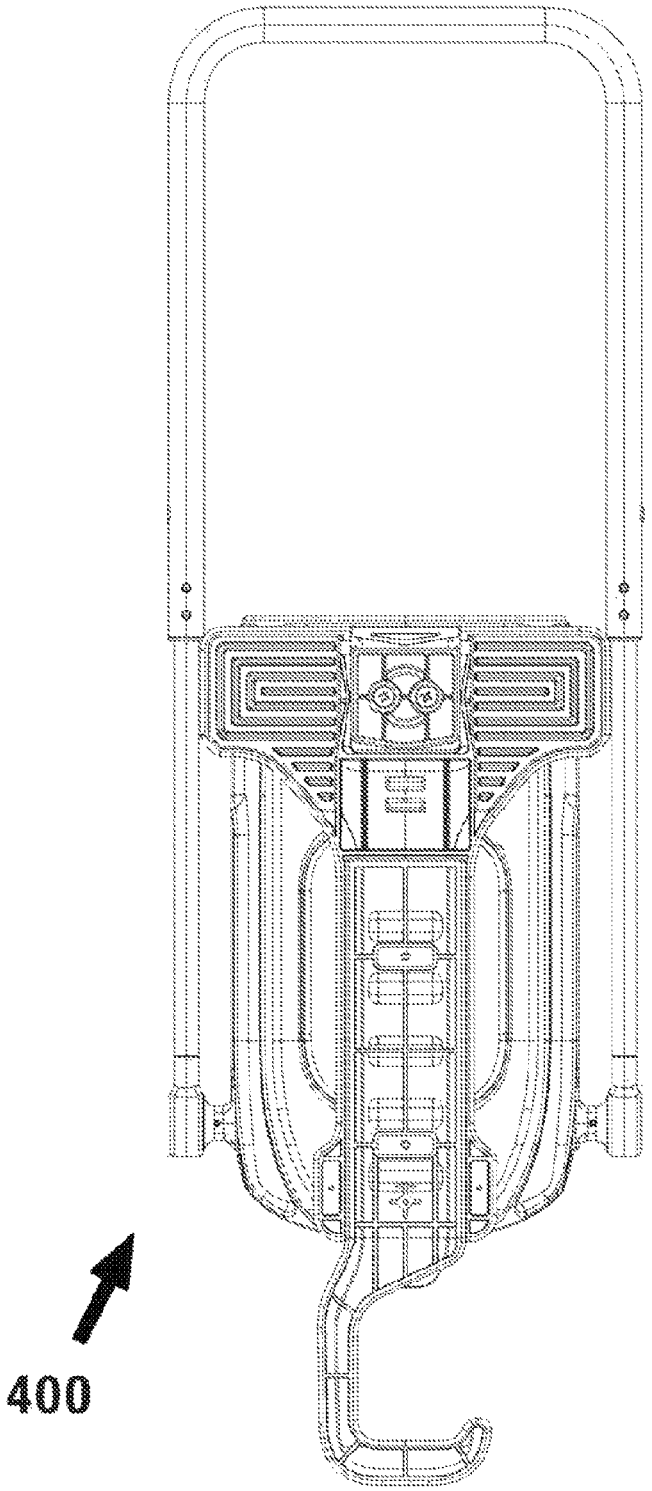
Figure 36D:
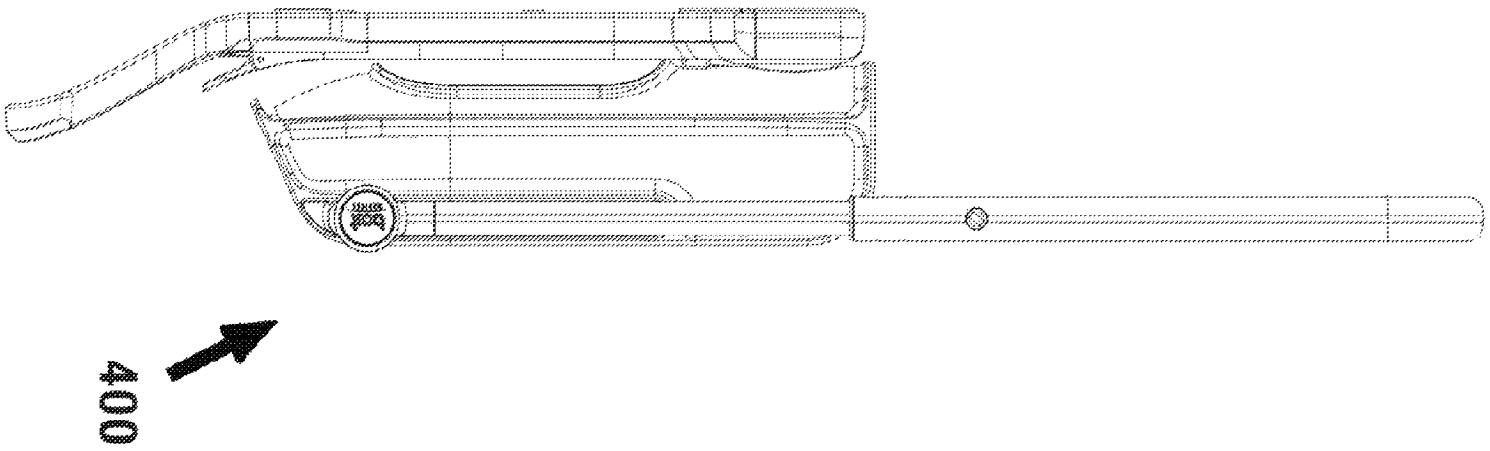
Figure 36E:
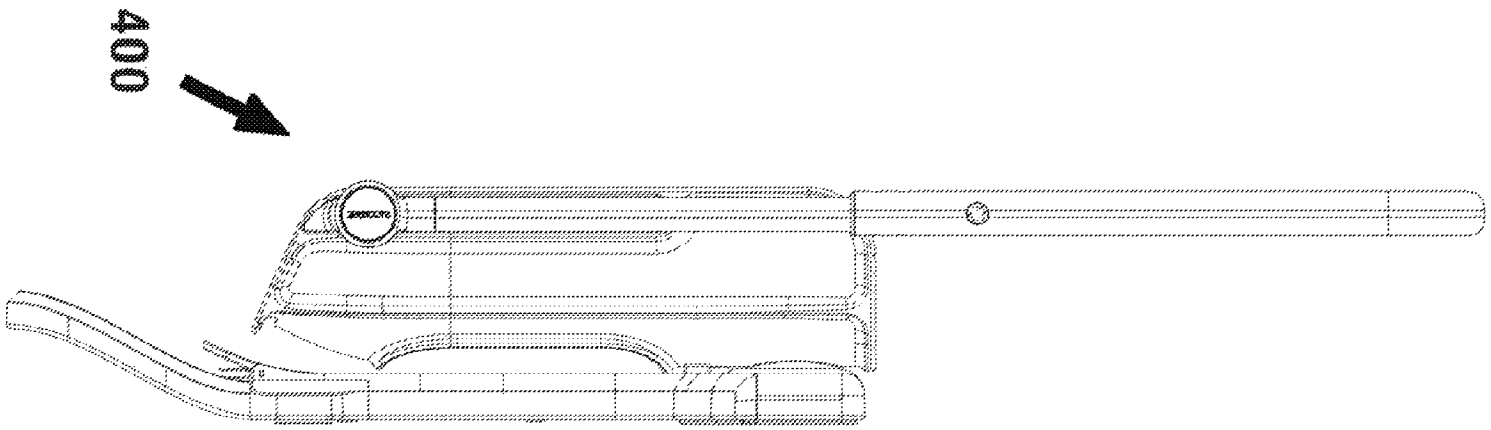
Figure 36F:
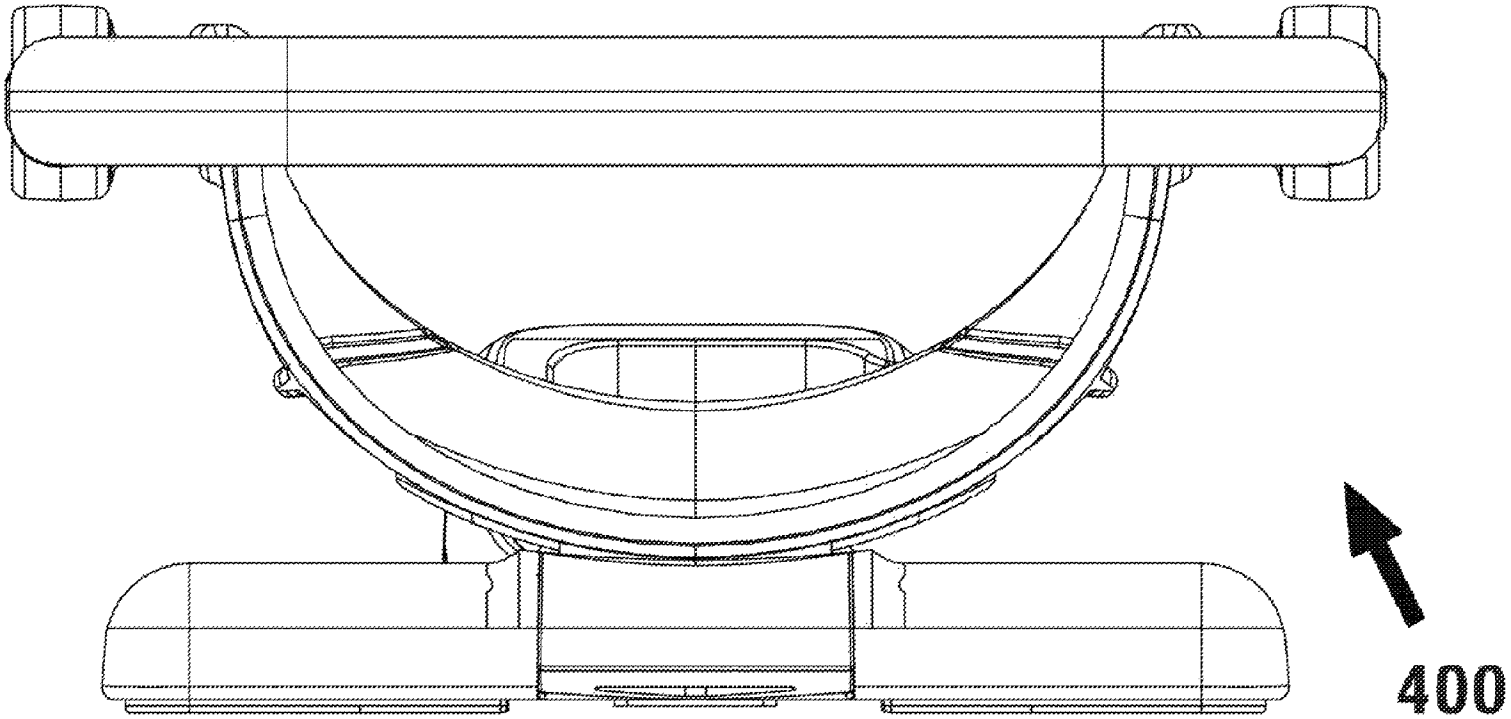
Figure 36G:
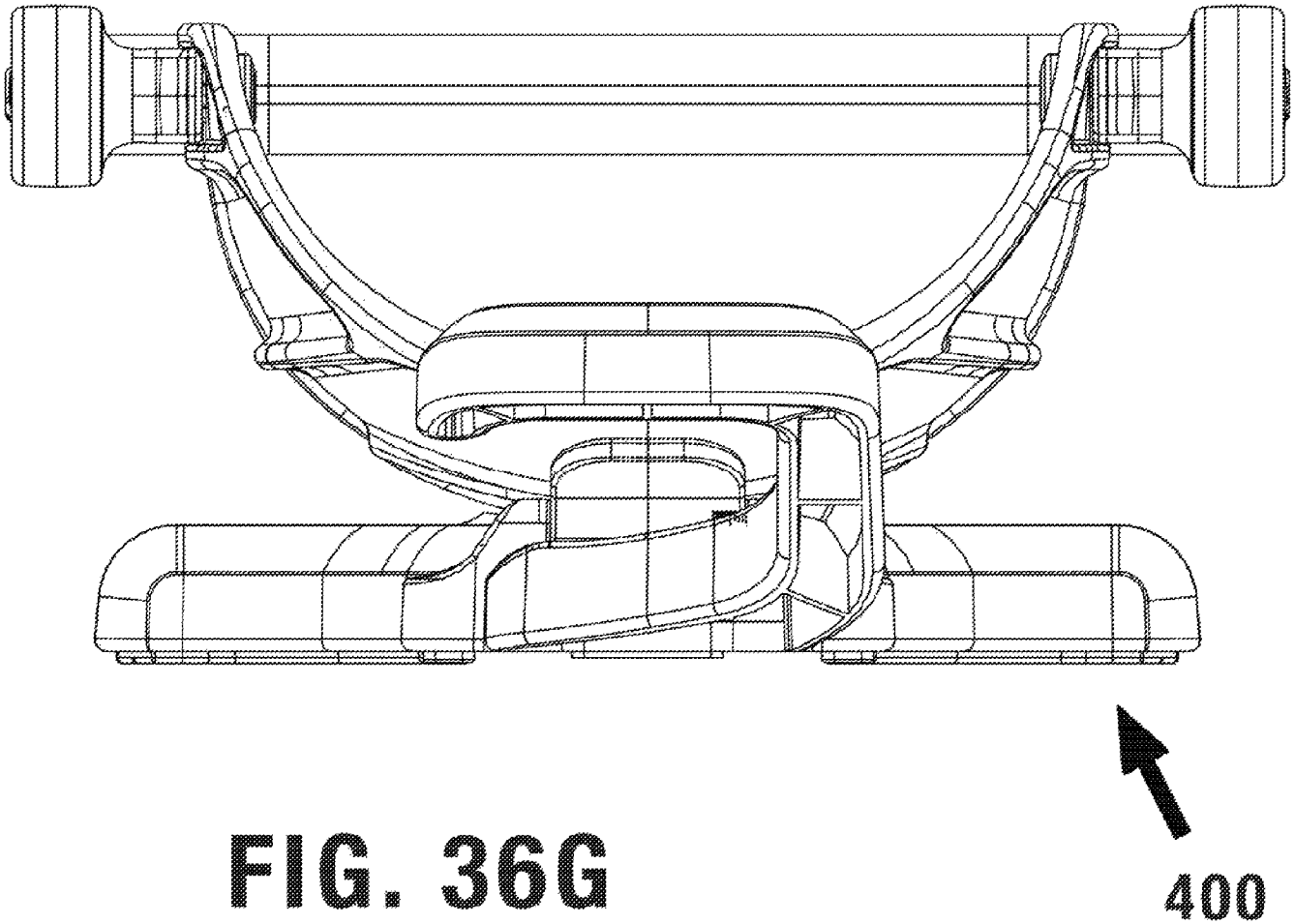
Figure 37A:
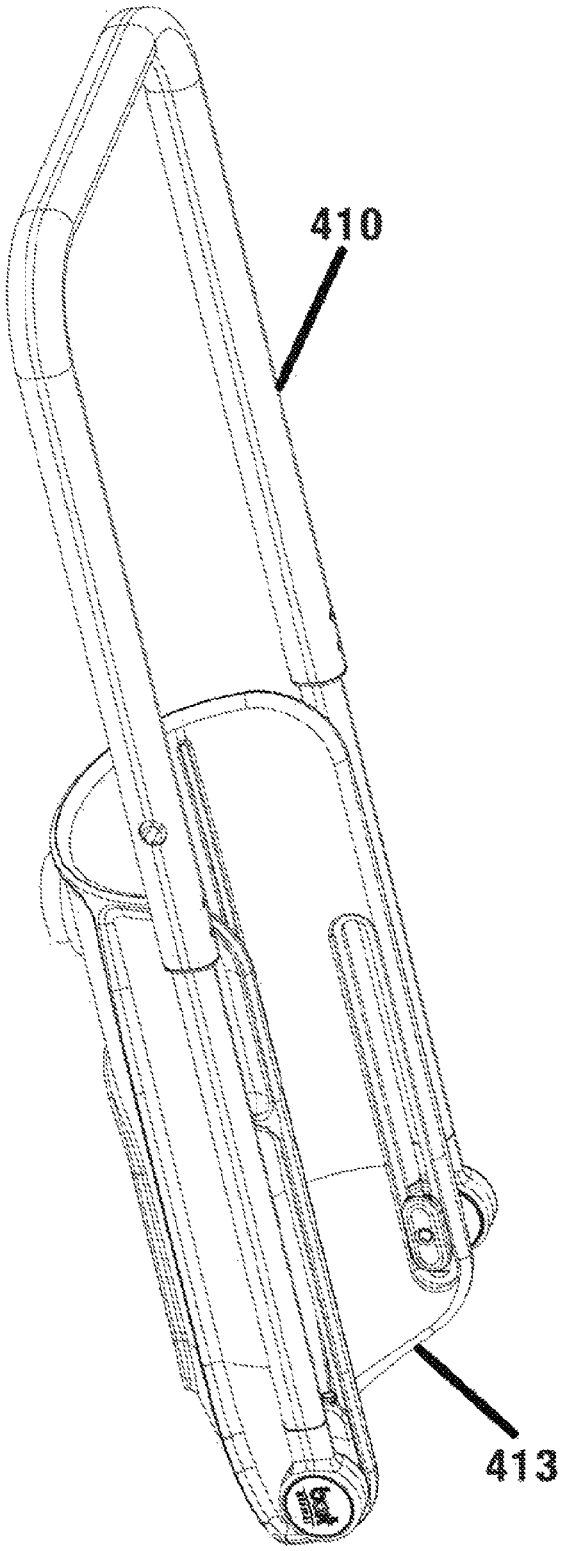
FIGS. 37A to 37H are schematic illustrations of the improved handle assembly and the improved caddy, of the improved device for wearing socks, in accordance with some demonstrative embodiments of the present invention.
Figure 37B:
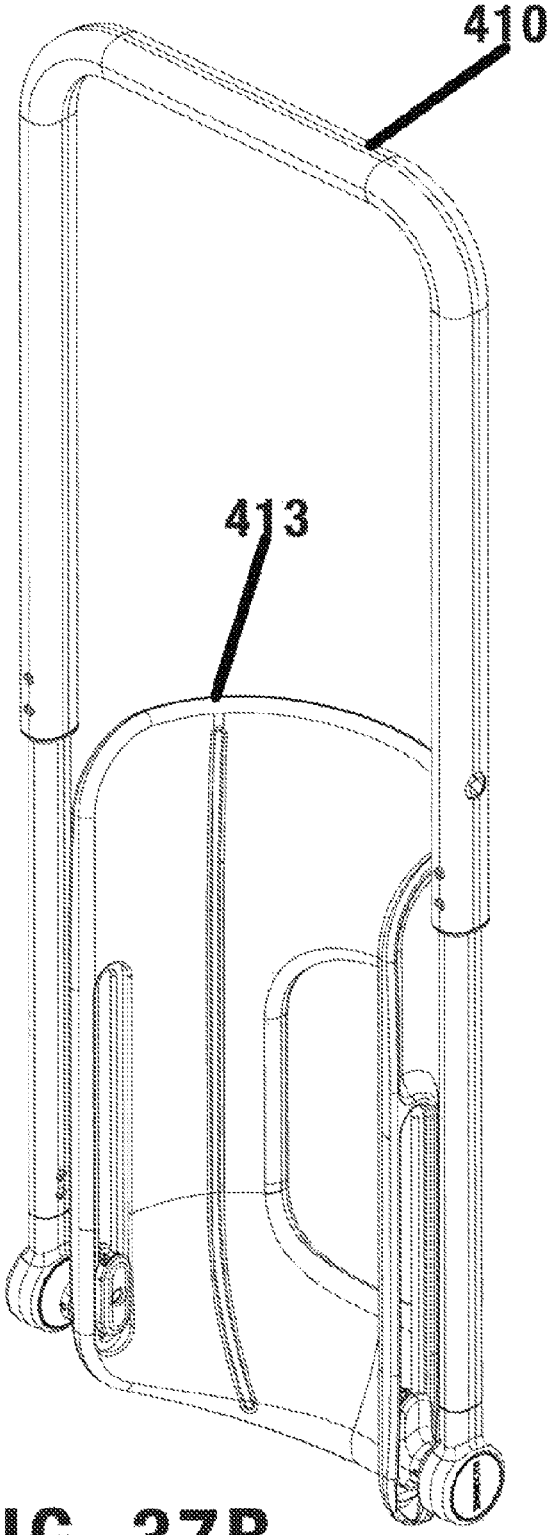
Figure 37C:
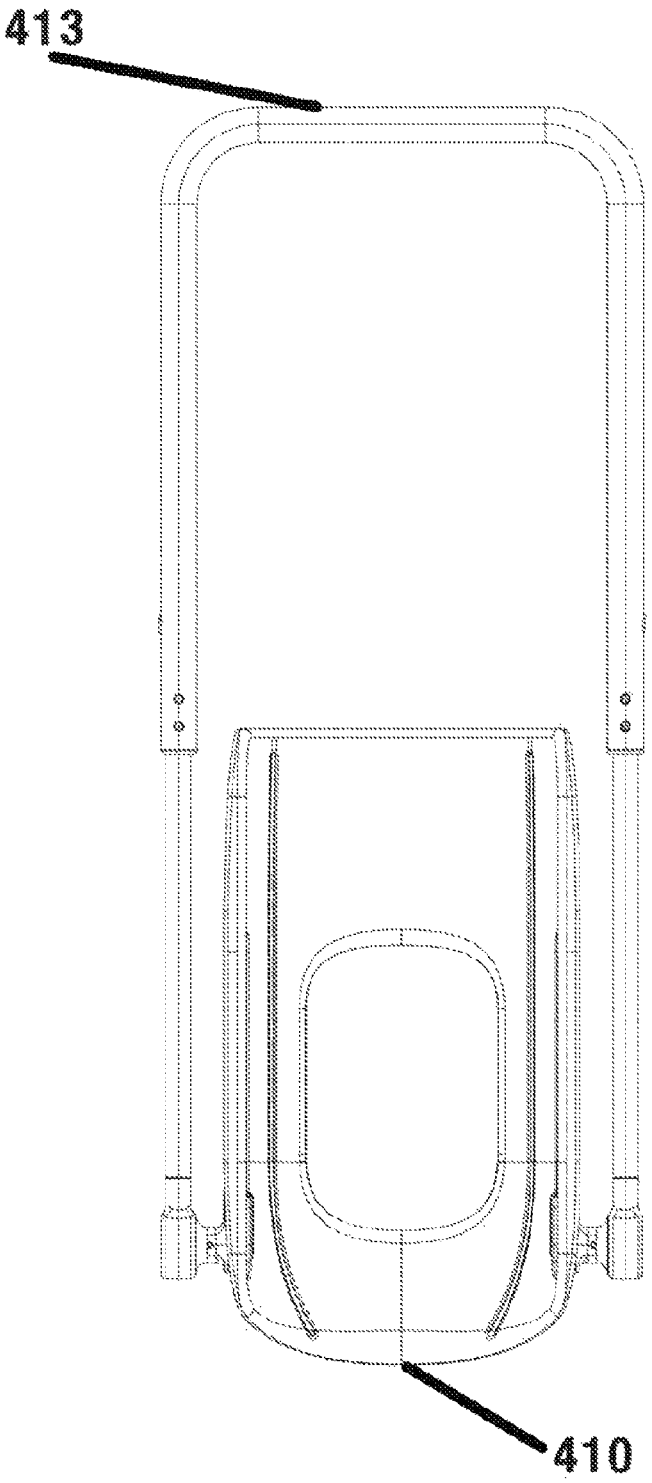
Figure 37D:
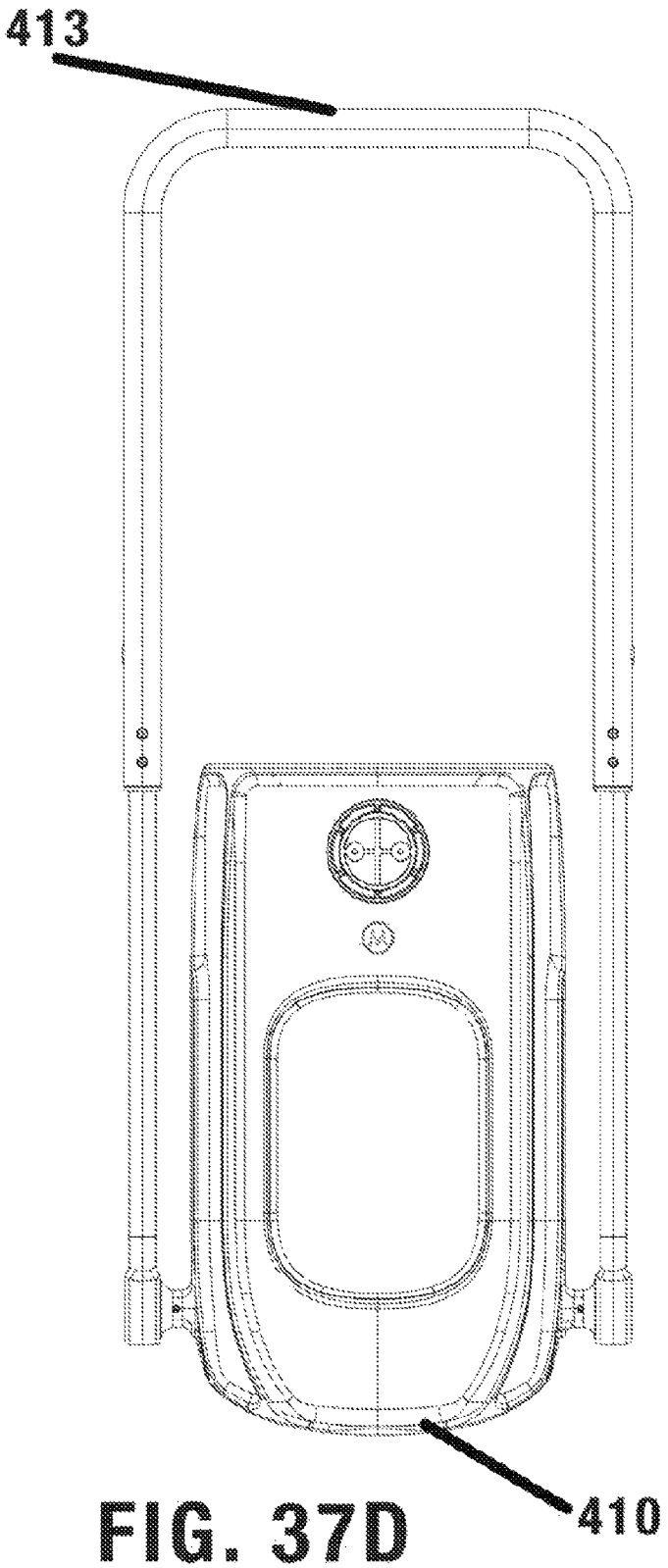
Figure 37E:
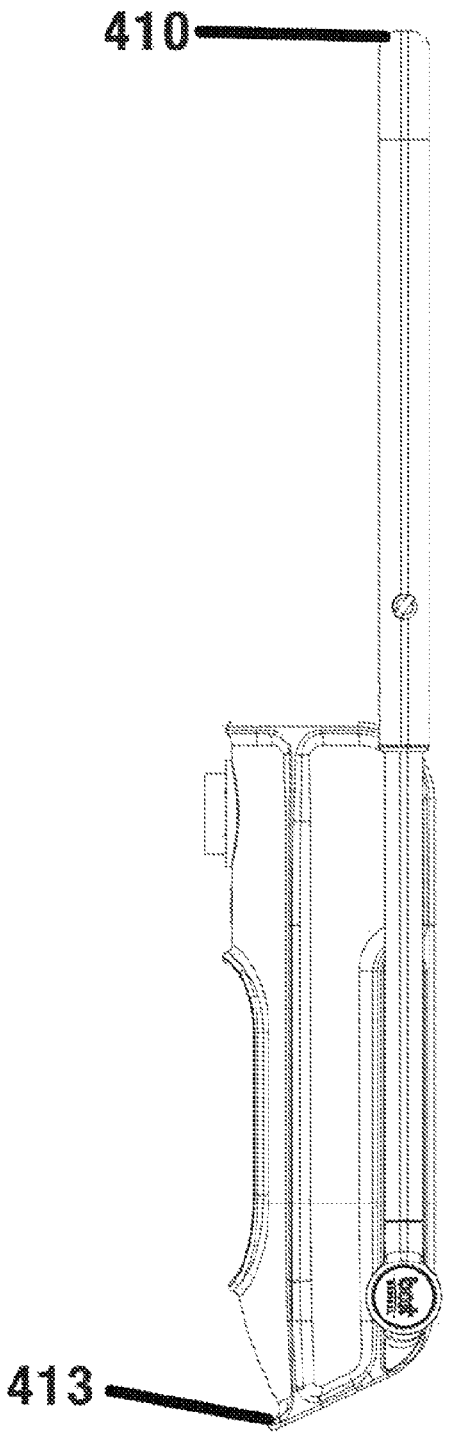
Figure 37F:
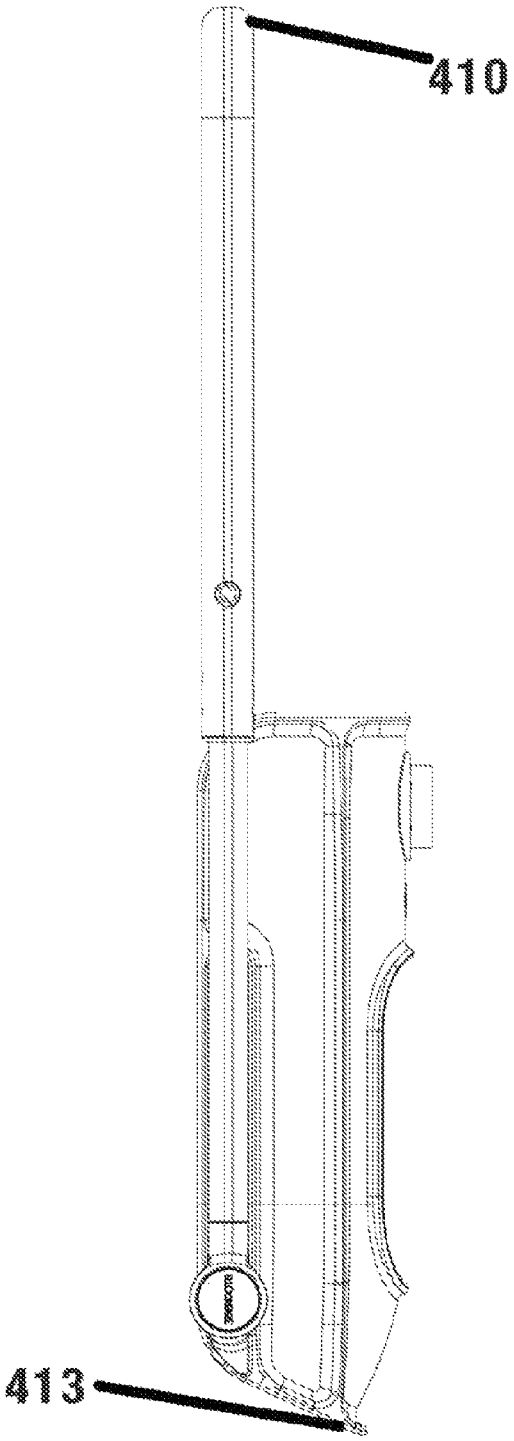
Figure 37G:
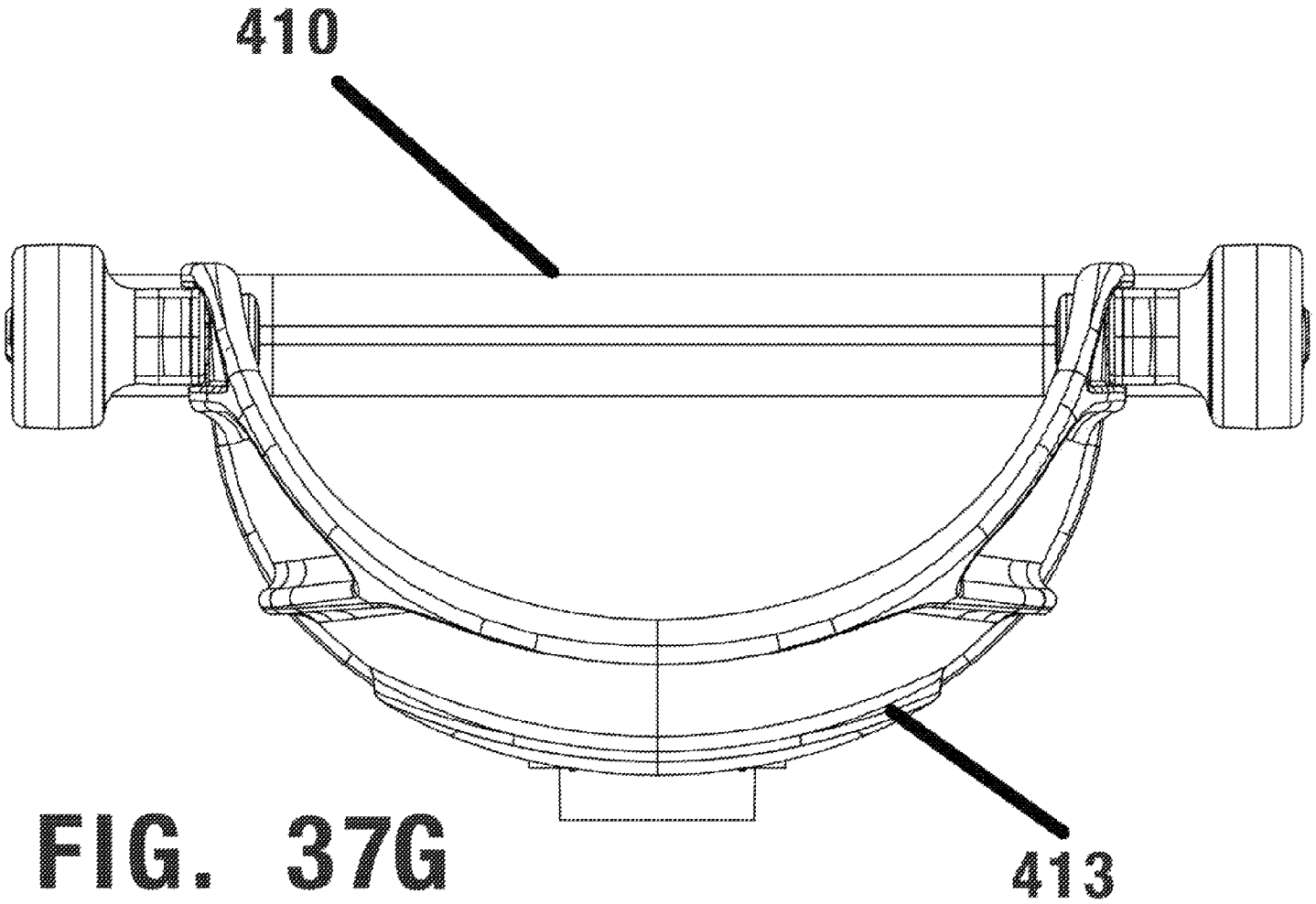
Figure 37H:
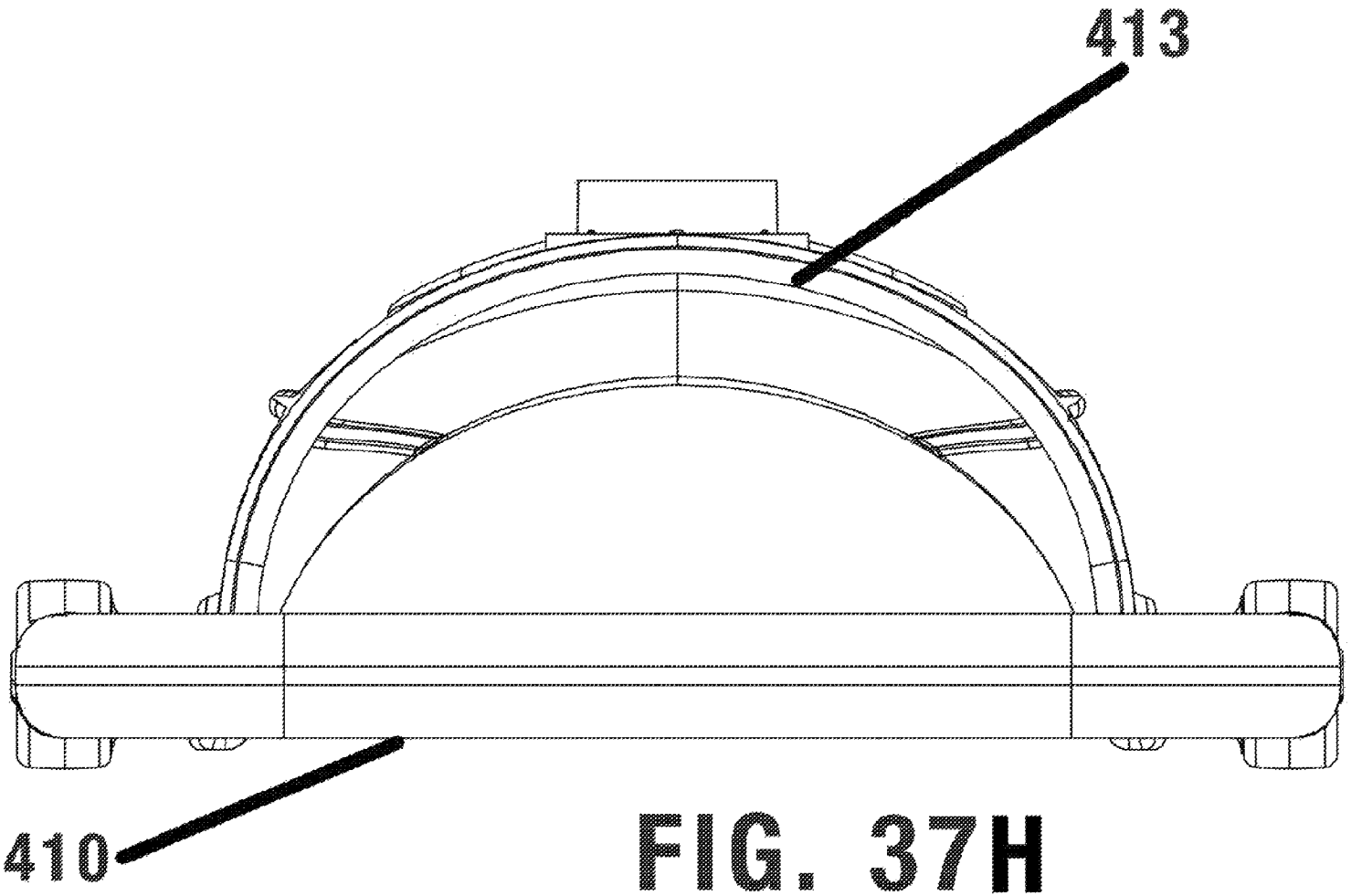
Figure 38A:
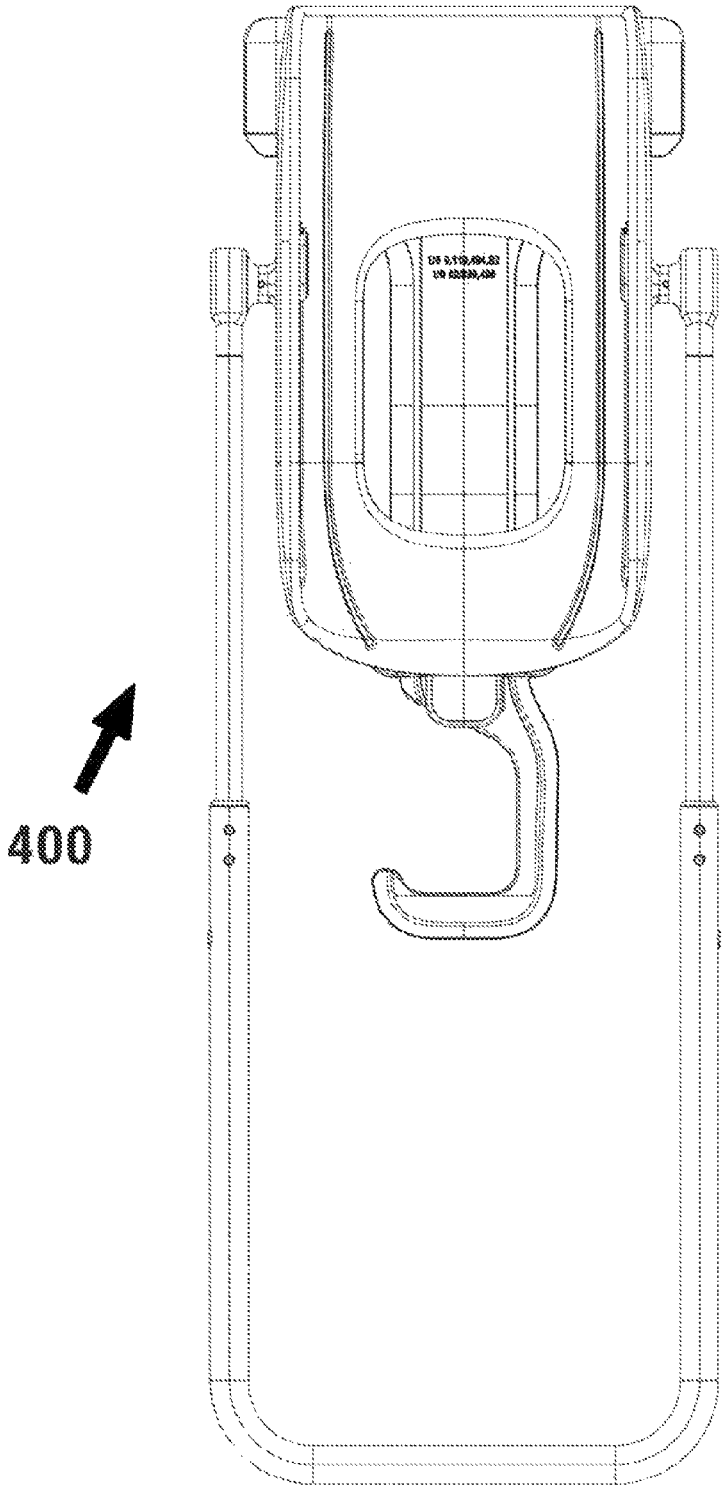
FIGS. 38A to 38E are additional schematic illustrations of the improved device for wearing socks, and its improved components, in accordance with some demonstrative embodiments of the present invention.
Figure 38B:
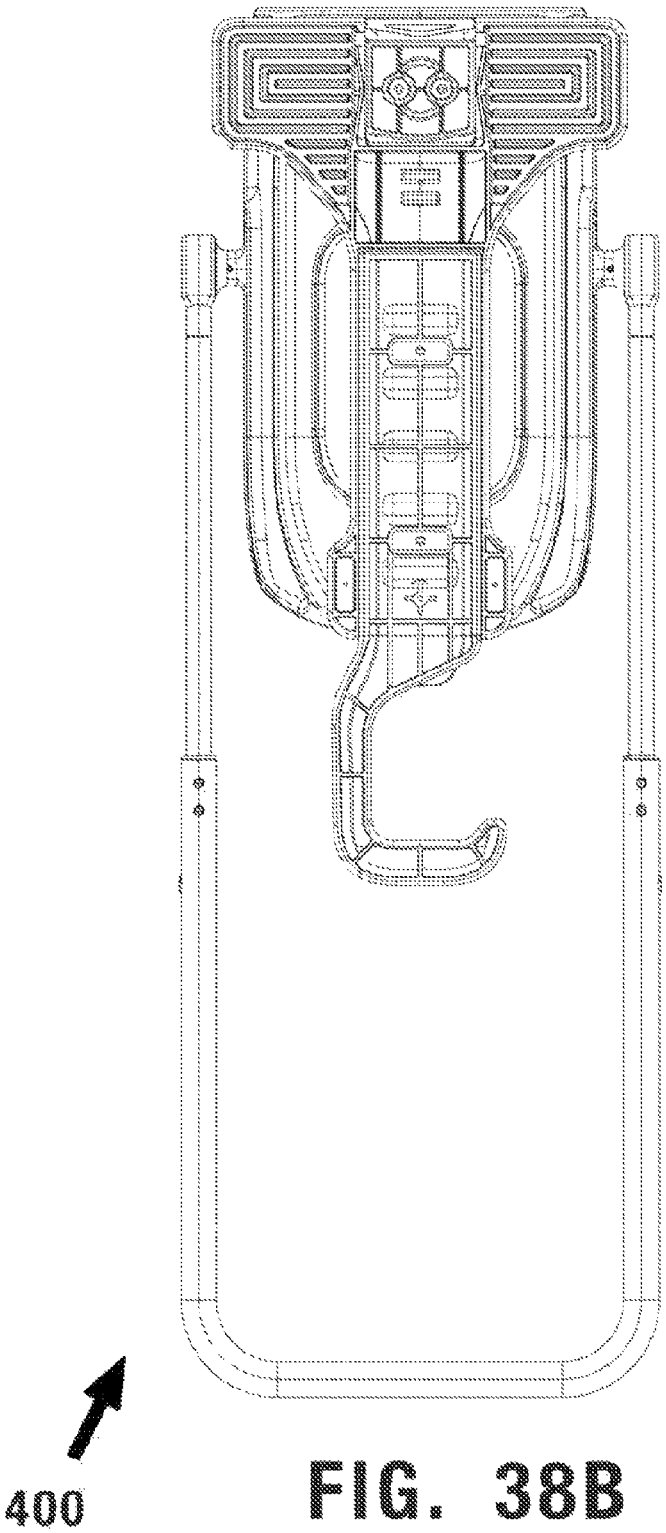
Figure 38C:
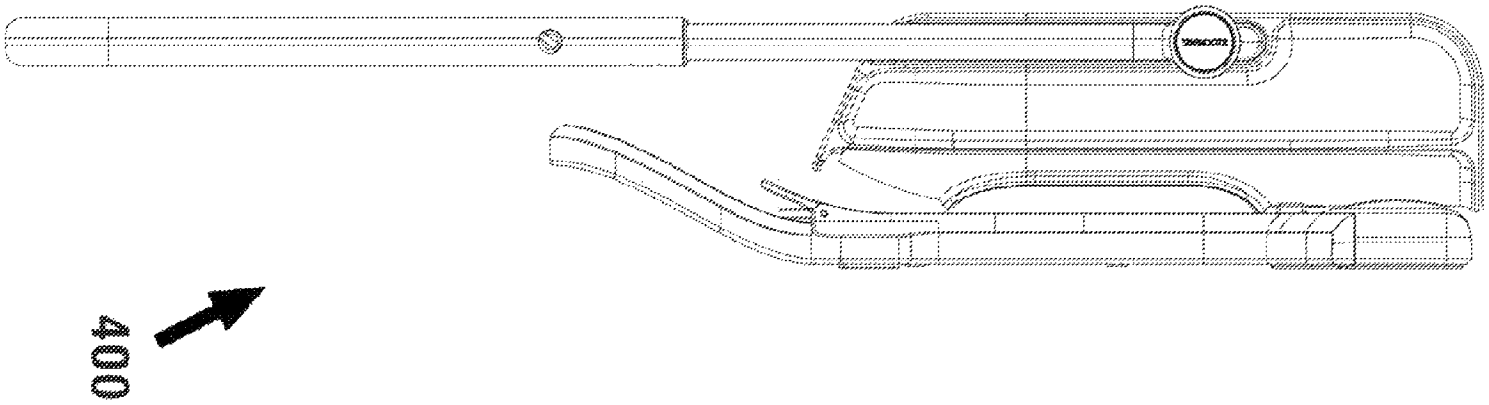
Figure 38D:
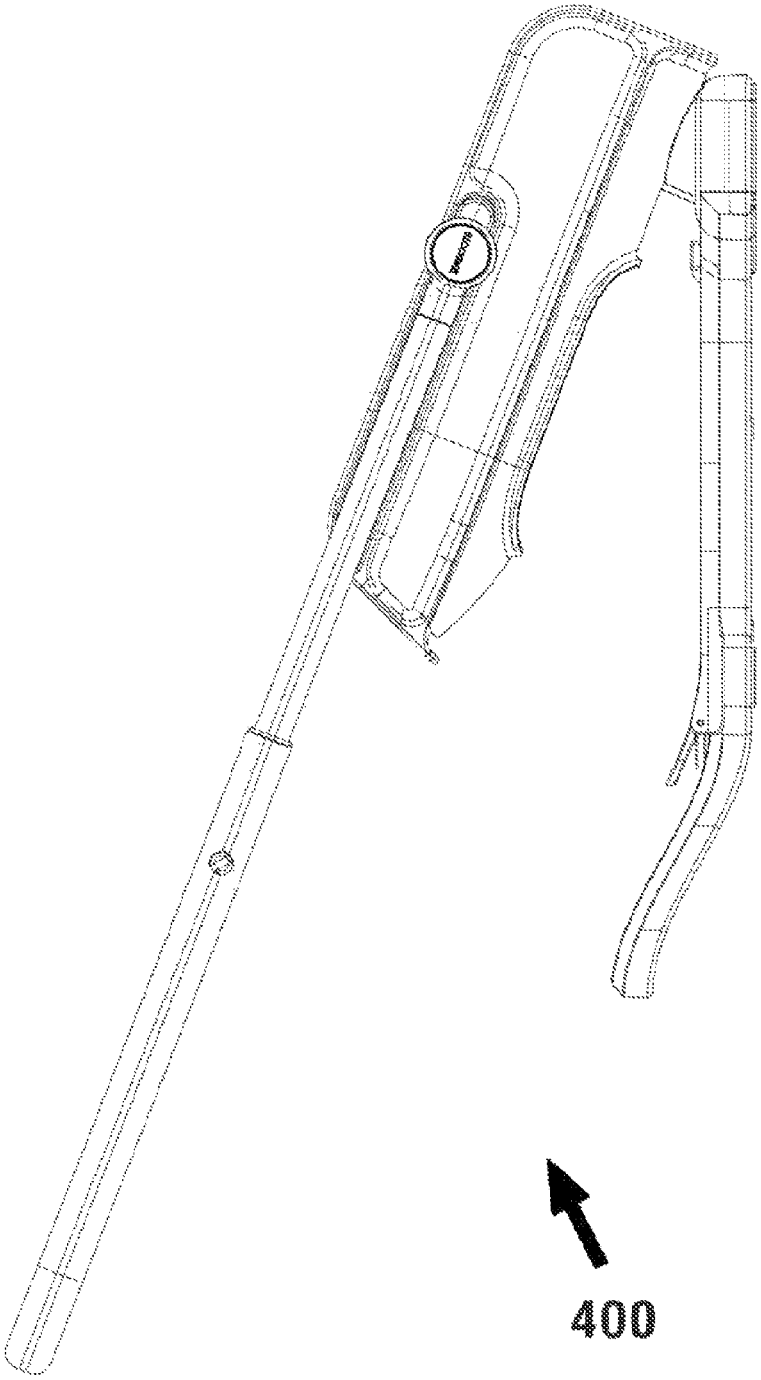
Figure 38E:
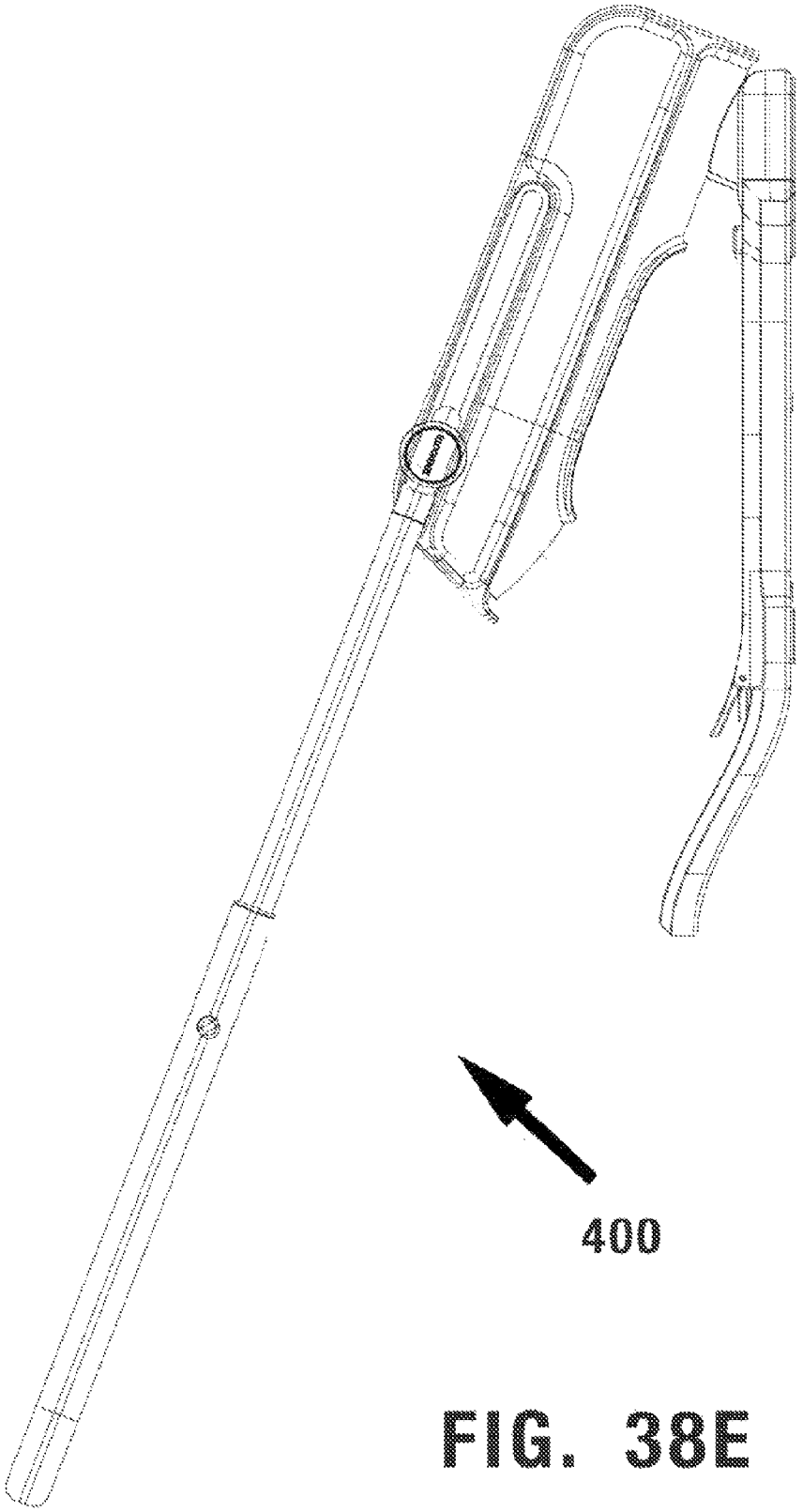

Reference is also made to FIG. 33, which demonstrates four stages 501-504 of a process of using the device 400 for wearing or putting-on a sock, in accordance with some demonstrative embodiments of the present invention.

Reference is further made to FIGS. 34A to 34H, which are additional schematic illustrations of the improved device 400 for wearing socks, and its improved components, in accordance with some demonstrative embodiments of the present invention.

Reference is further made to FIGS. 35A to 35F, which are further schematic illustrations of the improved device 400 for wearing socks, and its improved components, in accordance with some demonstrative embodiments of the present invention.

Reference is further made to FIGS. 36A to 36G, which are additional schematic illustrations of the improved device 400 for wearing socks, and its improved components, in accordance with some demonstrative embodiments of the present invention.

Reference is made to FIGS. 37A to 37H, which are schematic illustrations of the improved handle assembly and the improved caddy, of the improved device for wearing socks, in accordance with some demonstrative embodiments of the present invention.

Reference is further made to FIGS. 38A to 38E, which are additional schematic illustrations of the improved device 400 for wearing socks, and its improved components, in accordance with some demonstrative embodiments of the present invention.

The Applicants have realized that conventional sock-donning devices can be improved and/or modified, in a manner that would make them suitable for donning or for wearing of various types of socks, including, for example, compression socks, pressure socks, stockings, compression stockings, Thrombo-Embolic Deterrent (TED) Hose socks, TED Hose compression socks, or the like, and/or in a manner that would make them more useful for persons that are disabled or handicapped, or for older persons or for persons that suffer from a particular medical condition that makes it more difficult for them to put-on socks.

The Applicants have realized that conventional sock-donning devices may not enable a user to don, through such devices, an elongated sock and/or a compression sock and/or a TED Hose sock, due to the length and/or compression and/or elasticity and/or other features of such sock(s). In contrast, the improved sock-wearing device(s) of the present invention, may enable the user to don or to put-on such sock(s), efficiently and/or rapidly and/or easily.

The Applicants have realized that a single pole, or a single handle, or a single shaft, or a single pole assembly 71, may be insufficient or non-optimal for achieving the result of efficient and user-friendly donning of a sock. Accordingly, the Applicants have devised an improved Handle Assembly 410 (or a handle arrangement, or a handle structure), which has improved components, improved mode of operation, improved and more useful location, and other improved features.

The handle assembly 410 is located centrally to the device, instead of having the side-oriented location of the pole assembly 71. The Applicants have realized that a single pole assembly 71, that is located on the side of the device (e.g., entirely on the right side of the device; or entirely on the left side of the device), does not provide sufficient power or force or counter-force or leverage to the user operating the pole assembly, and/or does not provide efficient operation to the device.

The handle assembly 410 is located on top of, or above relative to, a caddy 413 or tube or semi-tube or foot-insertion component or foot-resting component, in which the user puts or inserts or rests his foot. The handle assembly 410 is structured not as a single pole and not as a single shaft, but rather, as a dual-pole or a generally-rectangular component or a "U" shaped component or an Upside-Down U-shaped handle assembly, or as an "n" shaped component or member, which allows the user to apply approximately 1.25 times or 1.50 times or twice (or more) the amount of force that is applied in a single pull, relative to using a single handle or single pole assembly. Additionally, the location of the handle assembly 410 within the device 400, rather than being at a side of the foot, and due to the improved location on top of (or above) the foot and the caddy 413, enables and/or ensures that most or all of the manual force(s) that are applied by the user, indeed translate or are converted directly and immediately into a sock-pulling operation of the device 400, without any loss of force(s) due to the previous side-location of the pole assembly 71.

The handle assembly 410 comprises, for example, a first pulling rod 411, which is generally perpendicular to a second pulling rod 412; and the two pulling rods 411-412 are connected at their top via a top-side bridge handle 415, which the user grasps or holds or grabs in order to simultaneously apply force (e.g., a pull force) on both of the rods 411-412, thereby allowing the user to utilize a single bridge handle 415 (e.g., pulled or operated by one hand of the user) in order to manipulate and control two generally-parallel pulling rods 411-412 which are located, in turn, on both the right side of his foot and the left side of his foot, and are both operated via the single bridge handle 415 which is located vertically on top of the foot or vertically relative to the foot.

It is noted that these important modifications and improvements, are not merely an ornamental modification and are not merely trivial design choices. Rather, they reflect particular, important, operational features, structural features, and functional features of the present invention. The Applicants have realized that this particular structure and operation of the handle assembly, and these particular location and features thereof, enable a more-efficient operation of the sock-wearing device and/or further enable a greater range of persons to utilize the device 400.

Additionally, the handle assembly 410 is free to move along or within or relative to a pair of two slider channels 421-422 (e.g., a right-side slider channel, and a left-side slider channel), which are located at or along two opposite sides of the improved caddy 413. For example, the handle assembly 410 may terminate with (or may be attached to, or may engage with) a pair of sliding connectors 431-432, each such sliding connector able to keep the handle assembly 410 connected and non-detachable from the improved caddy 413, while also allowing or enabling the handle assembly 410 to move along an additional degree of freedom, namely, enabling it the ability to move or to slide along the slider channels 421-422. Accordingly, in addition to the ability of the handle assembly 410 to move in a slanted or diagonal manner like a single pole or shaft (e.g., in a rotational movement relative to a single central point), the improved handle assembly 410 is further capable of sliding or moving along the improved caddy 413, via or within the slider channels 421-422; such that the points-of-connection or the edge-of-connection of the handle assembly 410 and the improved caddy 413 are not static but rather they are able to move or slide as the user operates (e.g., rotates, spins, pulls) the handle assembly 410.

Additionally or alternatively, the two slider channels 421-422 may assist the user in pulling upwardly the sock, during the sock-wearing operation that is performed via (or by utilizing) the device 400. The additional degree-of-freedom, that allows the handle assembly 410 to move in additional direction(s) and/or to slide horizontally within the slider channels 421-422, may thus assist the user in the entirety of the sock-wearing process, or at least in the later part of the sock-wearing process in which the sock is rolled-up along the leg of the user and/or towards the thigh of the user and/or towards the hip of the user.

Optionally, the handle assembly 410 may be structured by using telescopic mechanisms or other shrinkage/expansion mechanism; for example, by using two telescopic mechanisms 461-462 (e.g., a cylinder-within-cylinder mechanism) which allow the rods 411-412 to shrink (or to collapse, or to retrace) and to expand (or to extend, or to increase in length). Optionally, a ratchet mechanism or multiple ratchets, or position-locking elements or mechanisms, or a pin and hole mechanism, or a male-female mechanism, or other suitable mechanisms, may be incorporated into the handle assembly 410 in order to enable the user to selectively define and secure the desired length or size of the hand assembly 410, for example, at a particular length or size, or at pre-defined distance intervals or length intervals or size intervals.

Such telescopic mechanism(s), or other compression/expansion mechanisms of the handle assembly 410, may provide multiple benefits and advantages; for example, the ability of a single device 400 to accommodate and to serve a tall user and a short user; the ability to lift the device 400 from the floor (e.g., to transport it) without necessarily bending down; the ability to place the device on the ground or on the floor without necessarily bending down; the ability to efficiently use the user's arm muscles and/or hand muscles and/or other muscles (e.g., upper chest) during the operation of the sock-wearing functionality of the device.

These particular features and structure of the handle assembly 410 and its particular sliding interaction with the improved caddy 413 and the slider channels 421-422, enable the user to easily and efficiently apply additional force(s) to the operation of the handle assembly 410, and/or enable the user to apply an increased amount of force, and/or enable the device to utilize an increased amount of manual force applied by the user, and/or enable the device to accommodate and to serve users having different lengths of arms or hands or fingers or body-parts (e.g., without requiring a tall user to bend-down excessively; or without requiring a short user to extend his arm excessively).

Additionally, such particular structure, features and components allow the user of device 400 to apply additional force(s) towards the operation of the sock-wearing function, and to further extend the forces to be applied not only as rotational forces (e.g., as only a single, rotational force was applied to the non-moving and the only-rotating single pole assembly 71), but to also apply horizontal force(s) or other three-dimensional force(s) that are applied to the entire handle assembly 410 as it slides along the improved caddy 413.

The Applicants have further realized that previous components, which were intended to be used as a caddy (such as, caddy 113), can be improved and enhanced in order to enable a more-efficient sock-wearing process and in order to enhance user experience. For example, the Applicants have realized that caddy 113 has a main, elongated, surface on which the user mounts his foot, but lacks a suitable opening or structure for an ankle of the foot; and instead, is surrounded on its right-side and on its left-side by curved panels.

The Applicants have devised the improved caddy 413, which is structured in a novel manner that contributes to added convenience and increased efficiency in operating the device for wearing socks. The improved caddy 413 comprises a frame 444, which in turn includes multiple regions: a front-side (or toe-side) frame-region 444F, on which the toes of the user may rest; a right-side frame-region 444R, which supports or holds the right-side of the foot; a left-side frame-region 444L, which supports or holds the left-side of the foot; a back-side (or rear-side, or ankle-side) frame-region 444B, on which, typically, no part of the foot is intended to rest or to touch; and a central, hollow, frame-region 444C which has or comprises a hole or cavity or orifice or aperture, on which (or, in which) the ankle or ankle-area of the foot may rest or may be located.

The Applicants have realized that this particular structure of the improved caddy 413 may increase the efficiency and/or the usability of the device 400 and/or the user-convenience when utilizing the device 400. For example, the ankle of the user may be relatively free to hover over the hollow central frame-region 444C, and/or to sink downwardly and/or partially into the hollow aperture of the central frame-region 444C; thereby enabling the user to apply a better grip onto the device 400 via the user's ankle, and/or thereby enabling the user to better (or more efficiently) push the device 400 downwardly towards the floor or the ground and thus achieve more-efficient functionality of the device 400, and/or thereby preventing the user from being restricted to having his ankle on a flat surface, and providing increased freedom of movement to the ankle of the foot and/or to the rear-side of the foot during the sock-wearing operation, which in turn translate into more-efficient utilization of the muscles of the foot and to more-efficient sock-wearing functionality. In some embodiments, for example, the aperture in the improved caddy is structured to accommodate therein at least a portion of the ankle of the user, or at least a portion of a lower-surface or lower-region of the sole (the underside of the foot), in a manner that enables the user to push-down or to squeeze-down the improved caddy, downwardly towards the ground or the floor, thereby contributing or creating an additional force that pins-down the device 400 and/or the stabilizes the device 400 during the sock wearing process and thus enabling a smoother and more-reliable process.

The Applicants have further realized that an improved base-component may contribute to further increasing the efficiency of utilizing the sock-donning device. Instead of the narrow, elongated, base member 101, which necessarily relied upon a hook member 41 that was required to be connected to a chair or to a heavy furniture or anchor, the present invention comprises a stable base member 470 which may operate without the optional hook element 41. The improved, stable, base member 470 enables efficient and secure operation of the device 400, without requiring the device to be attached to, or hooked to, a leg of a chair or other furniture or anchor; and without necessarily requiring the now-optional hook element 41, which may be entirely removed or detached, thereby decreasing the weight and/or the size and/or the length and/or the dimensions and/or the form-factor of the device 400, and thereby increasing the ease-of-use of device 400, the ease of storage and transportation there, and thereby also allowing a reduction in costs and in breakable components, and a more efficient operation virtually anywhere without necessarily requiring the user to anchor the device to a leg of a furniture.

The improved base member 470 may be formed as a T-shaped element, having a front-side member 471 which is perpendicular to a central member 472. In some embodiments, the length of the central member 472, may be generally similar to, or identical to, the length of the front-side member 471. In some embodiments, the length of the central member 472, may be in the range of 80 to 99 percent of the length of the front-side member 471. In some embodiments, the length of the central member 472, may be in the range of 101 to 120 percent relative to the length of the front-side member 471. In some embodiments, the width of the central member 472, may be generally similar to, or identical to, the width of the front-side member 471. In some embodiments, the width of the central member 472, may be in the range of 80 to 99 percent of the width of the front-side member 471. In some embodiments, the width of the central member 472, may be in the range of 101 to 120 percent relative to the width of the front-side member 471. Other suitable ratios or values or ranges may be used.

In some embodiments, the structure of the improved base member 470 may be such that it enables secure attachment or secure holding or a secure pinning-down of the entirety of device 400 to a floor or to the ground by pressing-down of a human foot onto the improved caddy 413 and thereby creating a pin-down force of friction that stops the device 400 from moving sideways or back-and-forth relative to the ground or floor. For example, a bottom-side of the improved base member 470 may optionally comprise one or more rubber elements 475 or non-slip elements or no-skid elements or friction-creating elements, which may assist in securing the device 400 onto a stable position on the floor or on the ground, while also preventing slipping or sliding or skidding of the device 400 over such floor, and/or while also enabling efficient and easy and rapid removal or lifting of the device 400 from such floor (e.g., avoiding any long-term bonding of the device 400 to such floor).

The device of the present invention is particularly suitable for assisting a user to put on a medical sock or a sock having medical properties or "compression stockings" or a "pressure sock" or "pressure stocking" or an "elastic sock" or a high-elasticity sock, that is utilized by users that require such sock(s) for medical reasons; for example, due to vein problems, or due to a need to stand many hours per day, or for other conditions or reasons. Such "pressure sock" or "compression stocking" may be formed or knitted from one or more elastic fabric(s) and/or elastic material(s) in a manner that enables such sock to apply a high level of force or pressure on the veins and/or capillaries, thereby preventing accumulation of liquid(s) in the feet and/or legs and/or thereby improving the flow of blood therein. Since such "pressure sock" or "compression stocking" or highly-elastic sock has a high level of elasticity and is very tight, it may be difficult for a user to put on the sock around his foot and/or to pull-up the sock towards his upper leg or hip (such sock may reach up, even towards the knee or towards the hip).

The device of the present invention enables a user to easily and efficiently put-on such tight sock, by utilizing the particular structure and/or shape of the device as well as its particular curved (or semi-tubular) caddy or caddy-frame which has specific holes or craters or cavities that allow portion(s) of the sole and/or the ankle to rest therein and/or to enter therein. The mechanical mechanism of the device, when operated through the pulling of the handle assembly, causes the putting-on or the donning of the sock, onto the foot or sole, backwardly towards and onto the ankle, and then upwardly from the ankle towards the knee. The sliders mechanism and the handle assembly enable to put-up the tight sock all the way upwardly, optionally reaching up to the knee of the user; and from the knee and upward the user may utilize his hands to further put-on the tight sock upwardly towards the hip (if desired or if needed). The sock donning operation is performed while the user maintains his back (e.g., the back side of his body) at a straight and/or upright position, without needing to bend down or to curve his back; rather, the user holds the handle assembly for the purpose of moving the device, lifting or carrying the device, operating the donning process via the device, and/or otherwise handling the device.

It is noted that the device can be used by a right-handed user, as well as a left-handed user. Additionally, the same (e.g., single) device can be used for putting on a sock on the right foot; as well as for putting on a sock on the left foot; wherein both donning processes (for the right foot, and for the left foot) are generally identical processes. During the sock donning process, the device remains generally static or fixed and non-moving, for example, being pressed-down towards the floor and/or being anchored with an anchoring item (e.g., a chair or a sofa or a furniture item). Furthermore, the device need not be used only with elastic socks or medical socks, but rather, may be utilized with regular or conventional socks or with everyday socks or stockings, thereby making it a dual-purpose or multi-purpose device.

Referring again to FIG. 33 and the four stages 501-504 demonstrated therein, it is noted that the caddy comprises a cavity or crater or recess which accommodates the ankle or the back-portion of the sole or the back-region of the sole or the bottom-region of at least a part of the sole, thereby preventing the ankle or the foot to slide or to slid or to move (relative to the caddy) during the sock donning process; and/or thereby stabilizing or fixedly-maintaining the foot or the sole static (relative to the caddy) during the sock donning operation; and/or enabling the user to maintain a generally 90 degree angle between the sole of the foot and the leg, or between the foot and the leg, during the sock donning operation; and avoiding creation of a slanting of the leg relative to the foot (or the sole) during the sock donning process; as demonstrated particularly in stage 502. It is noted that without the particular recess or cavity or crater or hollow portion in the caddy, the human user would have needed to utilize the front-region of his foot in order to generate and constantly apply an immense amount of force downwardly in order to stabilize and/or immobilize the device, a force that is often beyond the capability of typical users.

In some embodiments, the device may comprise or may utilize a dual-axis gimbal or a dual-axis gimbaling mechanism, which enables the caddy to move along two generally-perpendicular axes or vectors or directions: (i) along the Pitch axis, and (ii) along the Yaw axis; and generally, without freedom of movement along the Roll axis. The dual-axis gimbal may comprise, or the dual-direction gimbaling mechanism may be implemented by using, one or more suitable components; for example, as shown in FIGS. 6A and 6B, the rectilinear tilt unit 62, the two head portions 111 and 112 of base 101, the tubular and annular pin 64, the forwardly positioned projection 67 of tilt unit 62, the two opposed pin holders 119, the central through-hole 61 through which a circular protruding part 118 of caddy 113 located in the vicinity of forward terminal edge 160 passes, the circular projection 86 protruding from flange 83, and/or other units shown in FIGS. 6A and/or 6B.

The freedom of movement of the caddy along the Pitch axis is demonstrated in FIGS. 20, 21 and 22. It enables the longest dimension of caddy to be generally horizontal (or, generally parallel to the ground) at the beginning of (or prior to) the sock donning process (as shown in FIG. 20); and then enabling the longest dimension of the caddy to become diagonal or slanted relative to the ground (as shown in FIG. 21); until it becomes generally perpendicular to the ground upon ending of the sock donning process (as shown in FIG. 22). The freedom of movement of the caddy along the Pitch axis enables the caddy to accompany the natural motion of the foot as the foot moves forward while the device performs the donning of the sock around the user's sole (or foot) and then ankle and then leg (or lower portion of the leg). Absent such freedom of movement of the device along the Pitch axis, the device would not be operable to perform and/or to complete the sock donning process, and the user's foot would remain stuck or fixed horizontally or generally-horizontally within the caddy.

The freedom of movement of the caddy along the Yaw axis (e.g., left and right in a circular or curved manner) is demonstrated in FIG. 29. It is enabled (e.g., only) in the initial part of the sock donning process or at the commencement of the sock donning process, while the caddy is still horizontal or generally-horizontal or generally-parallel to the floor; and it enables the user to comfortably and efficiently place his foot within the caddy, even if the caddy itself is not entirely aligned relative to the foot, such that the user can slightly move or "spin" the caddy (while it remains parallel to the ground) to allow insertion of the foot into the caddy. Once the caddy begins to move along the Pitch axis (e.g., when the caddy is no longer parallel to the floor, by rather, is slanted relative to the floor), the freedom of movement along the Yaw axis is stopped or prevented or locked or closed or ends. The Yaw movement of the caddy enables the user to comfortably and safely insert his foot into the caddy; and absent such Yaw freedom of movement at the initial steps of the process, the foot of the user would not be easily fit into the caddy, or the foot of the user may bump into a leg of a chair or sofa.

The dual-axis gimbal or gimbaling mechanism is located at the front side of the caddy, and not for example at the center or at the rear of the caddy; in order to enable correct, efficient, and/or ergonomic movement of the caddy together with the user's foot that is located within the caddy (or is approaching the caddy, or is being inserted into the caddy).

In some embodiments, a device for donning a sock comprises: a substantially horizontal base; an elongated U-shaped, semi-cylindrical caddy on which a sock positioned inside out is fittable and into an interior of which a foot is insertable; and a tilt unit coupled to said caddy and pivotally connected to a head portion of said base, wherein the tilt unit comprises a dual-axis gimbaling mechanism. The semi-cylindrical caddy comprises two elongated slider channels, that enable a handle assembly of the device to slide back-and-forth within said elongated slider channels. The device further includes the handle assembly, which comprises a right-side rod and a generally-parallel left-side rod which are interconnected by a generally-horizontal bridge handle.

In some embodiments, the right-side rod is located in its entirety on a right side of the foot when the foot is inserted into the semi-cylindrical caddy; and/or, the left-side rod is located in its entirety on a left side of the foot when the foot is inserted into the semi-cylindrical caddy.

In some embodiments, the generally-horizontal bridge handle is located above the foot during a sock donning process that is performed via the device.

In some embodiments, during a sock donning process, the handle assembly engages with the semi-cylindrical caddy by both (i) pivoting upwardly and (ii) sliding backwards.

In some embodiments, the right-side rod of the handle assembly comprises a first telescopic structure that enables the user to selectively extend or reduce a length of the right-side rod; wherein the left-side rod of the handle assembly comprises a telescopic structure that enables the user to selectively extend or reduce a length of the left-side rod; wherein the bridge handle, that interconnects the right-side rod and the left-side rod, is a non-telescopic handle and has a fixed length.

In some embodiments, the semi-cylindrical caddy comprises a hollow frame; wherein a central cavity of said hollow frame accommodates thereon an ankle of the foot; wherein a front-side of said hollow frame accommodates thereon toes of the foot.

In some embodiments, the semi-cylindrical caddy comprises a hollow frame; wherein a central cavity of said hollow frame accommodates thereon an ankle of the foot; wherein a front-side of said hollow frame accommodates thereon toes of the foot; wherein said central cavity, when a sole of the foot is laid therein, enables a friction force between the foot and the semi-cylindrical caddy which prevents the foot from sliding along the semi-cylindrical caddy.

In some embodiments, the semi-cylindrical caddy comprises a hollow frame; wherein a central cavity of said hollow frame accommodates thereon a rear portion of a sole of the foot; wherein a front-side of said hollow frame accommodates thereon toes of the foot; wherein said hollow frame enables the user to pin-down said device towards a floor by applying a downward force at the sole of the foot, and/or enables the user to pin-down his foot or his sole downwardly towards the caddy to avoid slipping or sliding of his foot relative to the caddy.

In some embodiments, the device comprises a base member to enable a user to secure the device onto a floor by pressing-down with the foot downwardly through the semi-cylindrical caddy. In some embodiments, a bottom-side of the base member comprises a set of rubber members to temporarily and securely stabilize the base member onto the floor without permanently connecting the base member to the floor.

In some embodiments, the device comprises a hook member to anchor the device to an anchoring item (e.g., a furniture leg) which is external to the device and which is separate from the device.

In some embodiments, the device has at least three location-securing mechanisms for fixedly securing a location of the device during a sock donning operation; wherein a first location-securing mechanism is said hook member; wherein a second location-securing mechanism is said set of rubber members under said bottom-side of the base member; wherein a third location-securing mechanism is said hollow frame having said central cavity of said semi-cylindrical caddy. In some embodiments, at least two of these three location-securing mechanisms, or all three of them, are comprised in the device.

In some embodiments, the dual-axis gimbaling mechanism, which is connected to the head portion of the base, (I) is coupled to a front end of the caddy, and (II) enables the caddy to move along a Pitch freedom of movement axis during a sock donning process, and (III) enables the caddy to move along a Yaw freedom of movement axis only at an initial portion of the sock donning process while the caddy is generally parallel to a ground.

In some embodiments, an apparatus for donning socks comprises: a substantially horizontal base; an elongated U-shaped, semi-cylindrical caddy on which a sock positioned inside out is fittable and into an interior of which a foot is insertable; and a tilt unit coupled to said caddy and pivotally connected to a head portion of said base; wherein the semi-cylindrical caddy comprises two elongated slider channels, that enable a handle assembly of the device to slide back-and-forth within said elongated slider channels; wherein the apparatus further comprises said handle assembly, which comprises a right-side rod and a generally-parallel left-side rod which are interconnected by a generally-horizontal bridge handle; wherein the right-side rod is located in its entirety on a right side of the foot when the foot is inserted into the semi-cylindrical caddy; wherein the left-side rod is located in its entirety on a left side of the foot when the foot is inserted into the semi-cylindrical caddy; wherein the generally-horizontal bridge handle is located above the foot during a sock donning process that is performed via the device; wherein during a sock donning process, the handle assembly engages with the semi-cylindrical caddy by both (i) pivoting upwardly and (ii) sliding backwards; wherein the right-side rod of the handle assembly comprises a first telescopic structure that enables the user to selectively extend or reduce a length of the right-side rod; wherein the left-side rod of the handle assembly comprises a telescopic structure that enables the user to selectively extend or reduce a length of the left-side rod; wherein the bridge handle, that interconnects the right-side rod and the left-side rod, is a non-telescopic handle and has a fixed length; wherein the semi-cylindrical caddy comprises a hollow frame; wherein a central cavity of said hollow frame accommodates thereon an ankle of the foot; wherein a front-side of said hollow frame accommodates thereon toes of the foot; wherein said central cavity, when a sole of the foot is laid therein, enables a friction force between the foot and the semi-cylindrical caddy which prevents the foot from sliding along the semi-cylindrical caddy; wherein said hollow frame enables the user to pin-down said device towards a floor by applying a downward force at the sole of the foot; a base member to enable a user to secure the device onto a floor by pressing-down with the foot downwardly through the semi-cylindrical caddy; wherein a bottom-side of the base member comprises a set of rubber members to temporarily and securely stabilize the base member onto the floor without permanently connecting the base member to the floor; wherein the dual-axis gimbaling mechanism, which is connected to the head portion of the base, (I) is coupled to a front end of the caddy, and (II) enables the caddy to move along a Pitch freedom of movement axis during a sock donning process, and (III) enables the caddy to move along a Yaw freedom of movement axis only at an initial portion of the sock donning process while the caddy is generally parallel to a ground.

Functions, operations, components and/or features described herein with reference to one or more embodiments, may be combined with, or may be utilized in combination with, one or more other functions, operations, components and/or features described herein with reference to one or more other embodiments of the present invention.

While certain features of the present invention have been illustrated and described herein, many modifications, substitutions, changes, and equivalents may occur to those skilled in the art. Accordingly, the claims are intended to cover all such modifications, substitutions, changes, and equivalents.

What is claimed is:

1. A device for donning socks, comprising:

a substantially horizontal base;

an elongated U-shaped, semi-cylindrical caddy on which a sock positioned inside out is fittable and into an interior of which a foot is insertable; and a tilt unit coupled to said caddy and pivotally connected to a head portion of said base, wherein the tilt unit comprises a dual-axis gimbaling mechanism;

wherein the semi-cylindrical caddy comprises two elongated slider channels, that enable a handle assembly of the device to slide back-and-forth within said elongated slider channels;

wherein the device further comprises a hook member to anchor the device to an anchoring item which is external to the device and is separate from the device.

2. The device of claim 1, further comprising said handle assembly, which comprises a right-side rod and a generally-parallel left-side rod which are interconnected by a generally-horizontal bridge handle.

3. The device of claim 2, wherein the right-side rod is located in its entirety on a right side of the foot when the foot is inserted into the semi-cylindrical caddy;

wherein the left-side rod is located in its entirety on a left side of the foot when the foot is inserted into the semi-cylindrical caddy.

4. The device of claim 2, wherein the generally-horizontal bridge handle is located above the foot during a sock donning process that is performed via the device.

5. The device of claim 2, wherein during a sock donning process, the handle assembly engages with the semi-cylindrical caddy by both (i) pivoting upwardly and (ii) sliding backwards.

6. A device for donning socks, comprising:

a substantially horizontal base;

an elongated U-shaped, semi-cylindrical caddy on which a sock positioned inside out is fittable and into an interior of which a foot is insertable; and a tilt unit coupled to said caddy and pivotally connected to a head portion of said base, wherein the tilt unit comprises a dual-axis gimbaling mechanism;

wherein the semi-cylindrical caddy comprises two elongated slider channels, that enable a handle assembly of the device to slide back-and-forth within said elongated slider channels;

wherein the device further comprises said handle assembly, which comprises a right-side rod and a generally-parallel left-side rod which are interconnected by a generally-horizontal bridge handle;

wherein the right-side rod of the handle assembly comprises a first telescopic structure that enables the user to selectively extend or reduce a length of the right-side rod;

wherein the left-side rod of the handle assembly comprises a telescopic structure that enables the user to selectively extend or reduce a length of the left-side rod;

wherein the bridge handle, that interconnects the right-side rod and the left-side rod, is a non-telescopic handle and has a fixed length.

7. The device of claim 1, wherein the semi-cylindrical caddy comprises a hollow frame;

wherein a central cavity of said hollow frame accommodates thereon an ankle of the foot; wherein a front-side of said hollow frame accommodates thereon toes of the foot.

8. The device of claim 1, wherein the semi-cylindrical caddy comprises a hollow frame;

wherein a central cavity of said hollow frame accommodates thereon an ankle of the foot; wherein a front-side of said hollow frame accommodates thereon toes of the foot;

wherein said central cavity, when a sole of the foot is laid therein, enables a friction force between the foot and the semi-cylindrical caddy which prevents the foot from sliding along the semi-cylindrical caddy.

9. The device of claim 1, wherein the semi-cylindrical caddy comprises a hollow frame;

wherein a central cavity of said hollow frame accommodates thereon a rear portion of a sole of the foot;

wherein a front-side of said hollow frame accommodates thereon toes of the foot;

wherein said hollow frame enables the user to pin-down said device towards a floor by applying a downward force at the sole of the foot.

10. A device for donning socks, comprising:

a substantially horizontal base;

an elongated U-shaped, semi-cylindrical caddy on which a sock positioned inside out is fittable and into an interior of which a foot is insertable; and a tilt unit coupled to said caddy and pivotally connected to a head portion of said base, wherein the tilt unit comprises a dual-axis gimbaling mechanism;

wherein the semi-cylindrical caddy comprises two elongated slider channels, that enable a handle assembly of the device to slide back-and-forth within said elongated slider channels;

wherein the device further comprises said handle assembly, which comprises a right-side rod and a generally-parallel left-side rod which are interconnected by a generally-horizontal bridge handle;

wherein the device comprises a base member to enable a user to secure the device onto a floor by pressing-down with the foot downwardly through the semi-cylindrical caddy.

11. The device of claim 10, wherein a bottom-side of the base member comprises a set of rubber members to temporarily and securely stabilize the base member onto the floor without permanently connecting the base member to the floor.

12. The device of claim 11, wherein the device has at least three location-securing mechanisms for fixedly securing a location of the device during a sock donning operation, wherein a first location-securing mechanism is said hook member, wherein a second location-securing mechanism is said set of rubber members under said bottom-side of the base member, wherein a third location-securing mechanism is said hollow frame having said central cavity of said semi-cylindrical caddy.

13. The device of claim 1, wherein the dual-axis gimbaling mechanism, which is connected to the head portion of the base, (I) is coupled to a front end of the caddy, and (II) enables the caddy to move along a Pitch freedom of movement axis during a sock donning process, and (III) enables the caddy to move along a Yaw freedom of movement axis only at an initial portion of the sock donning process while the caddy is generally parallel to a ground.

14. An apparatus for donning socks, comprising:

a substantially horizontal base;

an elongated U-shaped, semi-cylindrical caddy on which a sock positioned inside out is fittable and into an interior of which a foot is insertable; and a tilt unit coupled to said caddy and pivotally connected to a head portion of said base, wherein the tilt unit comprises a dual-axis gimbaling mechanism;

wherein the semi-cylindrical caddy comprises two elongated slider channels, that enable a handle assembly of the device to slide back-and-forth within said elongated slider channels;

wherein the apparatus further comprises said handle assembly, which comprises a right-side rod and a generally-parallel left-side rod which are interconnected by a generally-horizontal bridge handle;

wherein the right-side rod is located in its entirety on a right side of the foot when the foot is inserted into the semi-cylindrical caddy;

wherein the left-side rod is located in its entirety on a left side of the foot when the foot is inserted into the semi-cylindrical caddy;

wherein the generally-horizontal bridge handle is located above the foot during a sock donning process that is performed via the device;

wherein during a sock donning process, the handle assembly engages with the semi-cylindrical caddy by both (i) pivoting upwardly and (ii) sliding backwards;

wherein the right-side rod of the handle assembly comprises a first telescopic structure that enables the user to selectively extend or reduce a length of the right-side rod;

wherein the left-side rod of the handle assembly comprises a telescopic structure that enables the user to selectively extend or reduce a length of the left-side rod;

wherein the bridge handle, that interconnects the right-side rod and the left-side rod, is a non-telescopic handle and has a fixed length;

wherein the semi-cylindrical caddy comprises a hollow frame;

wherein a central cavity of said hollow frame accommodates thereon an ankle of the foot;

wherein a front-side of said hollow frame accommodates thereon toes of the foot;

wherein said central cavity, when a sole of the foot is laid therein, enables a friction force between the foot and the semi-cylindrical caddy which prevents the foot from sliding along the semi-cylindrical caddy;

wherein said hollow frame enables the user to pin-down said device towards a floor by applying a downward force at the sole of the foot;

a base member to enable a user to secure the device onto a floor by pressing-down with the foot downwardly through the semi-cylindrical caddy;

wherein a bottom-side of the base member comprises a set of rubber members to temporarily and securely stabilize the base member onto the floor without permanently connecting the base member to the floor;

wherein the dual-axis gimbaling mechanism, which is connected to the head portion of the base, (I) is coupled to a front end of the caddy, and (II) enables the caddy to move along a Pitch freedom of movement axis during a sock donning process, and (III) enables the caddy to move along a Yaw freedom of movement axis only at an initial portion of the sock donning process while the caddy is generally parallel to a ground.

* * * * *